US005478212A

United States Patent [19]

Sakai et al.

[11] Patent Number: 5,478,212

[45] Date of Patent: Dec. 26, 1995

[54] SWASH PLATE TYPE COMPRESSOR

[75] Inventors: Takeshi Sakai, Chiryu; Mitsuo Inagaki, Okazaki; Masafumi Nakashima, Anjyo; Manabu Saiki, Chiryu, all of Japan

[73] Assignees: Nippondenso Co., Ltd., Kariya; Nippon Soken Inc., Nishio, both of Japan

[21] Appl. No.: 316,032

[22] Filed: Sep. 30, 1994

Related U.S. Application Data

[63] Continuation-in-part of Ser. No. 26,058, Mar. 13, 1993, Pat. No. 5,362,208.

[30] Foreign Application Priority Data

| | | | |
|---|---|---|---|
| Mar. 4, 1992 | [JP] | Japan | 4-46974 |
| May 6, 1992 | [JP] | Japan | 4-113716 |
| Jan. 13, 1993 | [JP] | Japan | 5-3995 |
| Aug. 26, 1993 | [JP] | Japan | 5-211810 |
| Sep. 21, 1993 | [JP] | Japan | 5-234868 |

[51] Int. Cl.[6] ..... F04B 1/12

[52] U.S. Cl. ..... 417/269; 417/222.2; 91/499

[58] Field of Search ..... 417/269, 222.1, 417/222.2, 270; 91/499

[56] References Cited

U.S. PATENT DOCUMENTS

| | | | |
|---|---|---|---|
| 2,160,978 | 6/1939 | Molk | 417/269 |
| 2,671,606 | 3/1954 | Ricardo | 417/270 |
| 3,482,521 | 12/1969 | Wolf | 417/269 |
| 3,696,710 | 10/1972 | Ortelli | 137/625.21 |
| 3,817,660 | 6/1974 | Knowles et al. | 417/269 |
| 4,007,663 | 7/1977 | Nagatomo et al. | 417/269 |
| 4,174,191 | 11/1979 | Roberts | 417/269 |
| 4,723,891 | 2/1988 | Takenaka et al. | 417/222 |
| 4,781,539 | 11/1988 | Ikeda et al. | 417/269 |
| 5,032,060 | 7/1991 | Kobayashi | 417/269 |
| 5,207,078 | 5/1993 | Kimura | 417/269 |
| 5,232,349 | 8/1993 | Kimura | 417/222.1 |
| 5,267,839 | 12/1993 | Kimura | 417/517 |
| 5,286,173 | 2/1994 | Takenaka et al. | 417/269 |
| 5,342,178 | 8/1994 | Kimura | 417/269 |

FOREIGN PATENT DOCUMENTS

| | | |
|---|---|---|
| 4229069 | 3/1993 | Germany . |
| 4235715 | 4/1993 | Germany . |
| 60-003995 | 2/1985 | Japan . |
| 5113174 | 3/1993 | Japan . |
| 5-66066 | 3/1993 | Japan . |
| 5-71467 | 3/1993 | Japan . |
| 5071468 | 3/1993 | Japan . |
| 5126038 | 5/1993 | Japan . |
| 5126039 | 5/1993 | Japan . |
| 5126040 | 5/1993 | Japan . |
| 5164044 | 6/1993 | Japan . |
| 5306680 | 11/1993 | Japan . |
| 5312145 | 11/1993 | Japan . |

*Primary Examiner*—Timothy S. Thorpe
*Assistant Examiner*—Peter G. Korytnyk
*Attorney, Agent, or Firm*—Cushman, Darby & Cushman

[57] ABSTRACT

A swash plate type variable capacity compressor having rotary valves that rotate together on a rotating shaft. The rotary valves are arranged on the shaft in such a manner that, upon one complete rotation, the rotary valves are connected, in sequential manner, for respective rotating angles, with circumferentially spaced piston chambers via respective intake passageways on the rotary valves. The arrangement between the intake passageways and the piston chamber changes in accordance with the axial position of the rotary valves on the shaft. Control of the rotating angle varies the effective volume of the piston chambers, thereby continuously varying the compressor capacity.

13 Claims, 45 Drawing Sheets

MAXIMUM CAPACITY

TOP DEAD CENTER

BOTTOM DEAD CENTER

Fig. 10A(1)
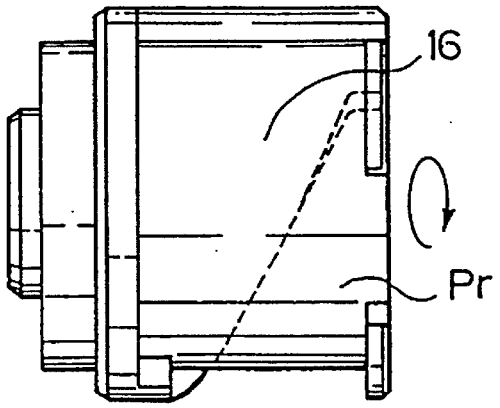
Fig. 10B(1)
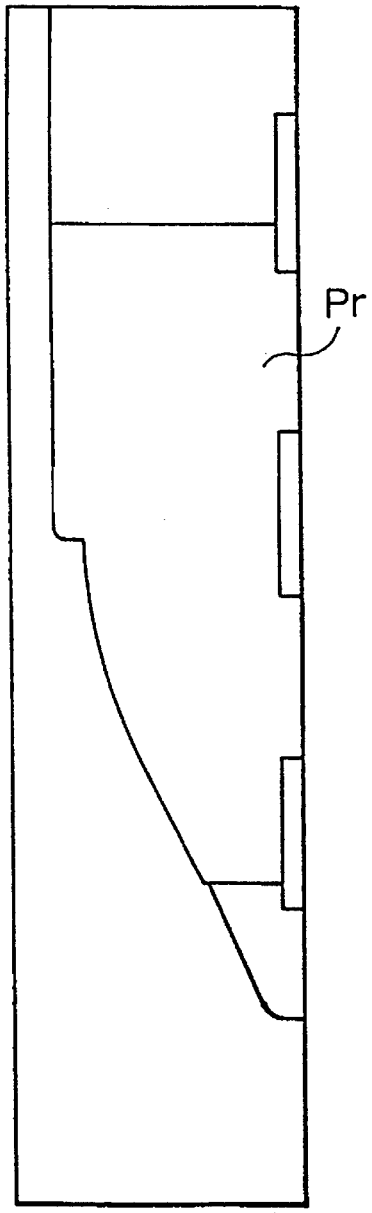

MAXIMUM CAPACITY
Fig.10A(2)
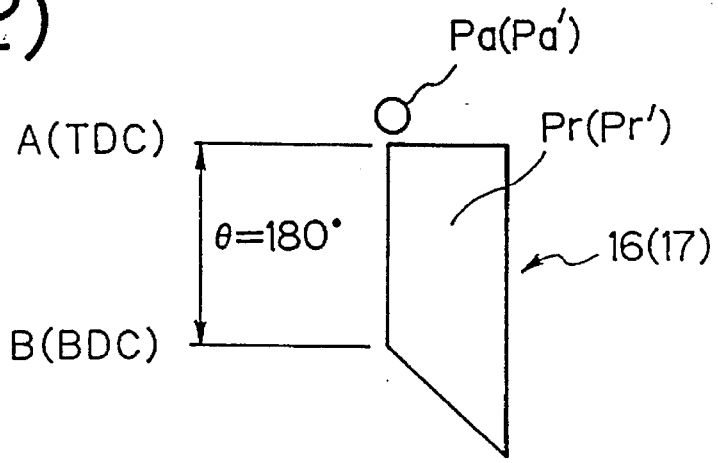
MINIMUM CAPACITY
Fig.10B(2)
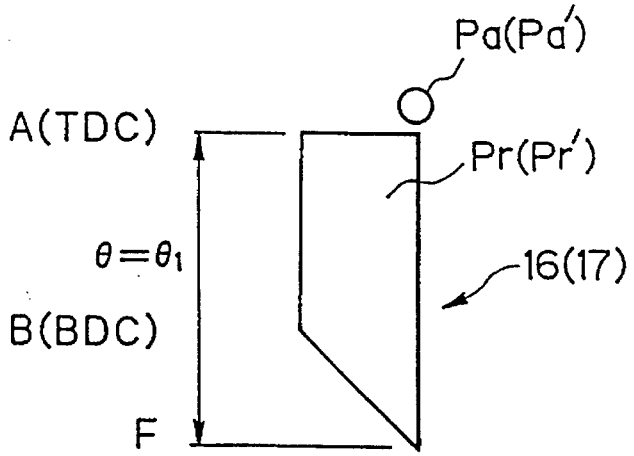

MAXIMUM CAPACITY

MINIMUM CAPACITY

BOTTOM DEAD CENTER

SWASH PLATE TYPE COMPRESSOR

This is a continuation-in-part of application Ser. No. 08/026,058 filed on May 13, 1993, now U.S. Pat. No. 5,362,208.

BACKGROUND OF THE INVENTION

1. Field of the Invention

The present invention relates to a swash plate type compressor, which is, for example, used for a refrigerant compressor of an air conditioning apparatus in an automobile.

2. Description of the Related Art

Known in the prior art is a compressor that is provided with a cylinder block defining bores, with pistons axially and slidably inserted in the respective bores so that piston chambers are created. A rotating shaft with respect to the cylinder block, and a swash plate mounted to a rotating shaft are connected to pistons so that an axial movement of the pistons is obtained in the cylinder bores. A means is further provided for controlling an inclination angle of the swash plate with respect to the axis of rotation of the rotating shaft for obtaining various compressor capacities.

The prior art compressor is, however, disadvantageous in that the construction for changing the inclined angle of the swash plate is complicated, which reduces efficiency when it is produced. Furthermore, it is not very reliable, in particular, under high rotational speed conditions.

SUMMARY OF THE INVENTION

An object of the present invention is to provide a swash plate type variable compressor, having a simplified construction which is efficient when produced, and which is reliable under high rotational speed operations.

According to the present invention, a variable capacity swash plate type compressor provided, comprises a rotating shaft adapted for connection to the source of ratio. A cylinder block is rotated with the rotating shaft and forms a plurality of circumferentially spaced cylinder bores each extending parallel to an axis of the rotating shaft. A plurality of pistons are axially and slidably stored in the respective cylinder bore so that piston chambers are formed on respective sides of the pistons. A swash plate is fixedly connected to the rotating shaft, which is connected to an axial reciprocal movement of the piston and moves when the shaft is rotated. The volume of the piston chambers alternately increase or decrease upon the axial reciprocal movement of the corresponding piston. The cylinder block forms therein an intake pressure chamber that is connected to a source of medium to be compressed, and an outlet pressure chamber removes compressed medium. Intake means controls introduction of the medium from the intake pressure chamber to the piston chambers and a discharge means controls a discharge of the medium from the piston chambers to the outlet pressure chamber. The intake means comprises a rotary valve that is axially slidable with respect to the shaft while rotating together with the shaft, and control means for controlling an axial position of the rotary valve on the shaft.

The rotary valve successively controls communication of the intake pressure chamber with the circumferentially spaced piston chambers at respective ranges of a rotating angle through one complete rotation of the rotary valve, introduces the medium to the respective piston chambers. The angle is controlled in accordance with the axial position of the rotary valve as obtained by the axial position control means.

The rotary valve of the simplified construction of the present invention axially moves on the rotating shaft and varies the capacity irrespective of its relatively simplified construction as compound with that of the prior art, in which an angle of a swash plate is controlled to vary the capacity. Furthermore, the manufacturing process is easier, and a reliable high speed operation can be obtained.

BRIEF DESCRIPTION OF ATTACHED DRAWINGS

FIG. 10A(1) shows a side elevational view of a rotary valve in a second embodiment.

FIG. 10B(1) shows a developed view of the outer cylindrical surface of the rotary valve in FIG. 10A(1).

FIGS. 10A(2) and 10B(2) show schematic views illustrating a relationship between the intake passageway with the intake port under the maximum and minimum capacity condition, respectively, in the second embodiment.

Figure 9A:
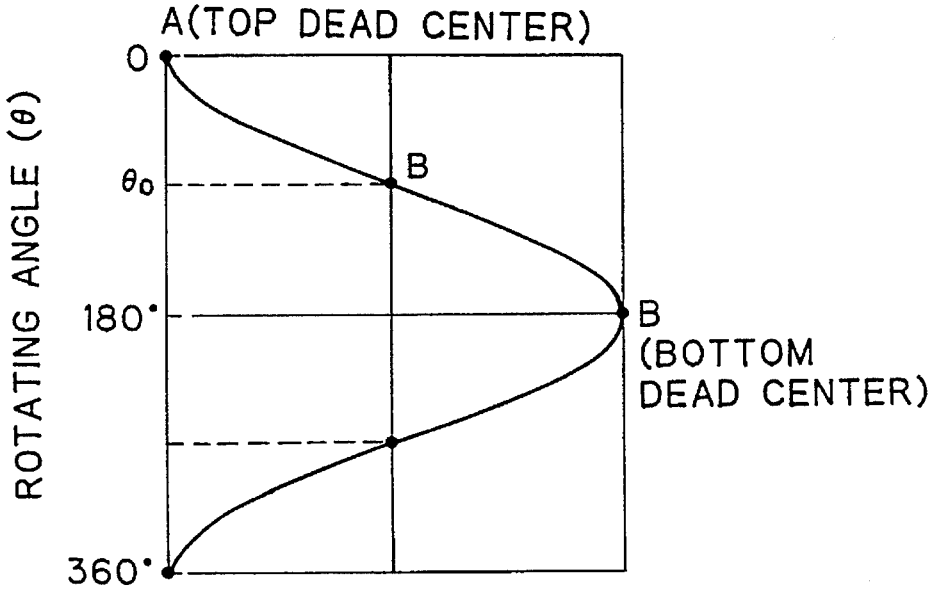
FIG. 9A shows a relationship between the rotating angle and the volume of a piston chamber of the compressor in the first embodiment of the present invention.
Figure 9B:
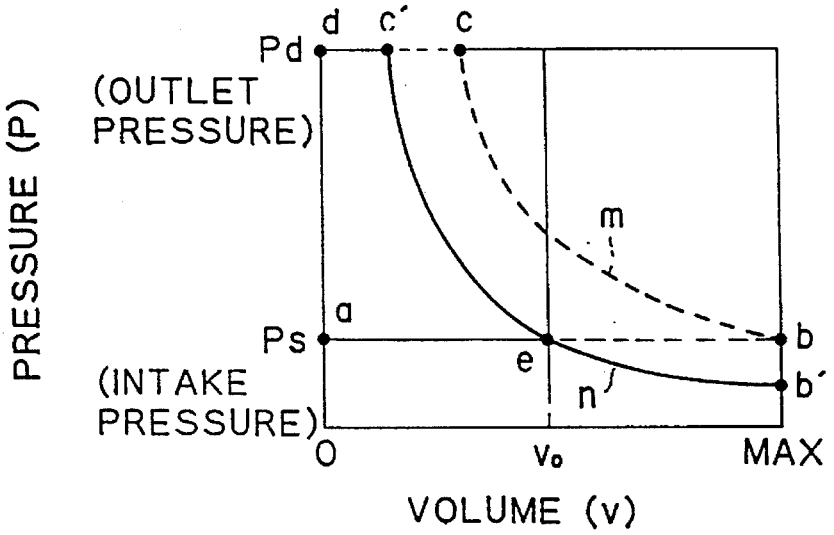
FIG. 9B shows a relationship between the volume of the piston chamber and the pressure therein.
Figure 11A:
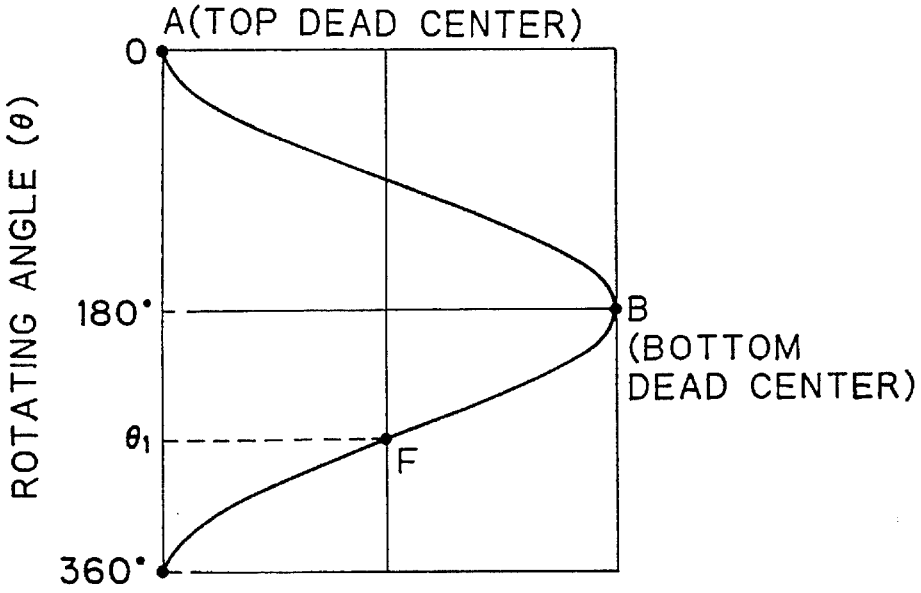
Figure 11B:
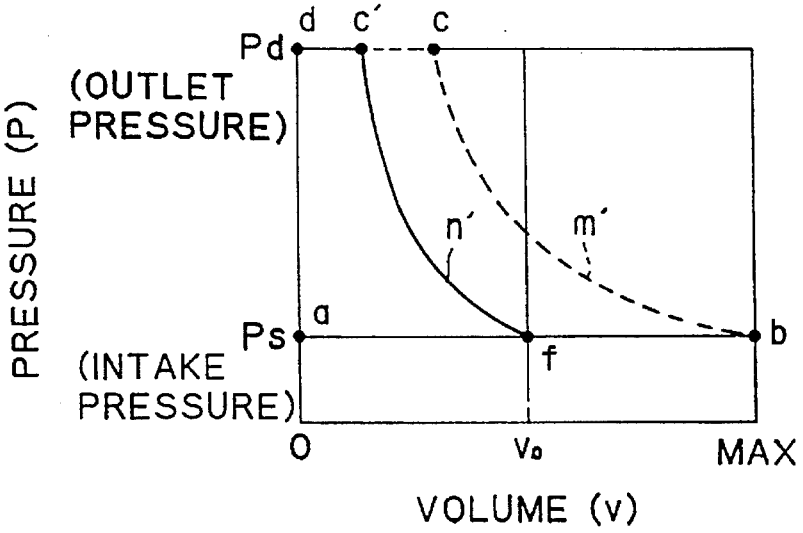

FIGS. 11A and 11B are similar to FIGS. 9A and 9B, but directed to the second embodiment of the compressor provided with the rotary valve as shown in FIG. 10.

Figure 1:
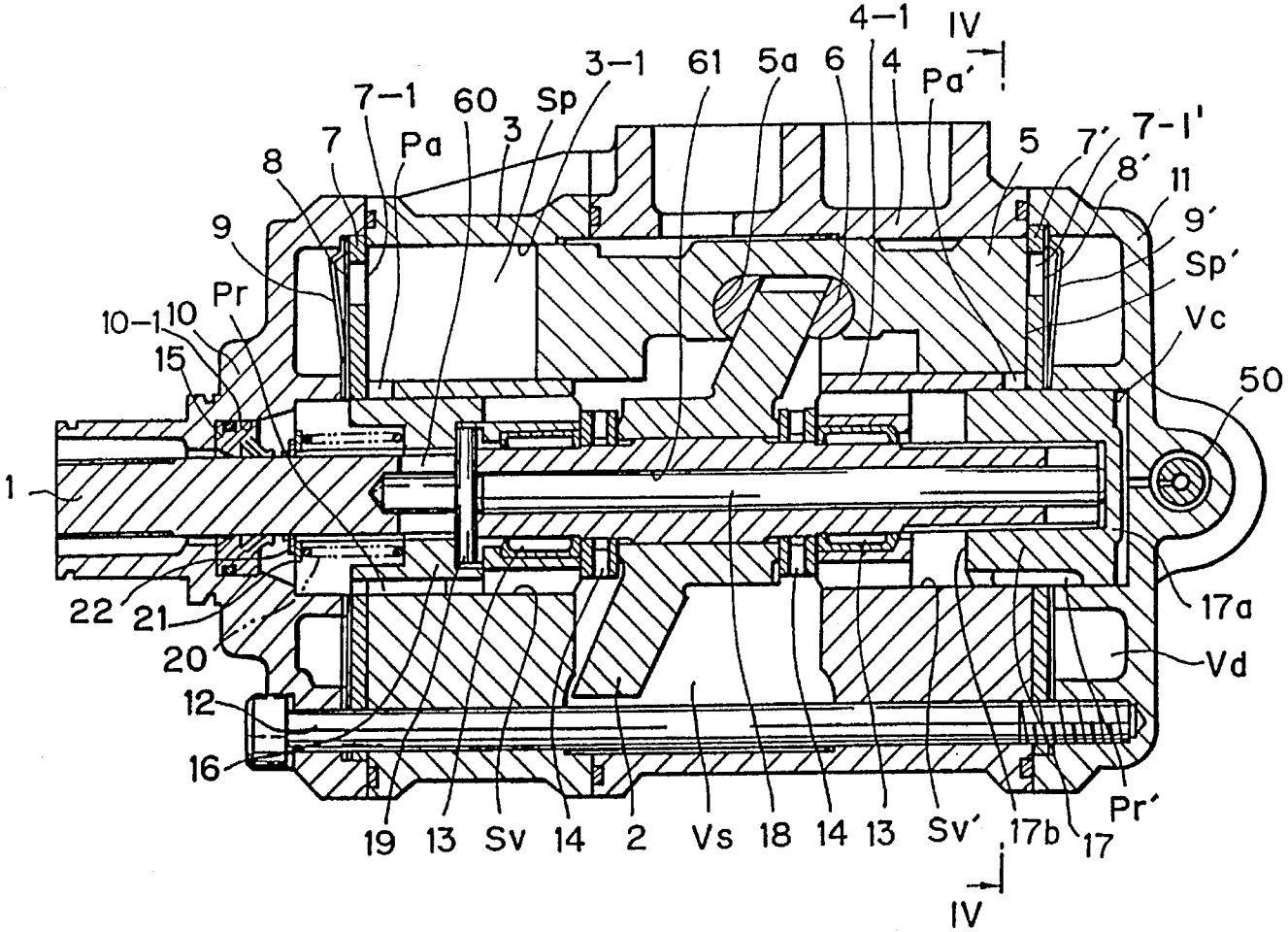
FIG. 1 is a longitudinal cross-sectional view of a swash plate type compressor according to a first embodiment of the present invention when under minimum capacity conditions, taken along a line I—I in FIG. 4.
Figure 12:
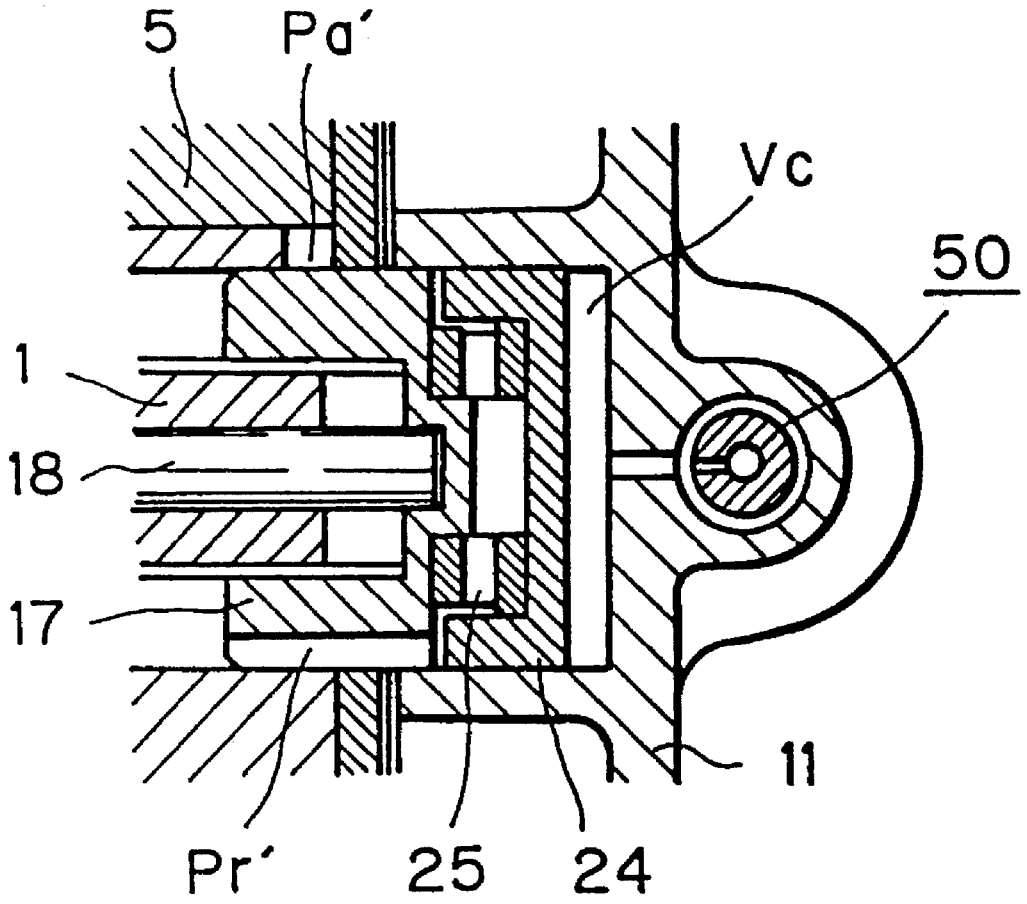

FIG. 12 shows a modification of a control valve in the first embodiment in FIG. 1.

Figure 13:
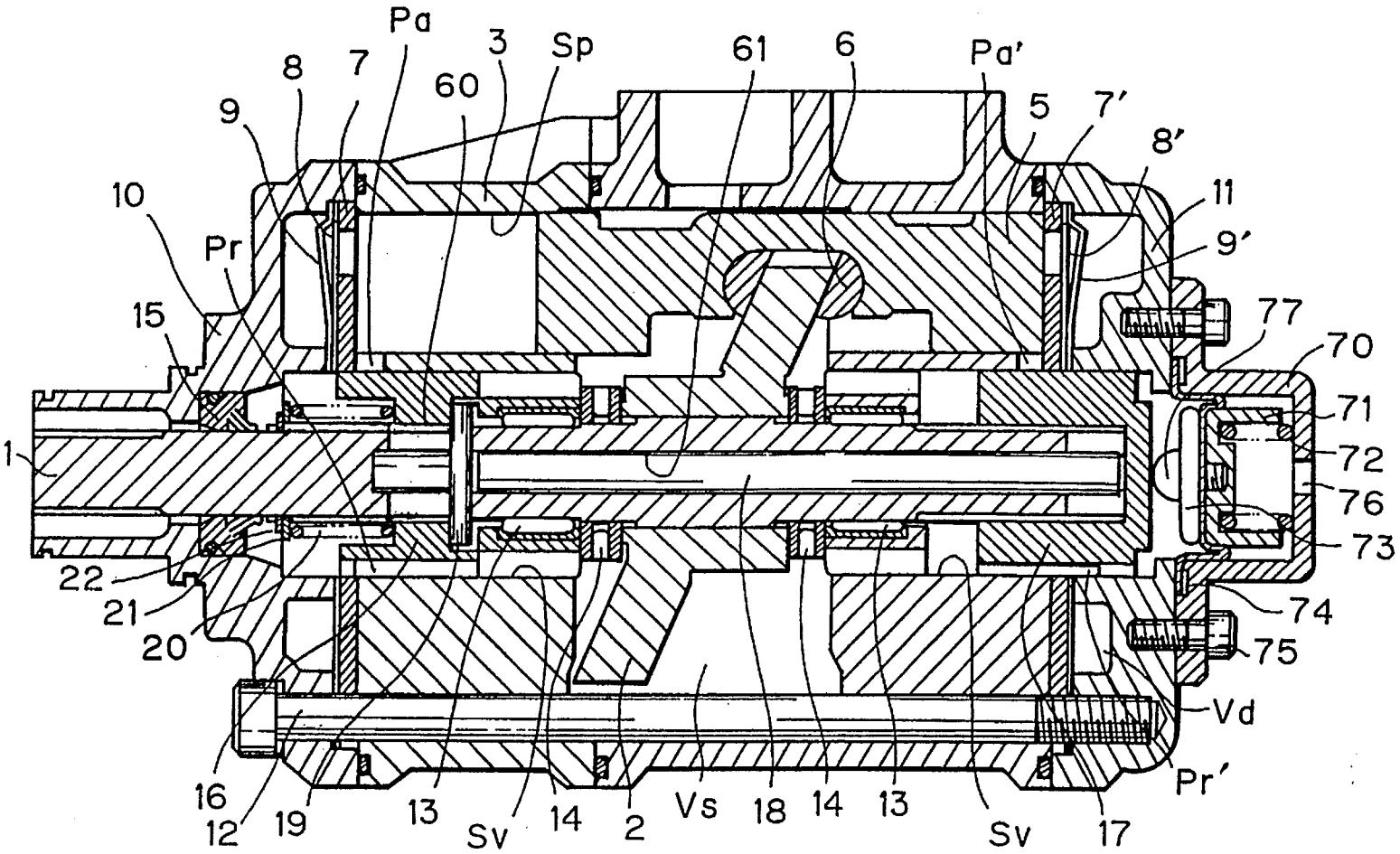

FIG. 13 shows a longitudinal cross-sectional view of a swash plate type compressor according to the third embodiment of the present invention.

Figure 14:
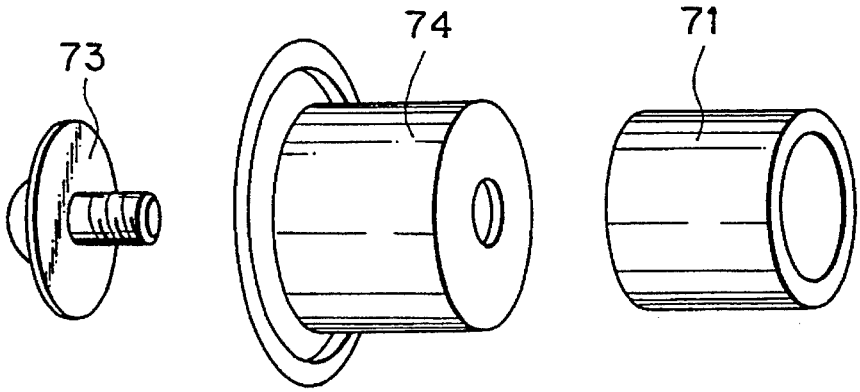

FIG. 14 is an enclosed perspective view of a control device in FIG. 13.

Figure 15:
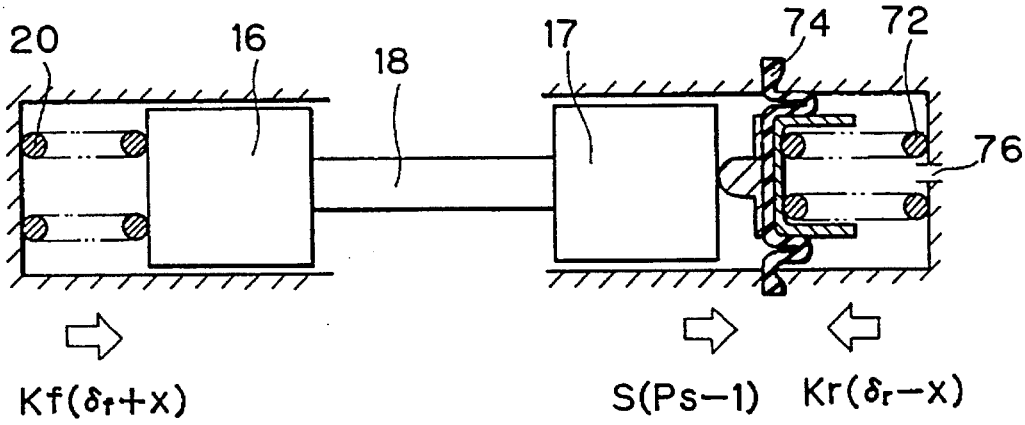

FIG. 15 is a diagrammatic view illustrating the operation of the embodiment in FIG. 13.

Figure 16:
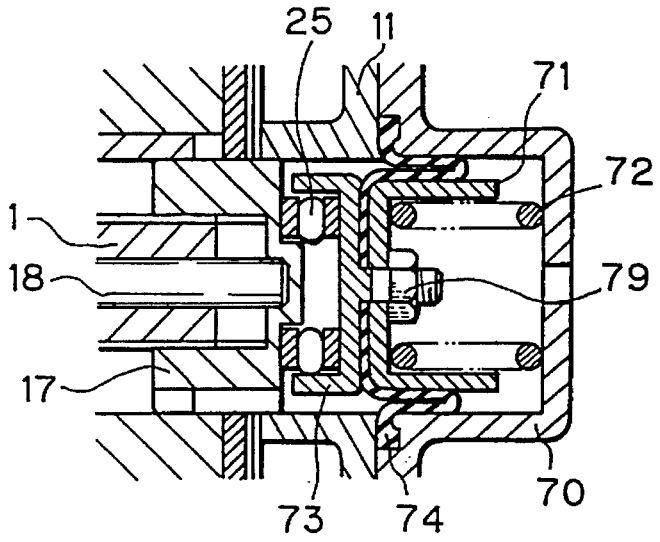
Figure 17:
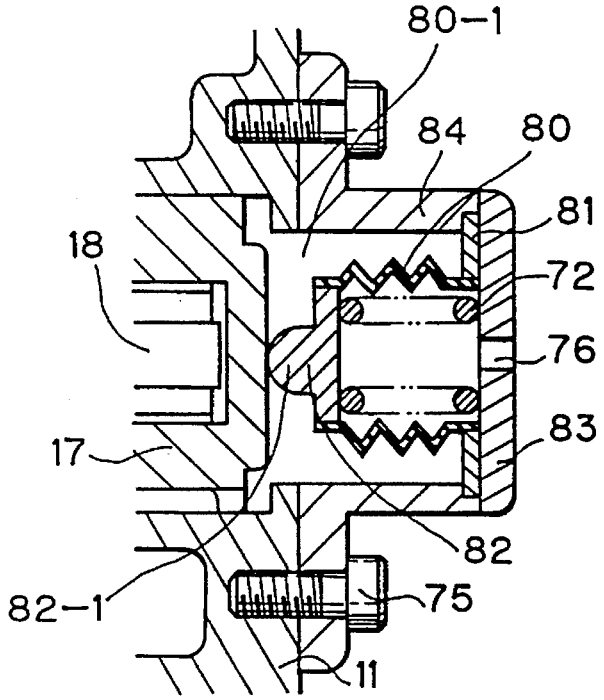

FIGS. 16 and 17 show modifications, respectively, of the control device.

Figure 18:
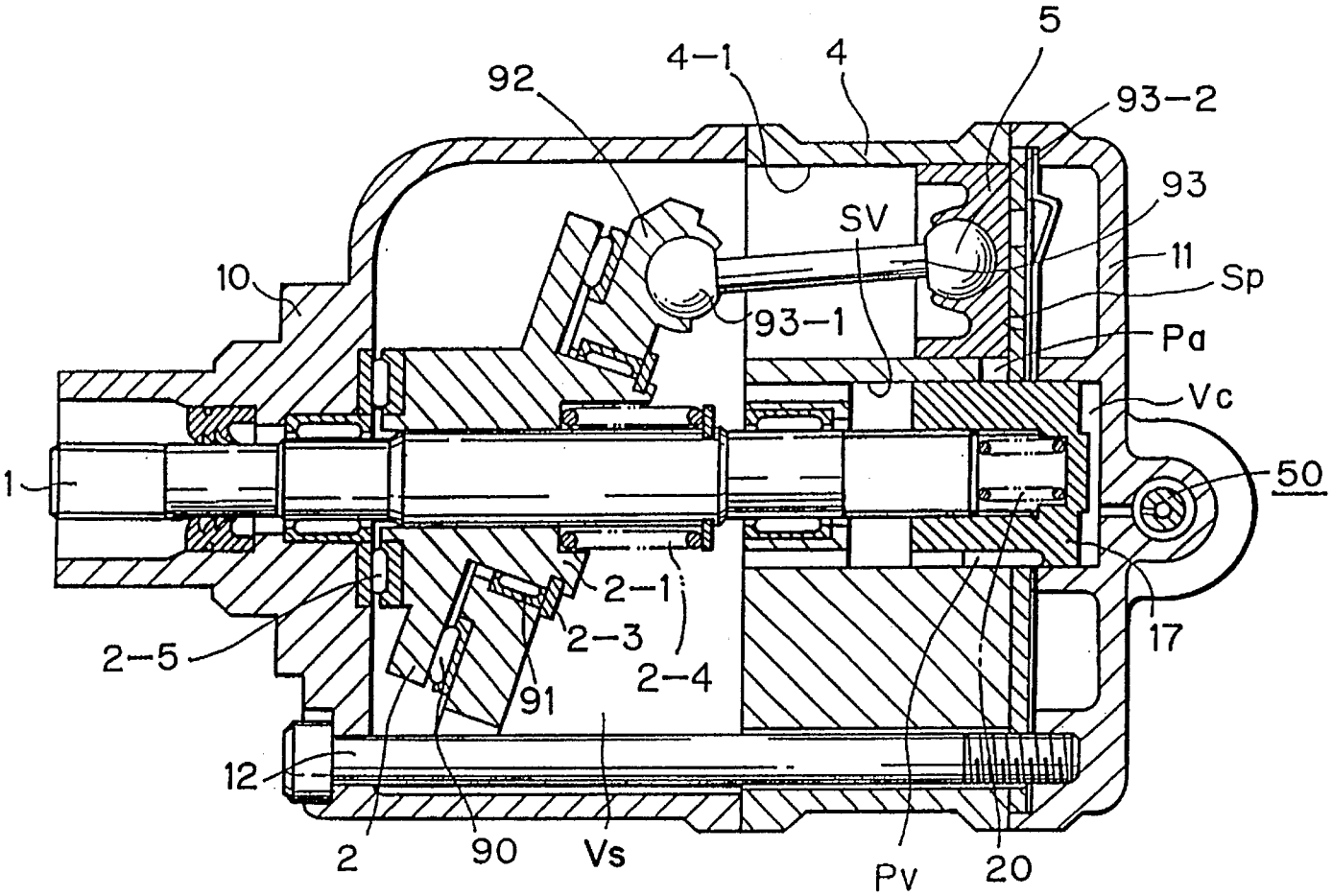

FIG. 18 shows a longitudinal cross-sectional view of a swash plate type compressor according to a fifth embodiment of the present invention.

Figure 19:
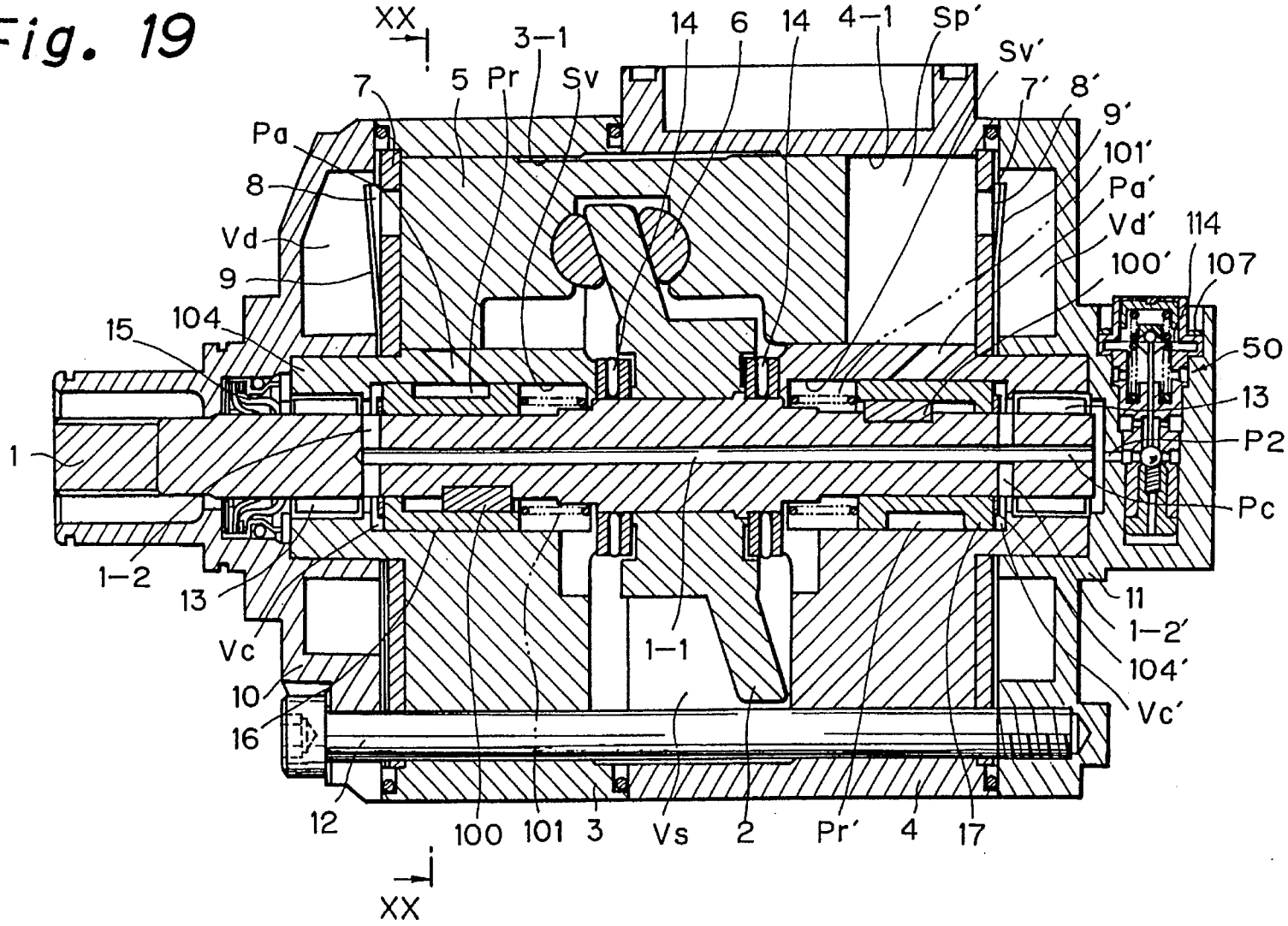
Figure 20:
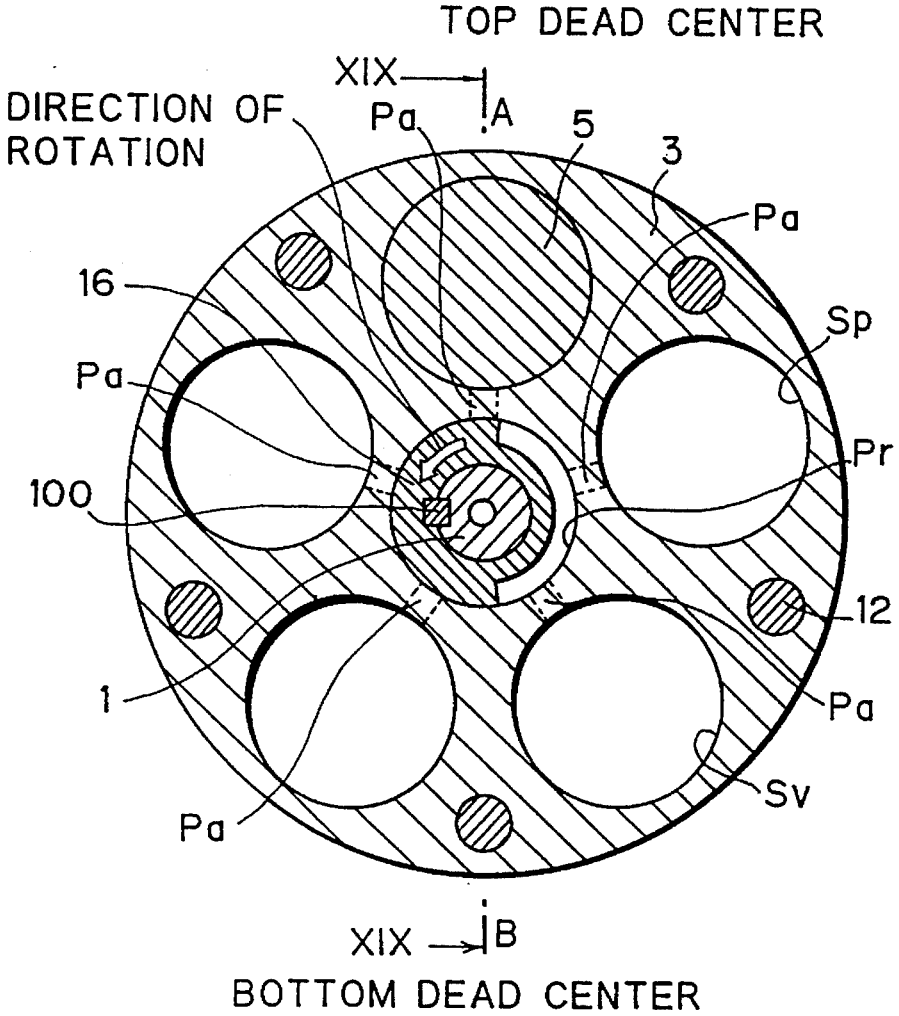

FIG. 19 shows a longitudinal cross-sectional view of a swash plate type compressor according to a sixth embodiment of the present invention when under maximum capacity condition, taken along line XIX—XIX in FIG. 20.

FIG. 20 is a transverse cross-sectional view taken along lines XX—XX in FIG. 19.

Figure 21:
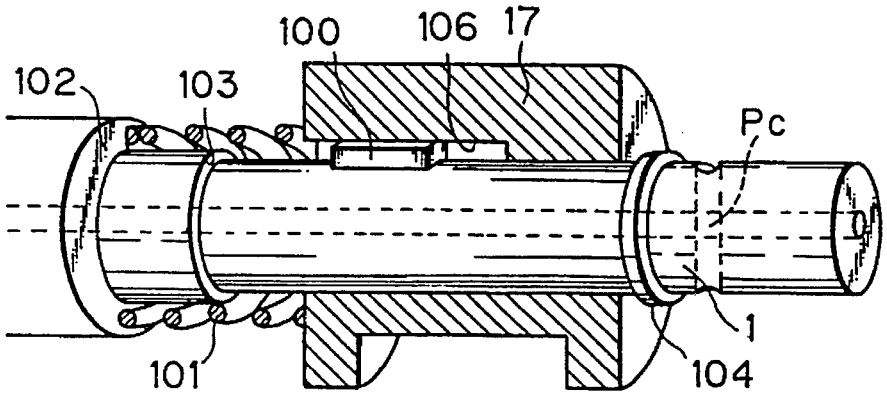

FIG. 21 is a schematic perspective view of a rotary valve in FIG. 19.

Figure 22:
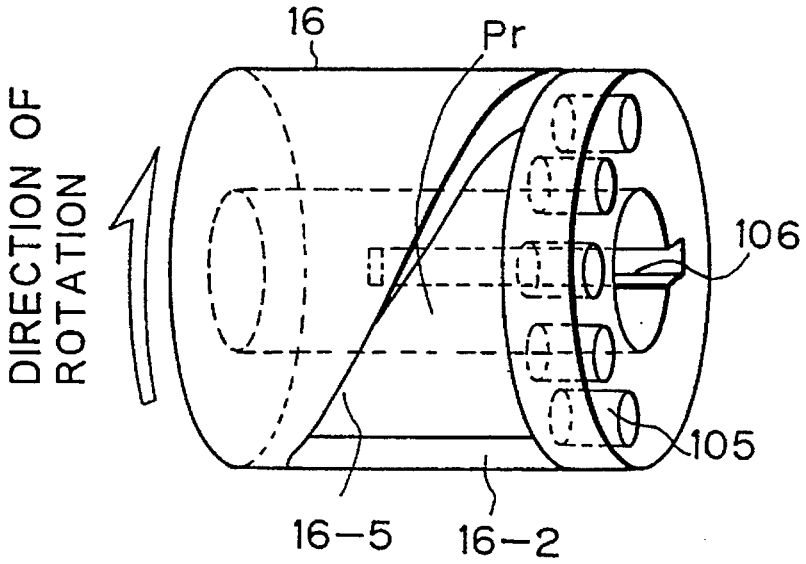
Figure 23:
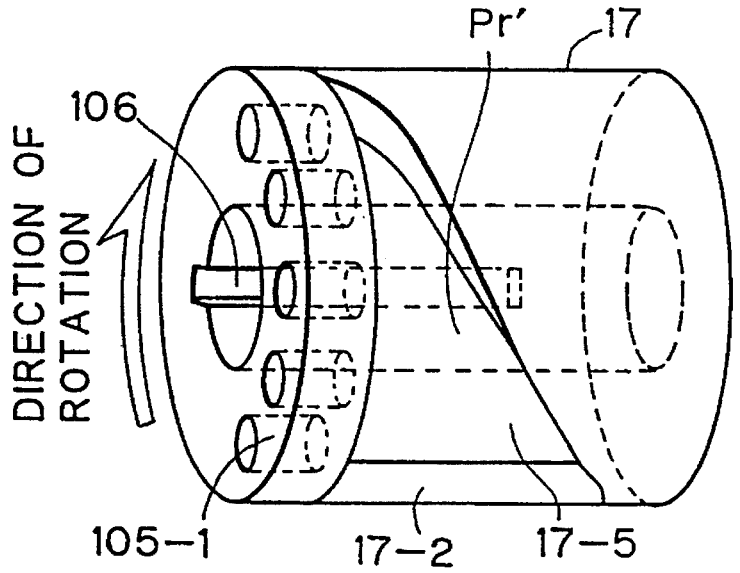

FIGS. 22 and 23 show rotary valves 16 and 17, respectively in the compressor in FIG. 19.

Figure 24:
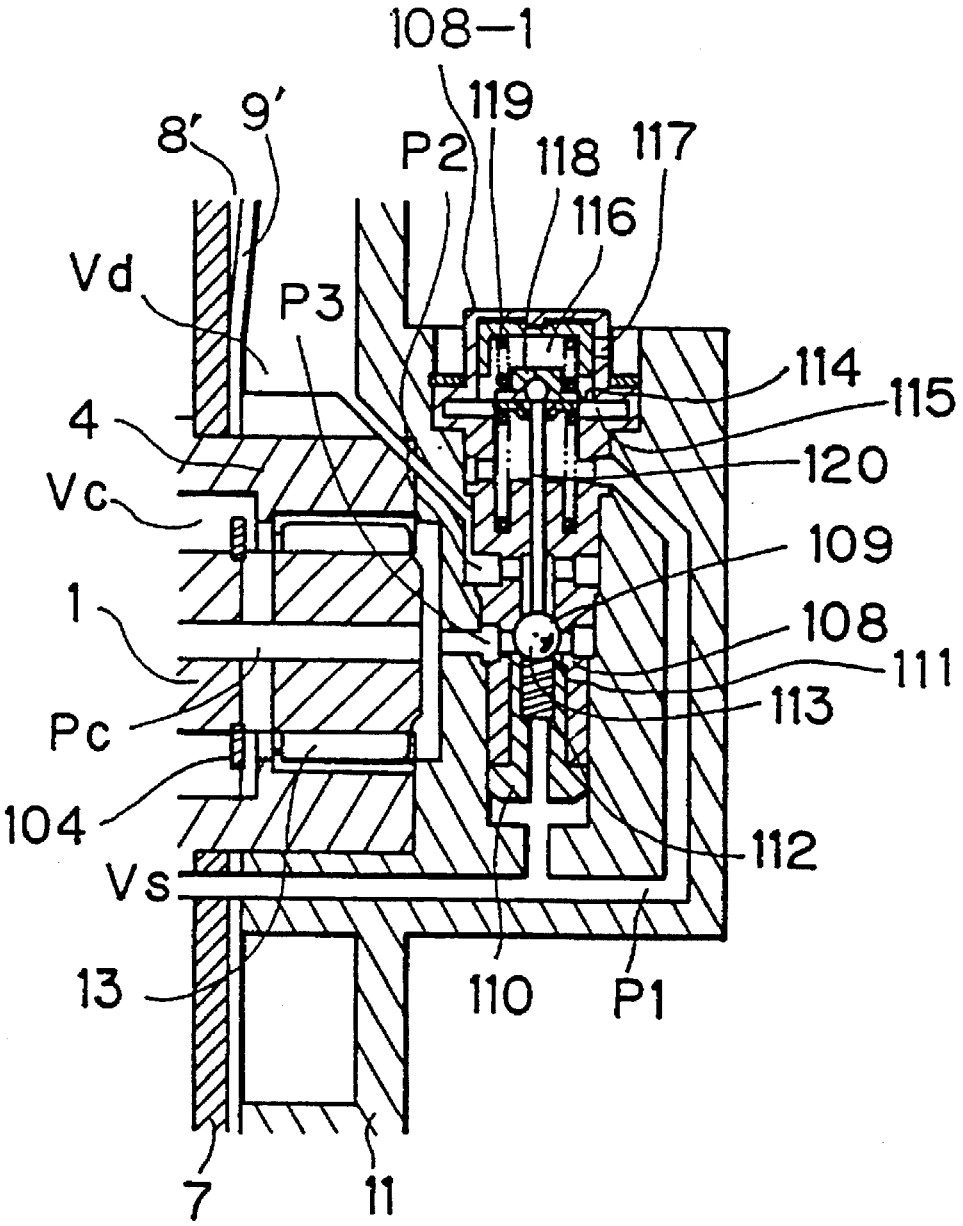

FIG. 24 shows a cross-sectional view of the rotary valve in the compressor in FIG. 19.

Figure 25:
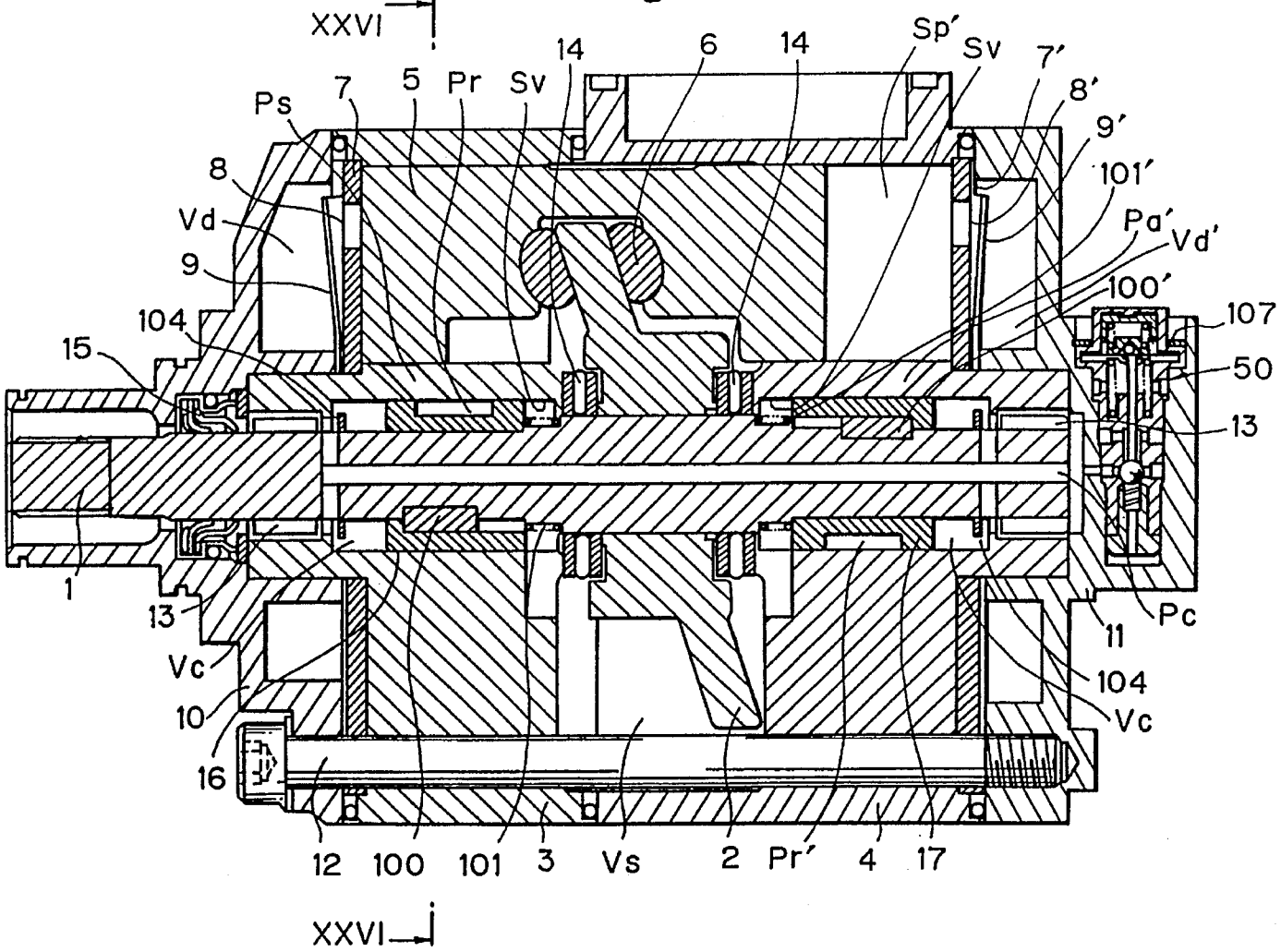
Figure 26:
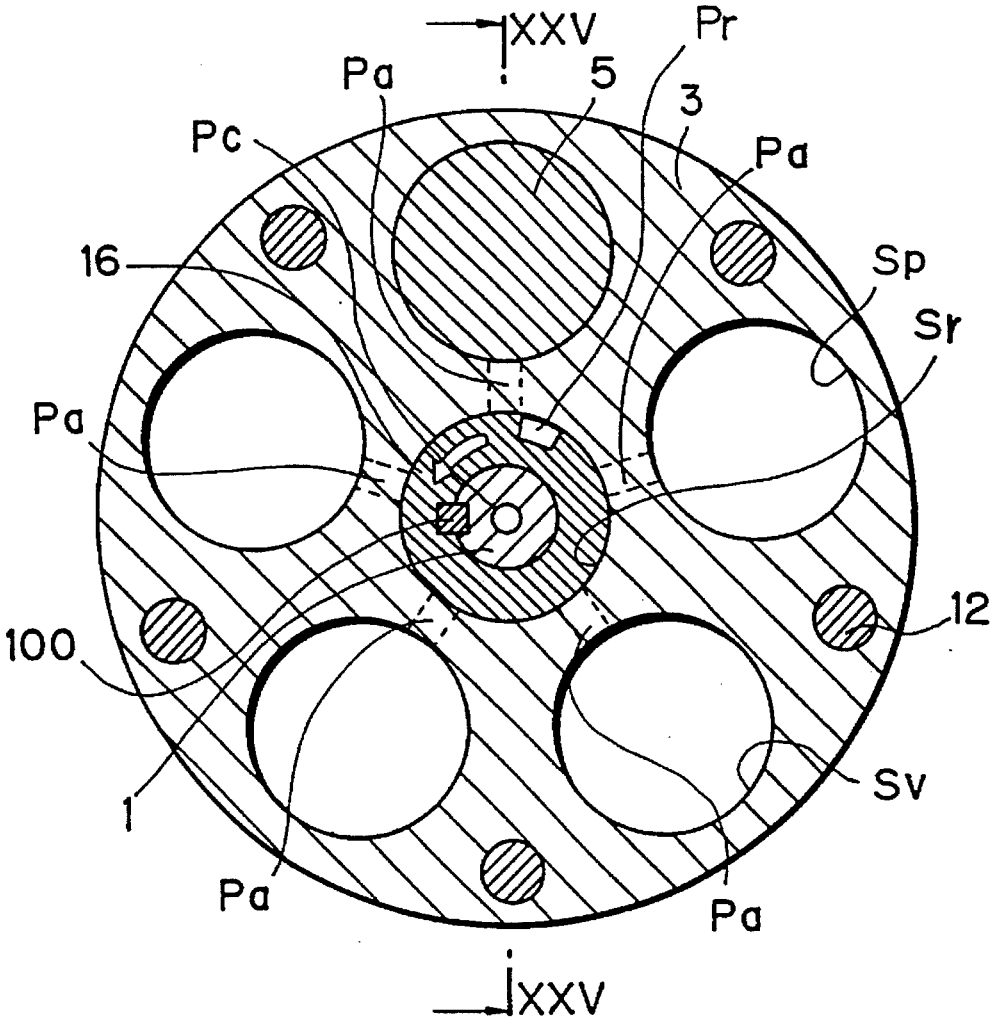

FIG. 25 is similar to FIG. 19, but when under minimum capacity conditions, taken along line XXV—XXV in FIG. 26.

FIG. 26 is a transverse cross-sectional view taken along line XXVI—XXVI in FIG. 25.

Figure 27:
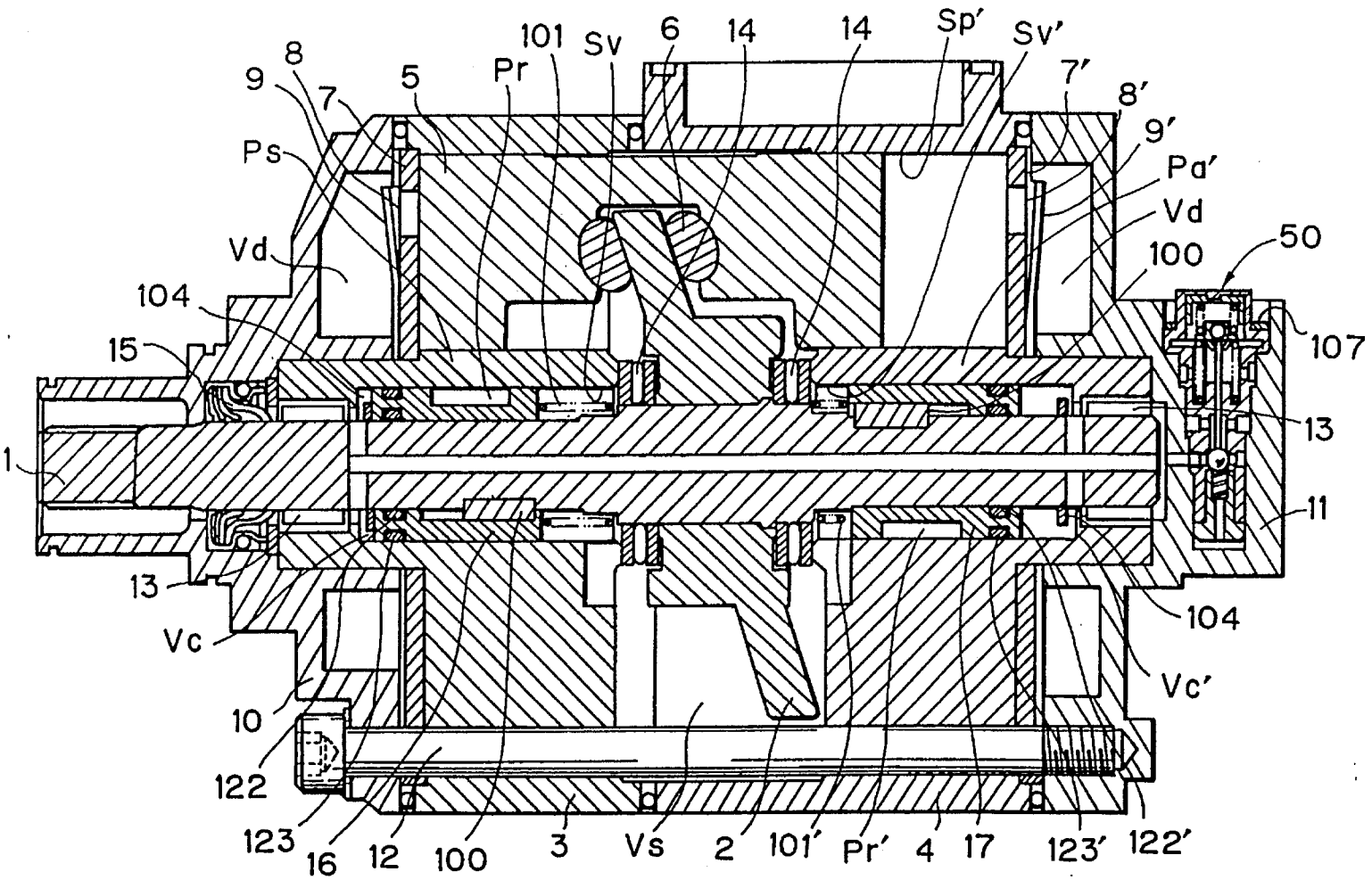
Figure 28:
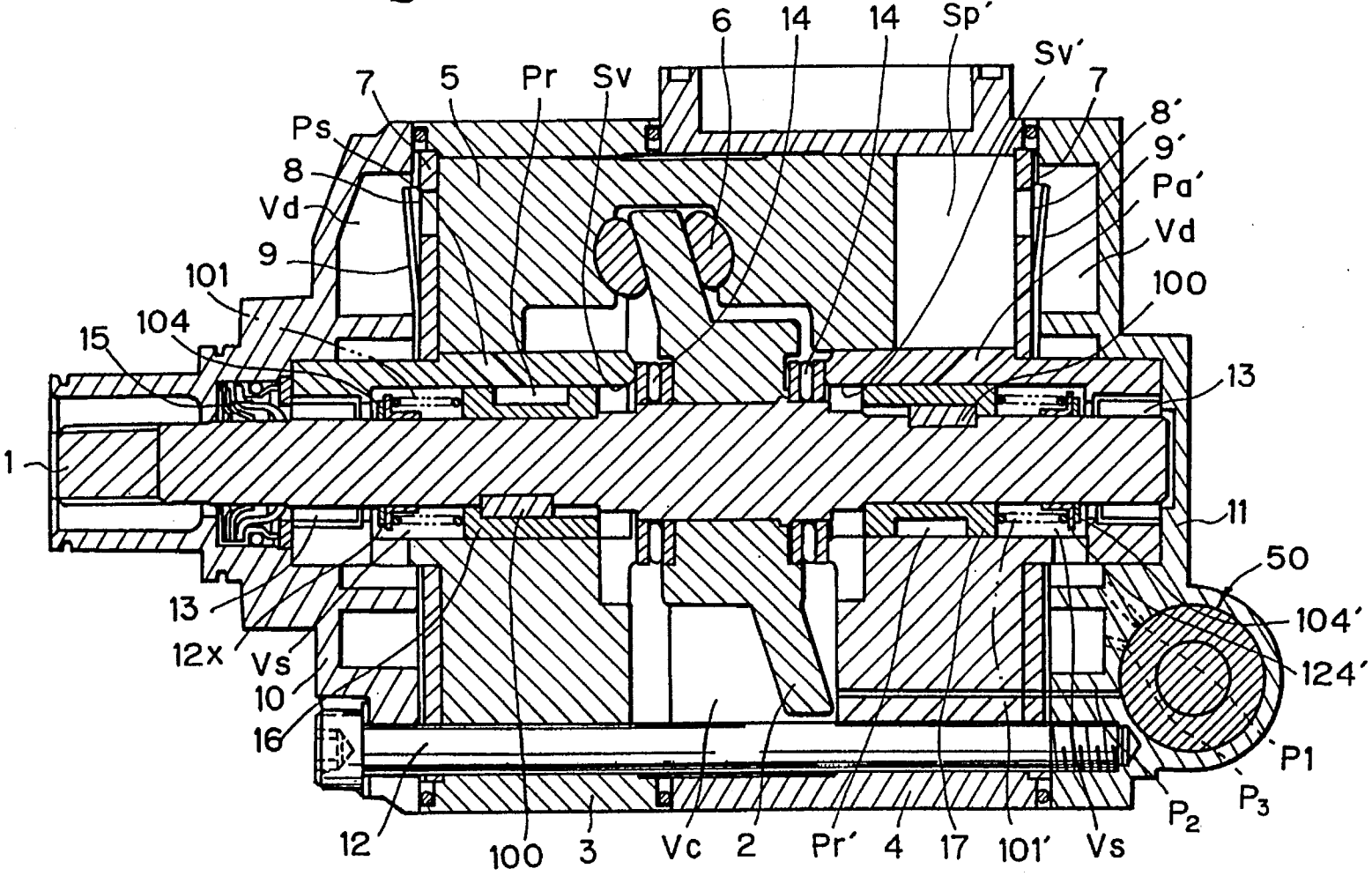
Figure 29:
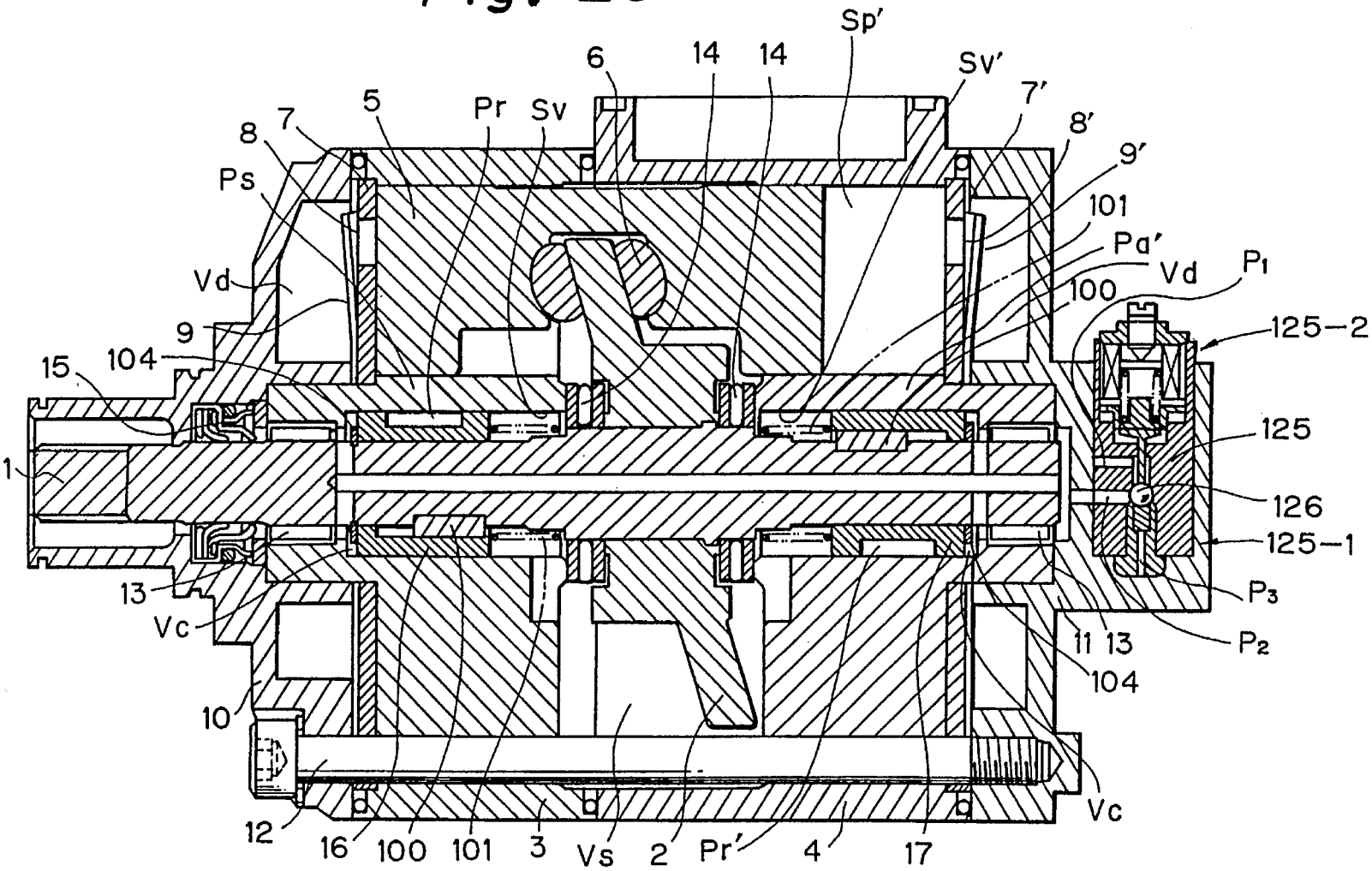

FIGS. 27, 28 and 29 show, respectively, longitudinal cross-sectional views of swash plate type compressors for different embodiments.

Figure 30:
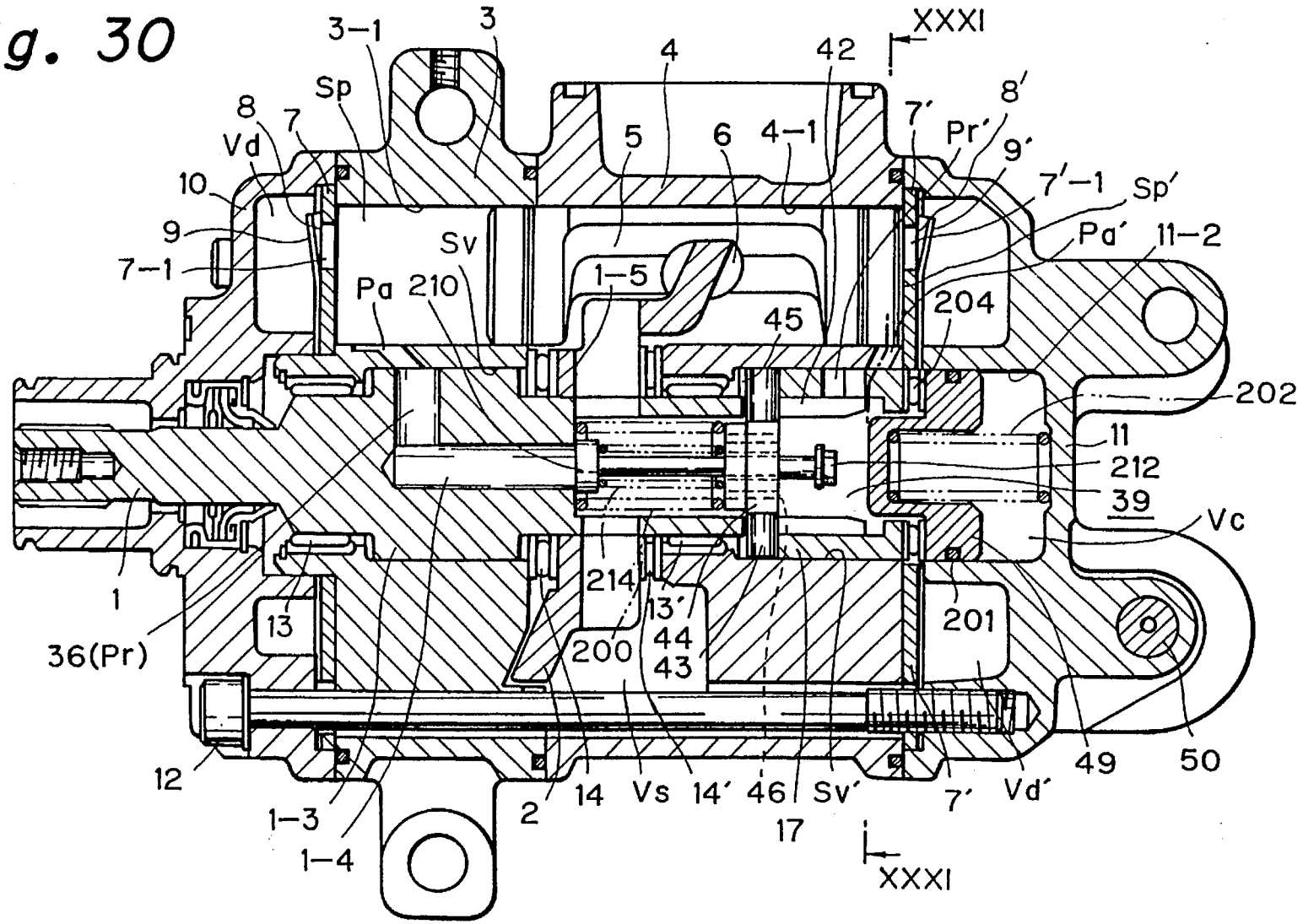
Figure 31:
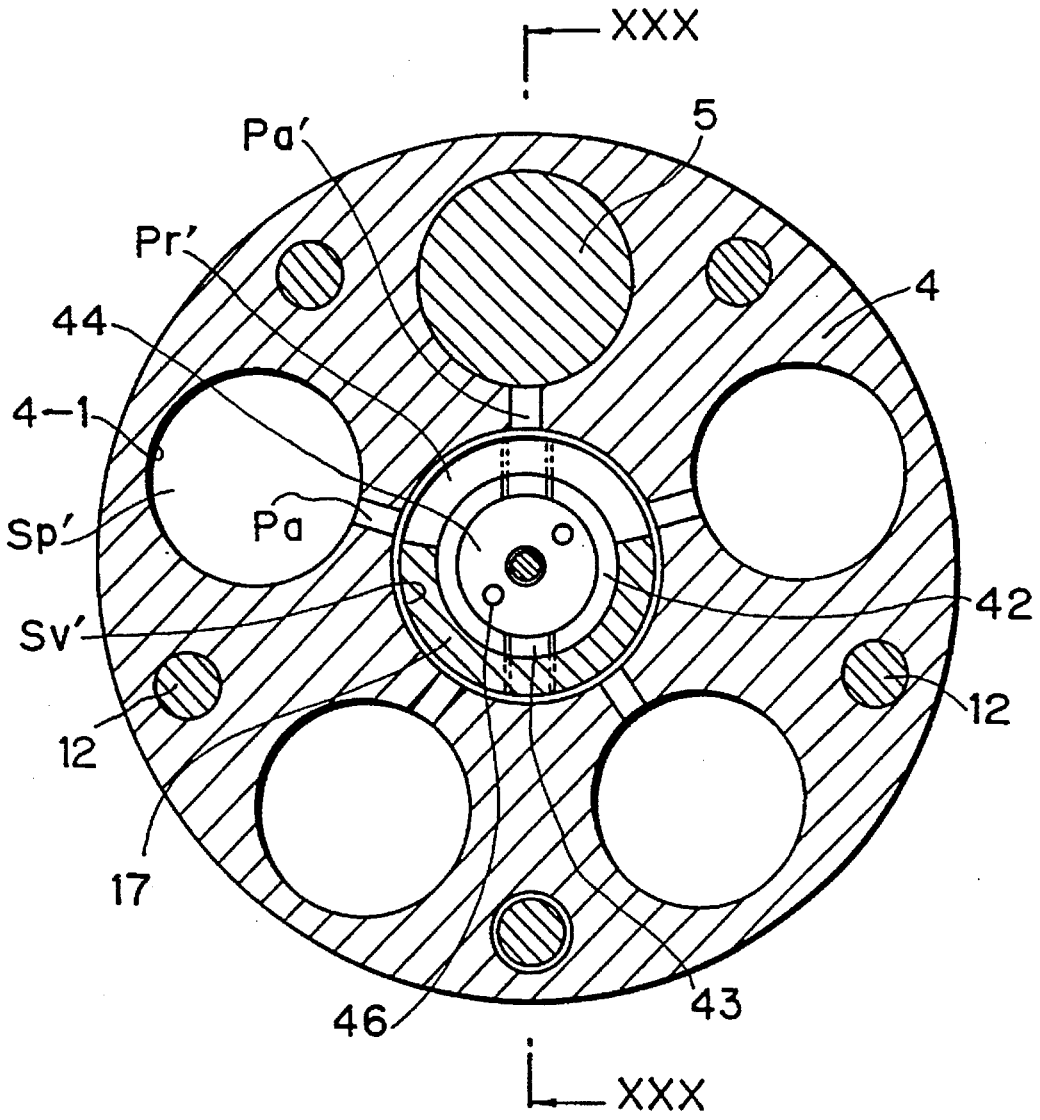

FIG. 30 is a longitudinal cross-sectional view of a swash plate type compressor according to a tenth embodiment of the present invention, taken along line XXX—XXX in FIG. 31.

FIG. 31 is a transverse cross-sectional view taken along line XXXI—XXXI in FIG. 30.

Figure 32:
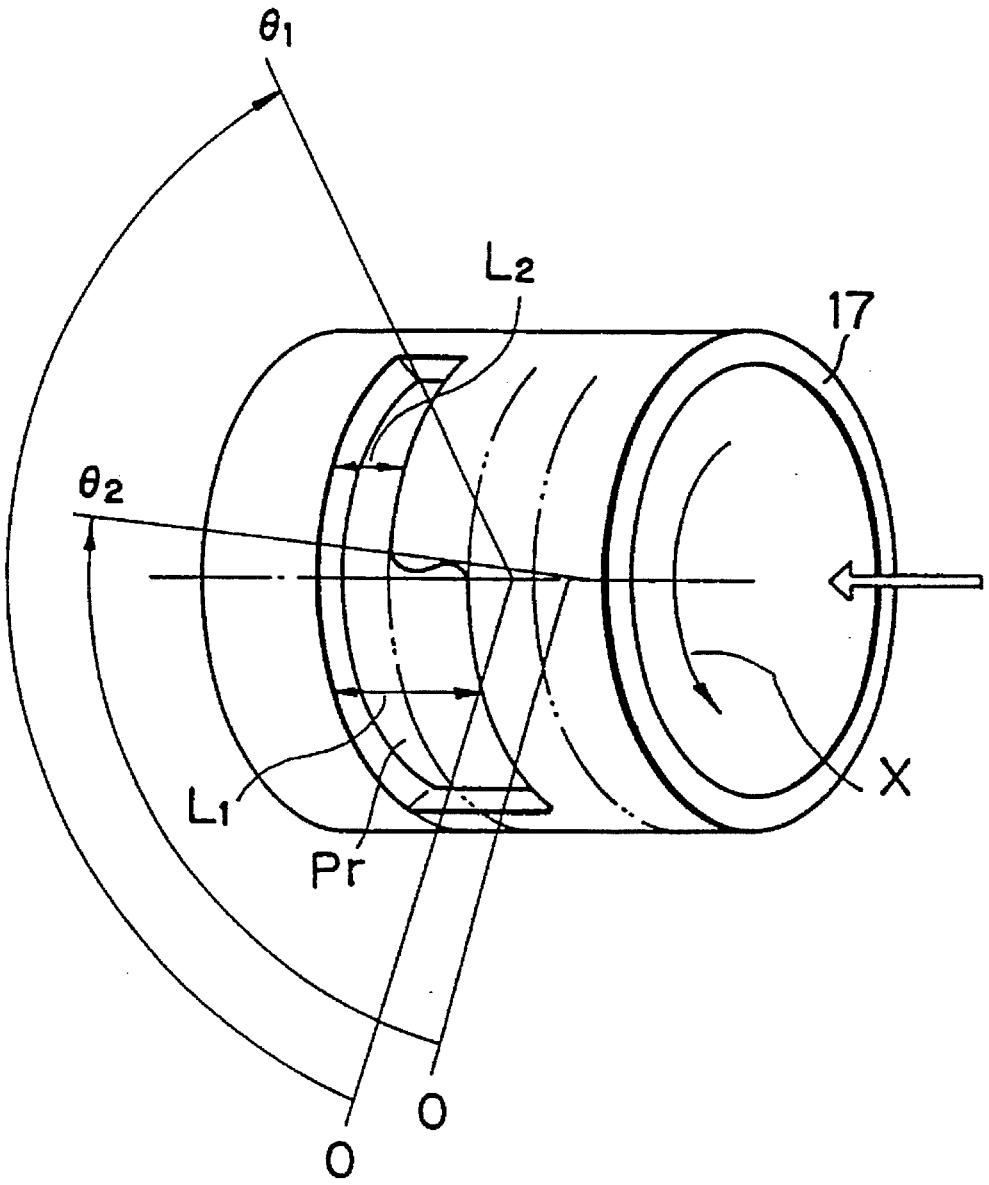

FIG. 32 shows a schematic perspective view of a rotary valve in the embodiment in FIG. 30.

Figure 33:
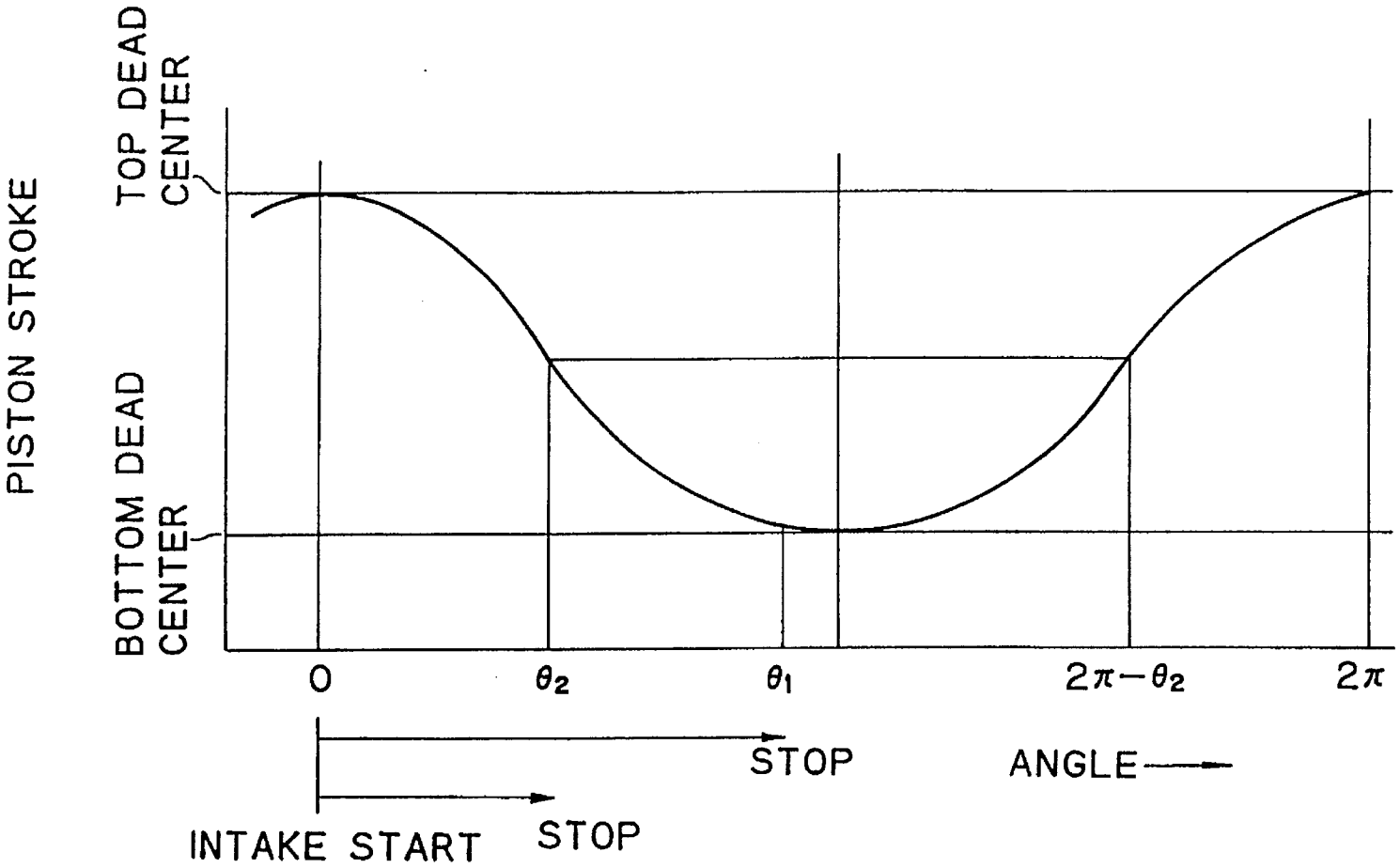

FIG. 33 shows a relationship between a rotating angle and a piston stroke in the embodiment in FIG. 30.

Figure 34:
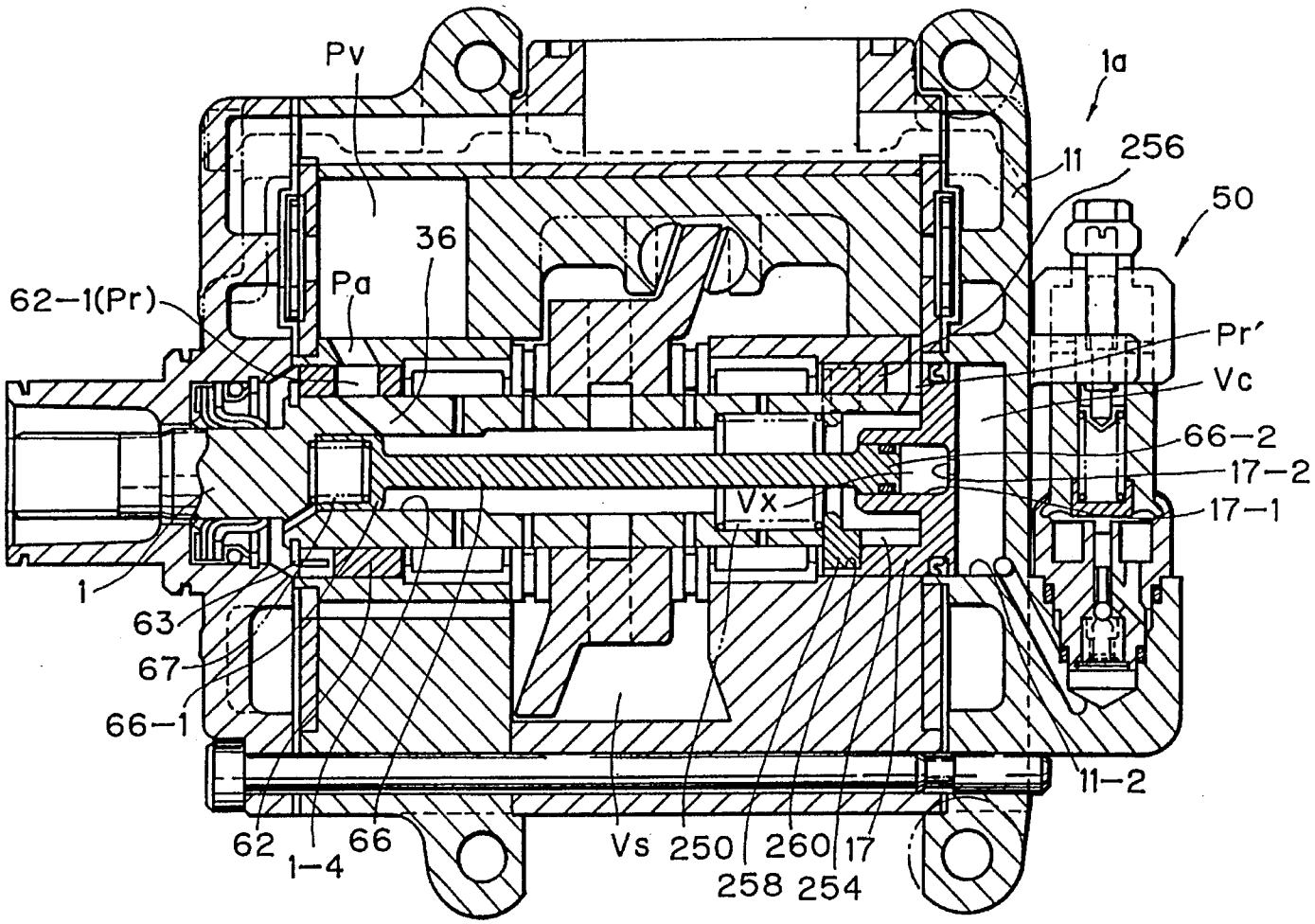

FIG. 34 is a longitudinal cross-sectional view of a swash plate type compressor according to an eleventh embodiment of the present invention.

Figure 35:
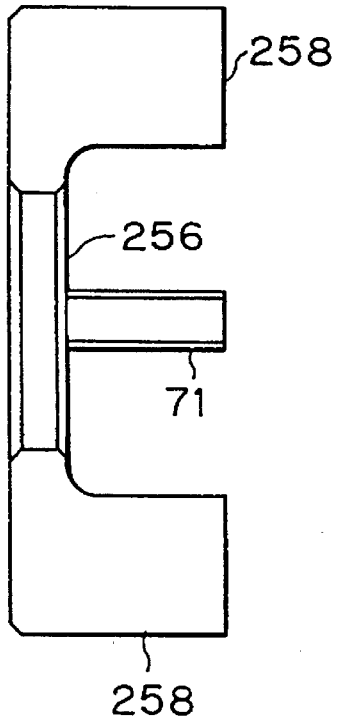

FIG. 35 is side view of a stopper in the embodiment in FIG. 34.

Figure 36:
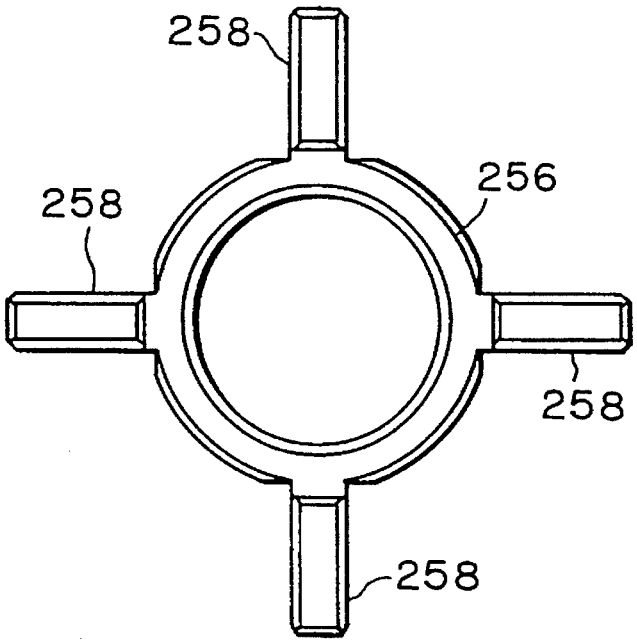

FIG. 36 is a front view of the stopper in FIG. 35.

Figure 37:
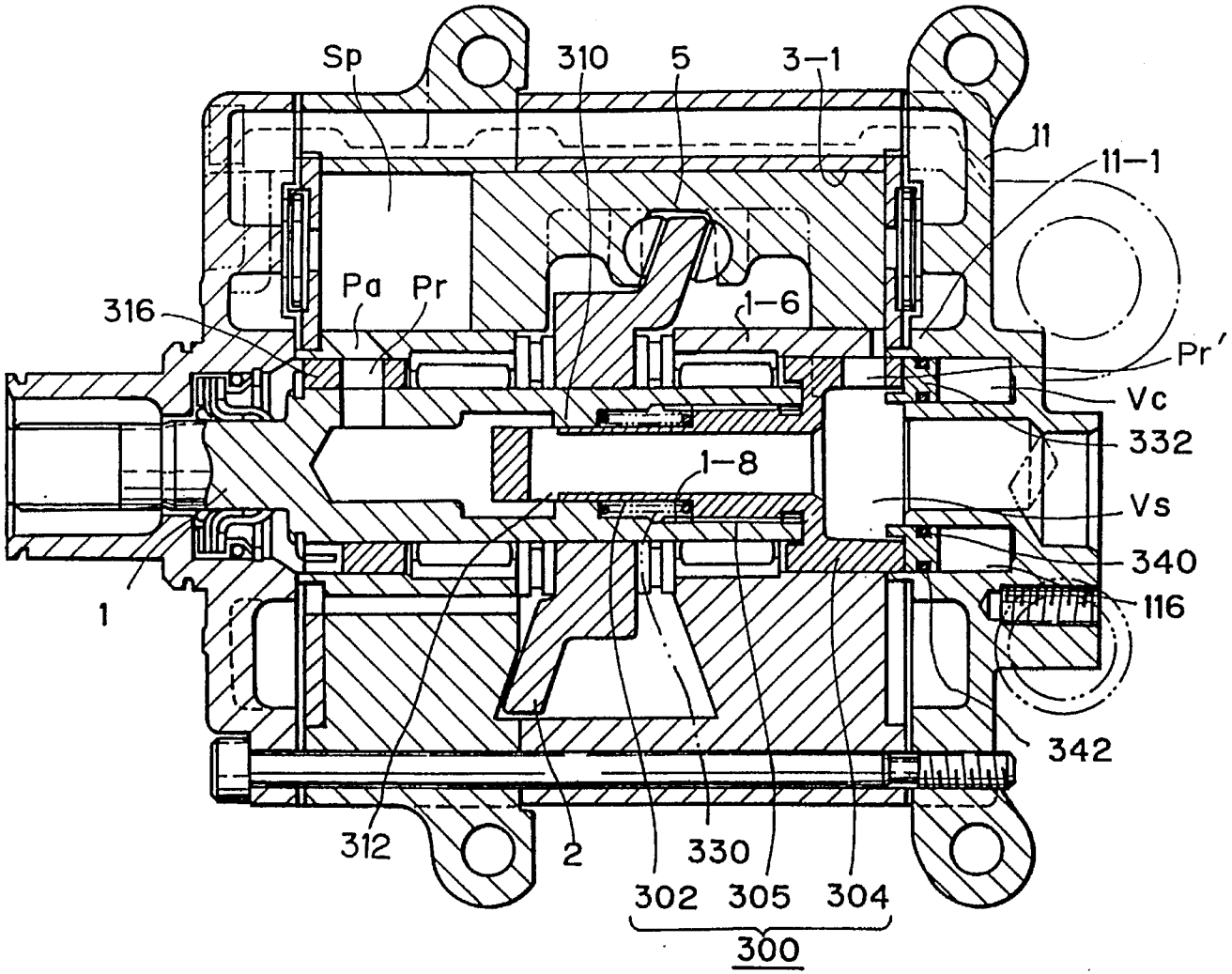

FIG. 37 is a longitudinal cross-sectional view of a swash plate type compressor according to a twelfth embodiment of the present invention.

Figure 38:
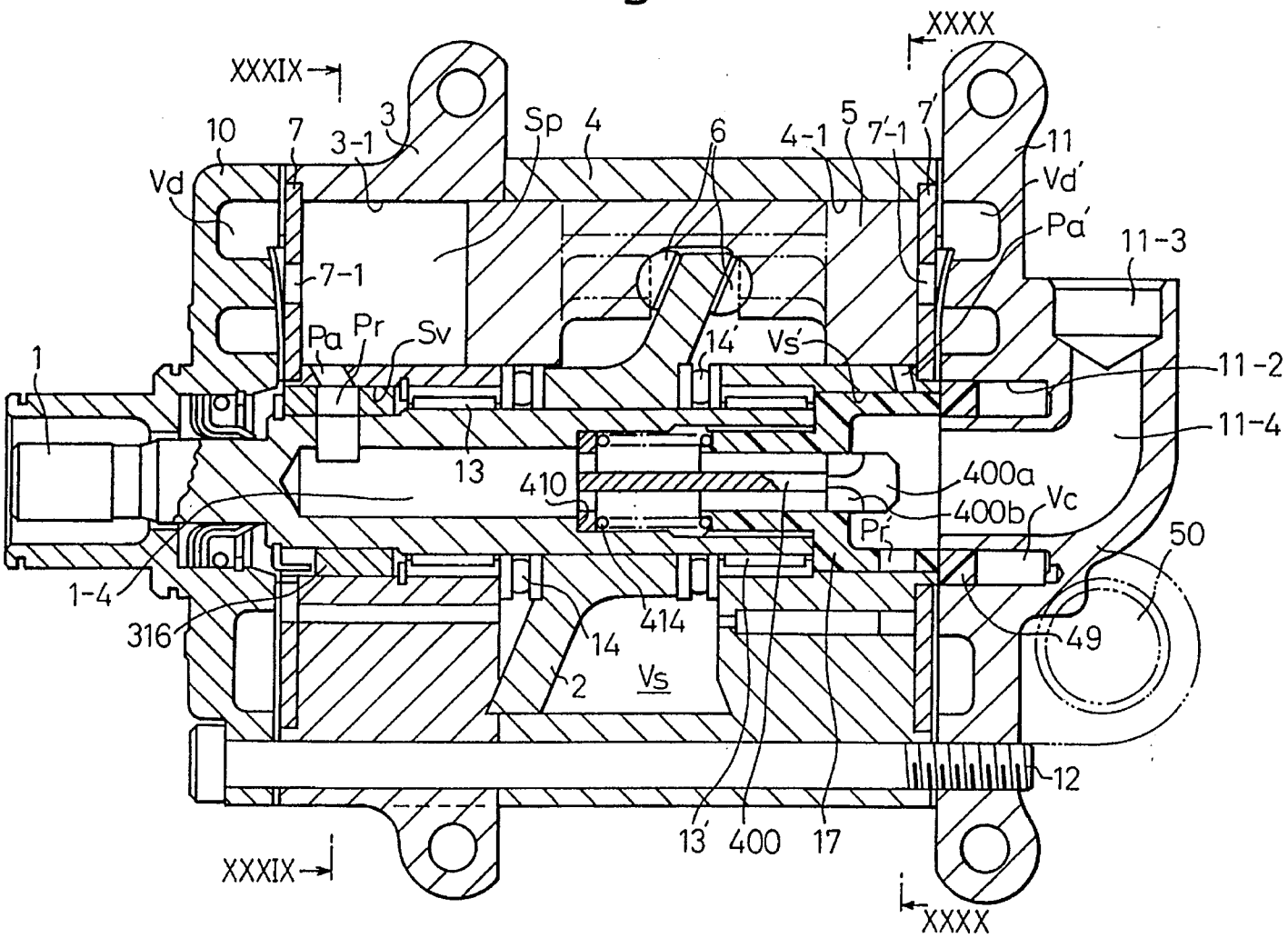

FIG. 38 is a longitudinal cross sectional view of a compressor according to a thirteenth embodiment.

Figure 39:
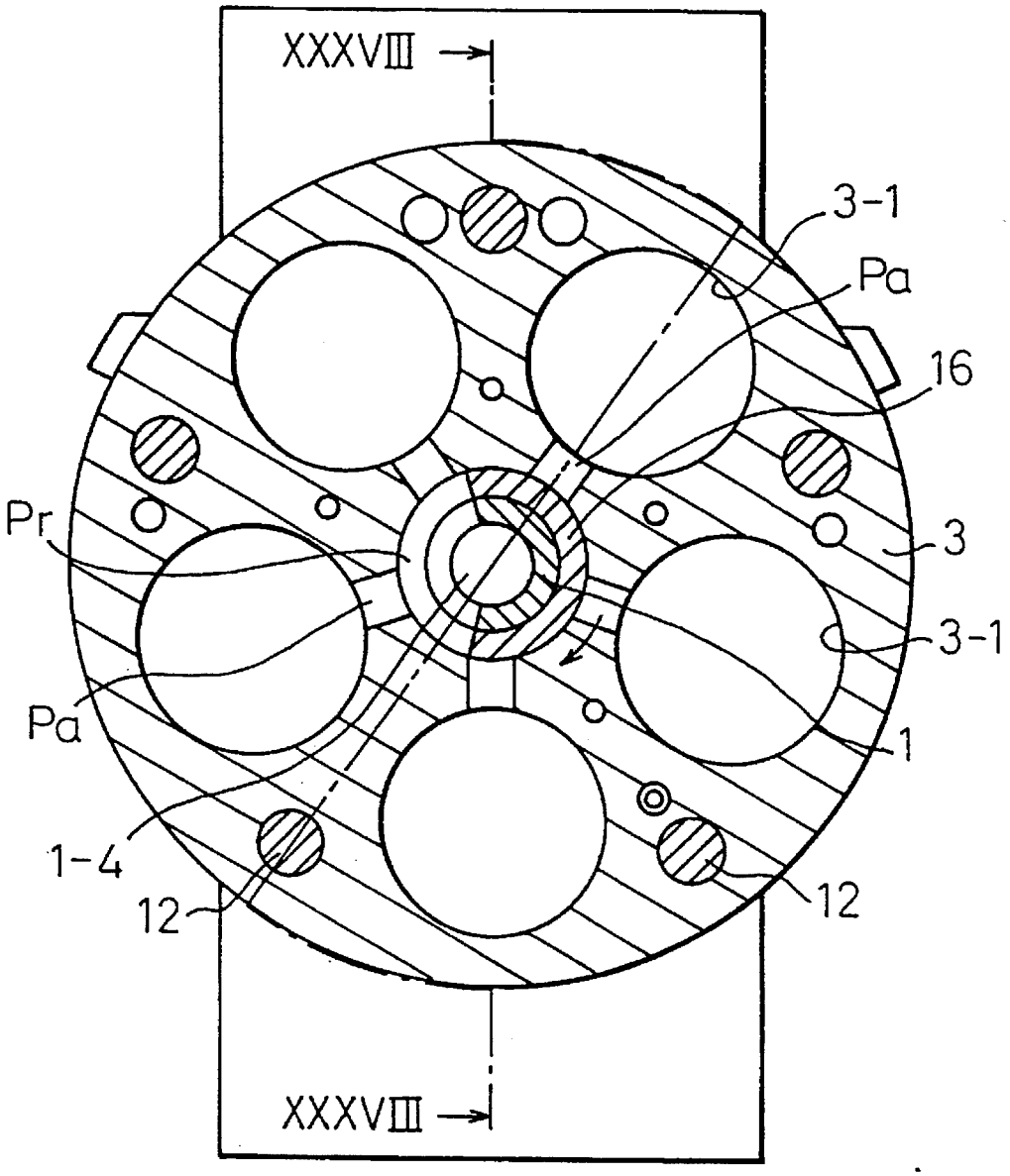

FIG. 39 is a transverse cross sectional view taken along a line XXXIX—XXXIX in FIG. 38.

Figure 40:
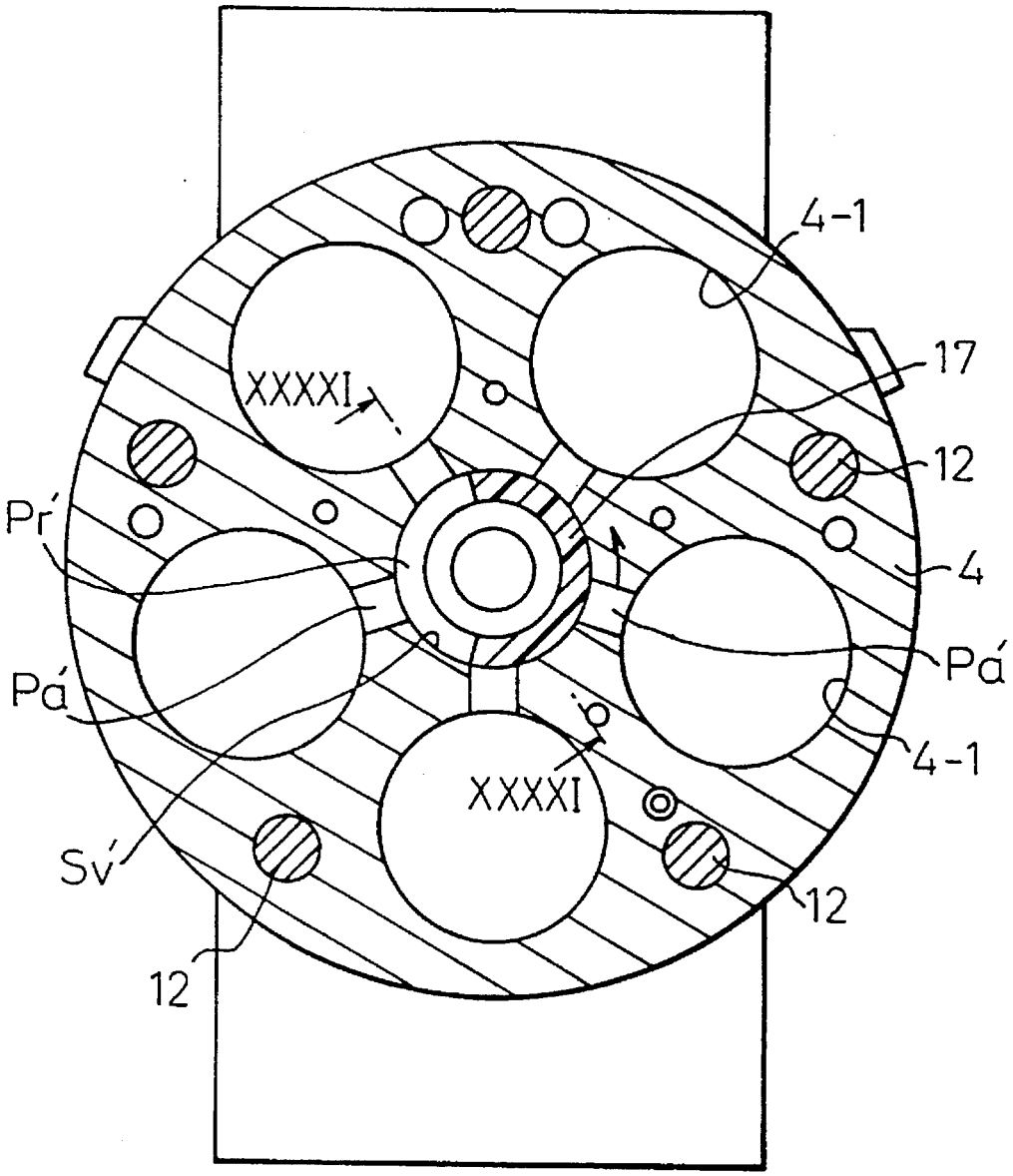

FIG. 40 is a transverse cross sectional view taken along a line XXXX—XXXX in FIG. 38.

Figure 41:
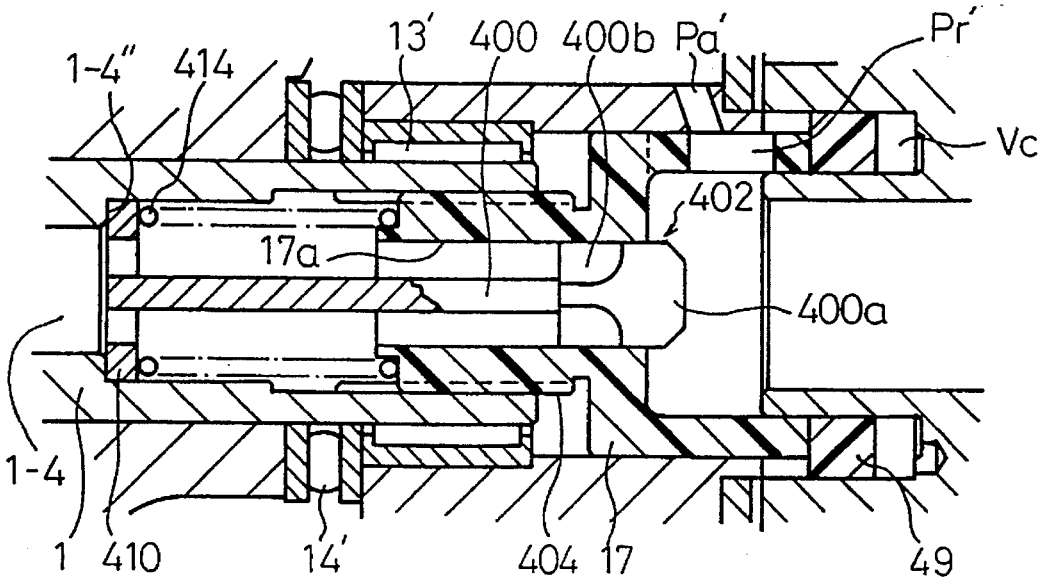

FIG. 41 is an enlarged view of FIG. 38 at a location around a movable, rear rotary valve.

Figure 42:
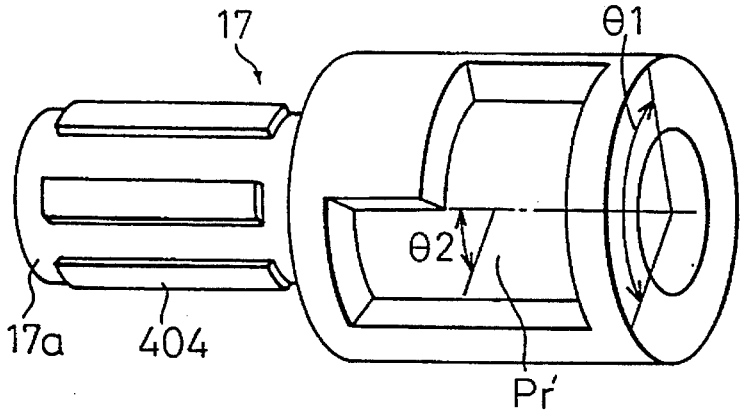

FIG. 42 is a perspective view of the rear rotary valve in FIG. 38.

Figure 43:
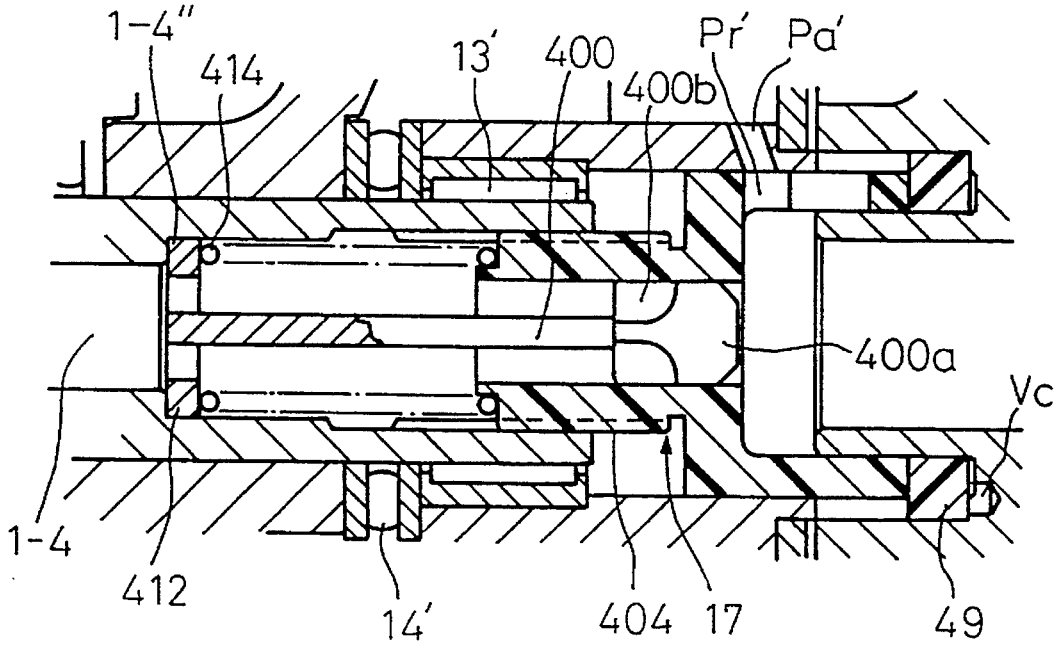

FIG. 43 is similar to FIG. 41 but illustrates a position of minimum capacity.

Figure 44:
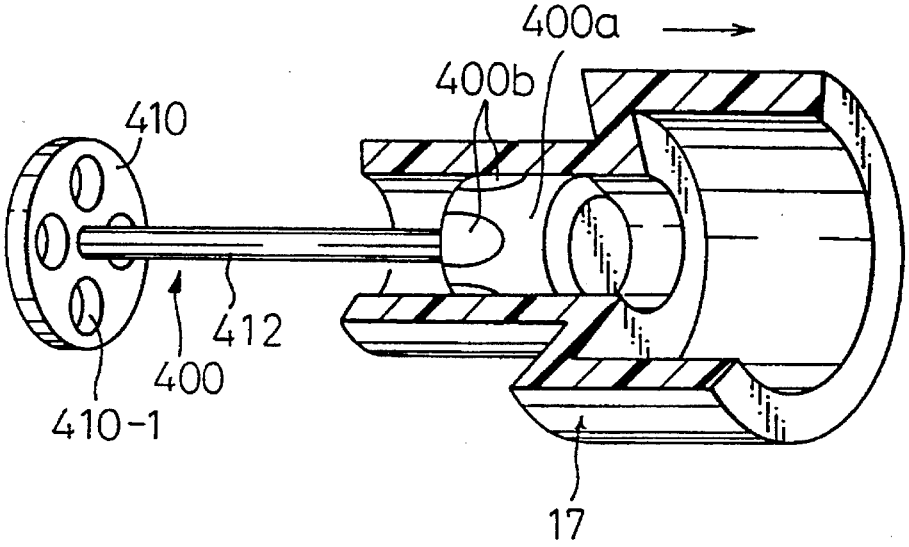

FIG. 44 is a perspective view of an inner valve together with the rear rotary valve.

Figure 45:
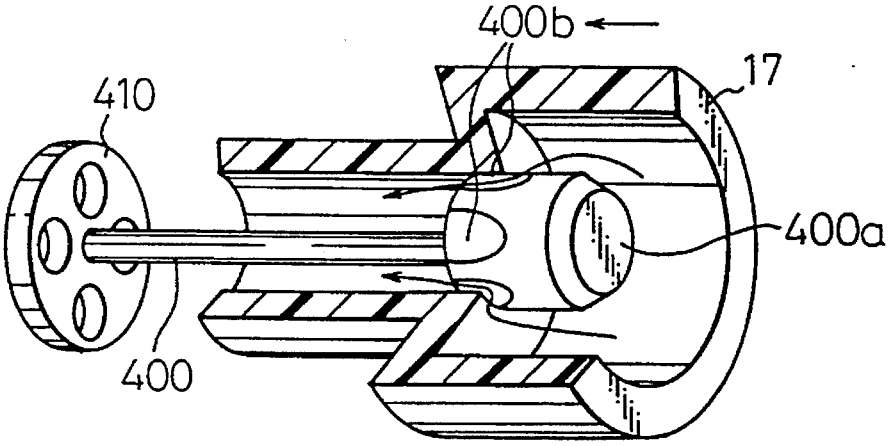

FIG. 45 is similar to FIG. 44 but illustrates a different position.

Figure 46:
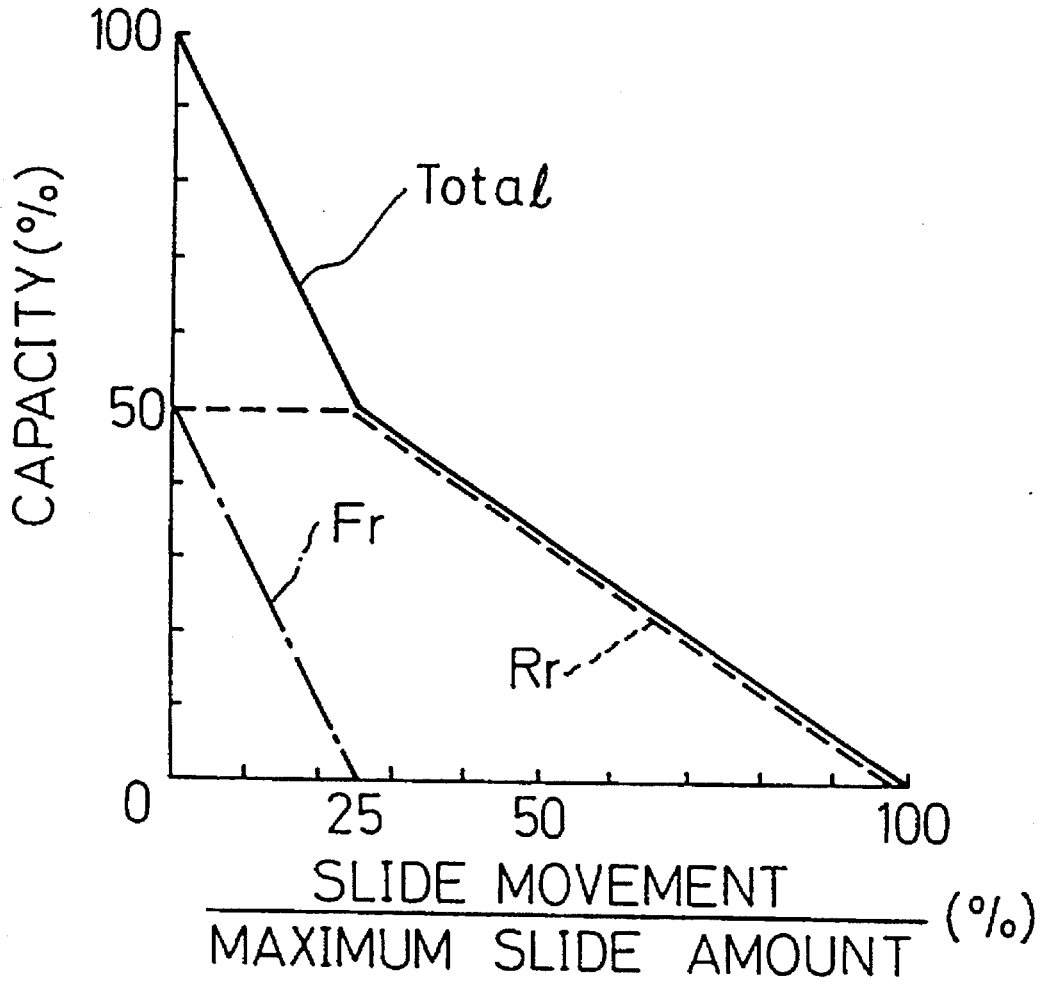

FIG. 46 is a relationship between the degree of an axial movement of the rear rotary valve in percent to the maximum movement and a capacity of the compressor in the thirteenth embodiment.

Figure 47:
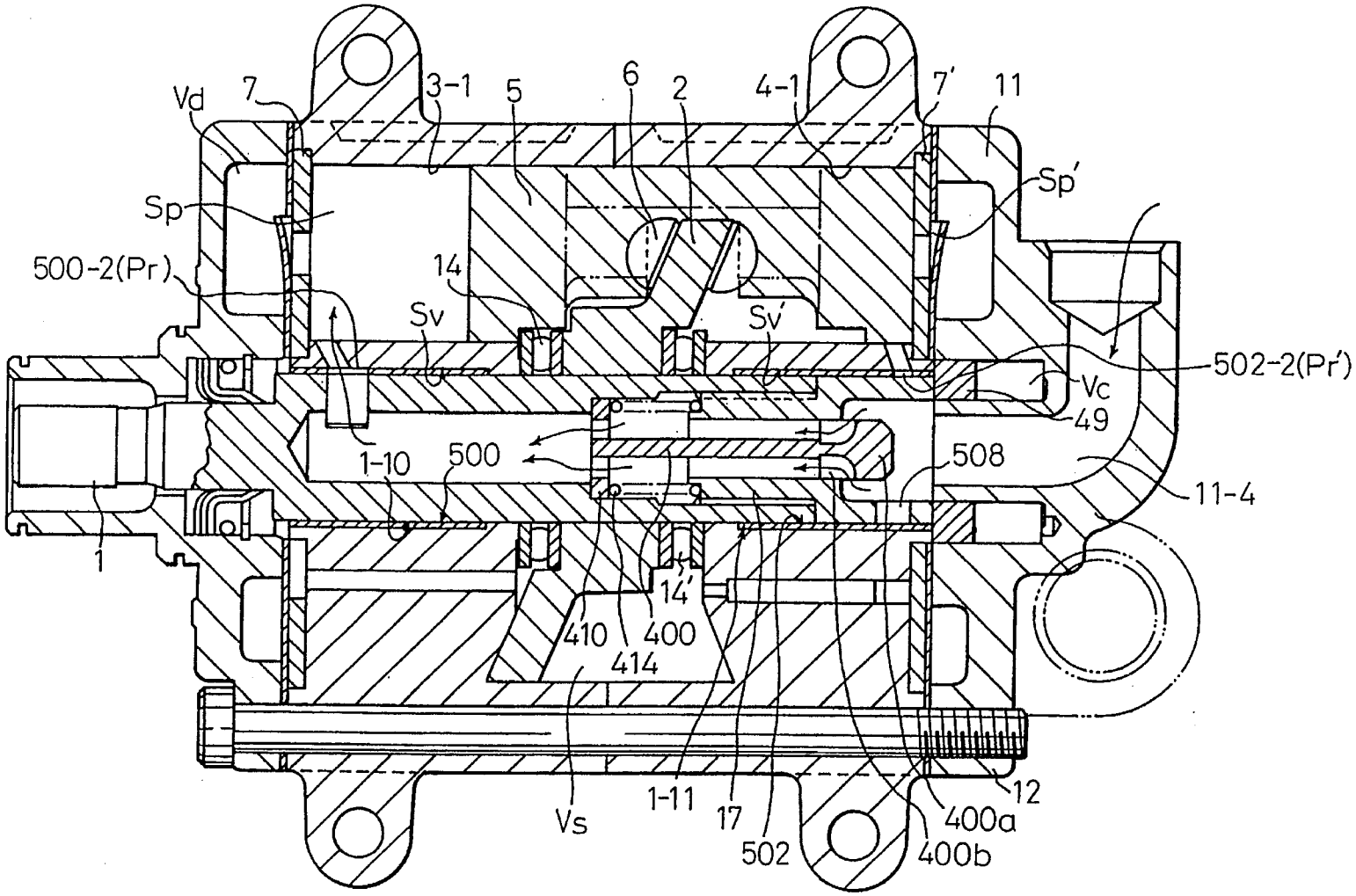

FIG. 47 is a longitudinal cross sectional view of a compressor according to fourteenth embodiment.

Figure 48:
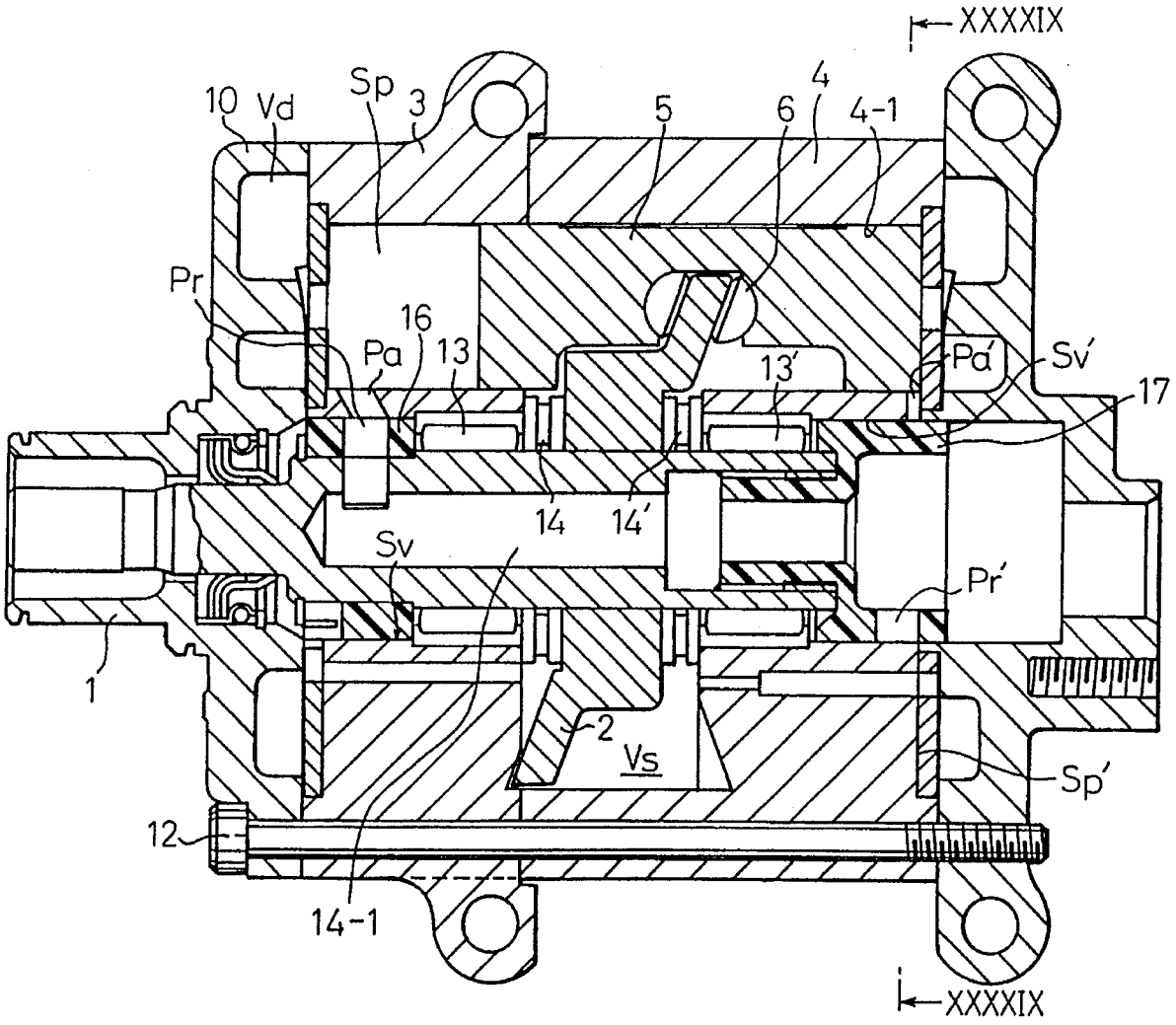

FIG. 48 is a longitudinal cross sectional view of a compressor according to fifteenth embodiment.

Figure 49:
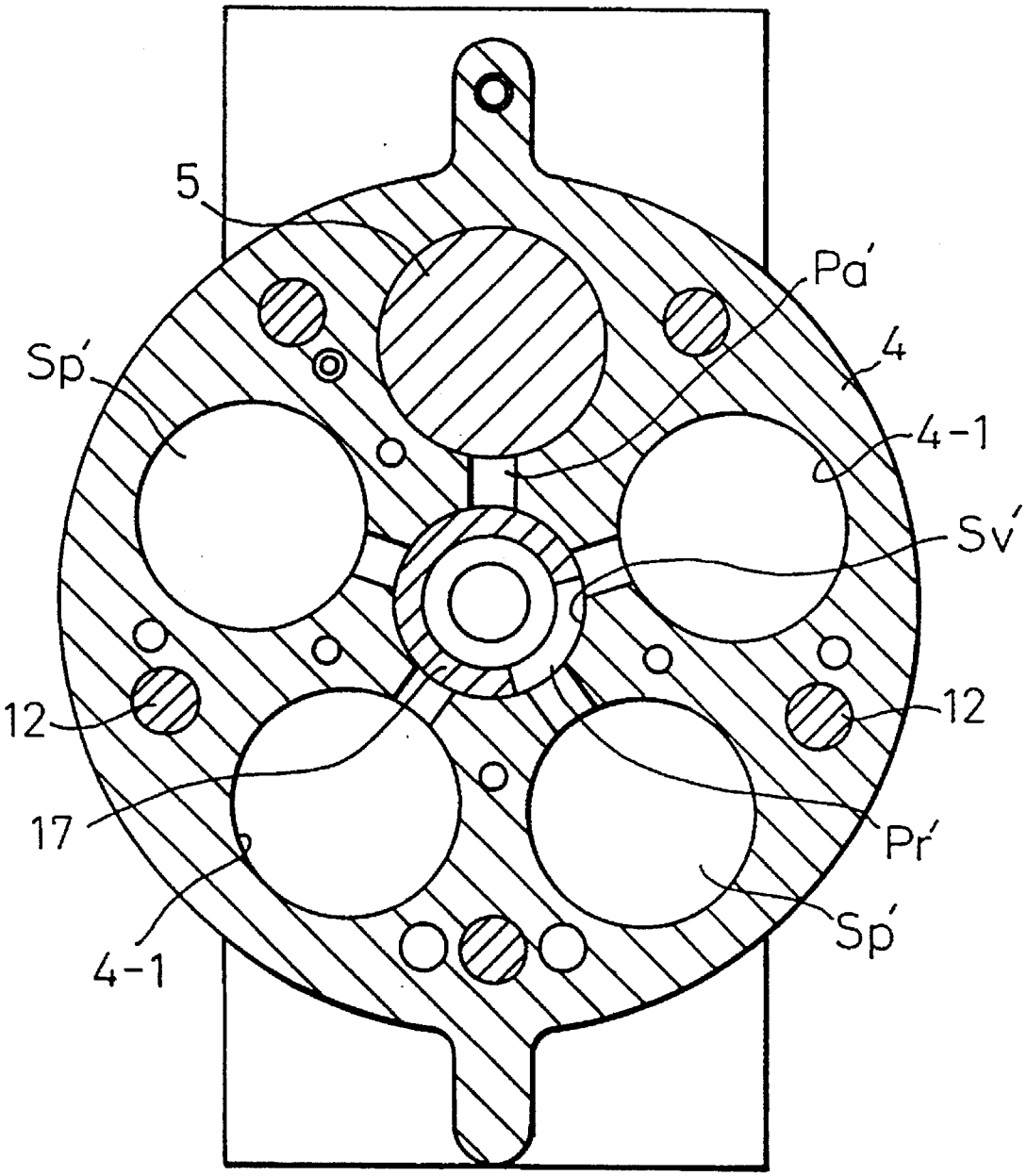

FIG. 49 is a transverse cross sectional view taken along a line XXXXIX—XXXXIX in FIG. 48.

Figure 50:
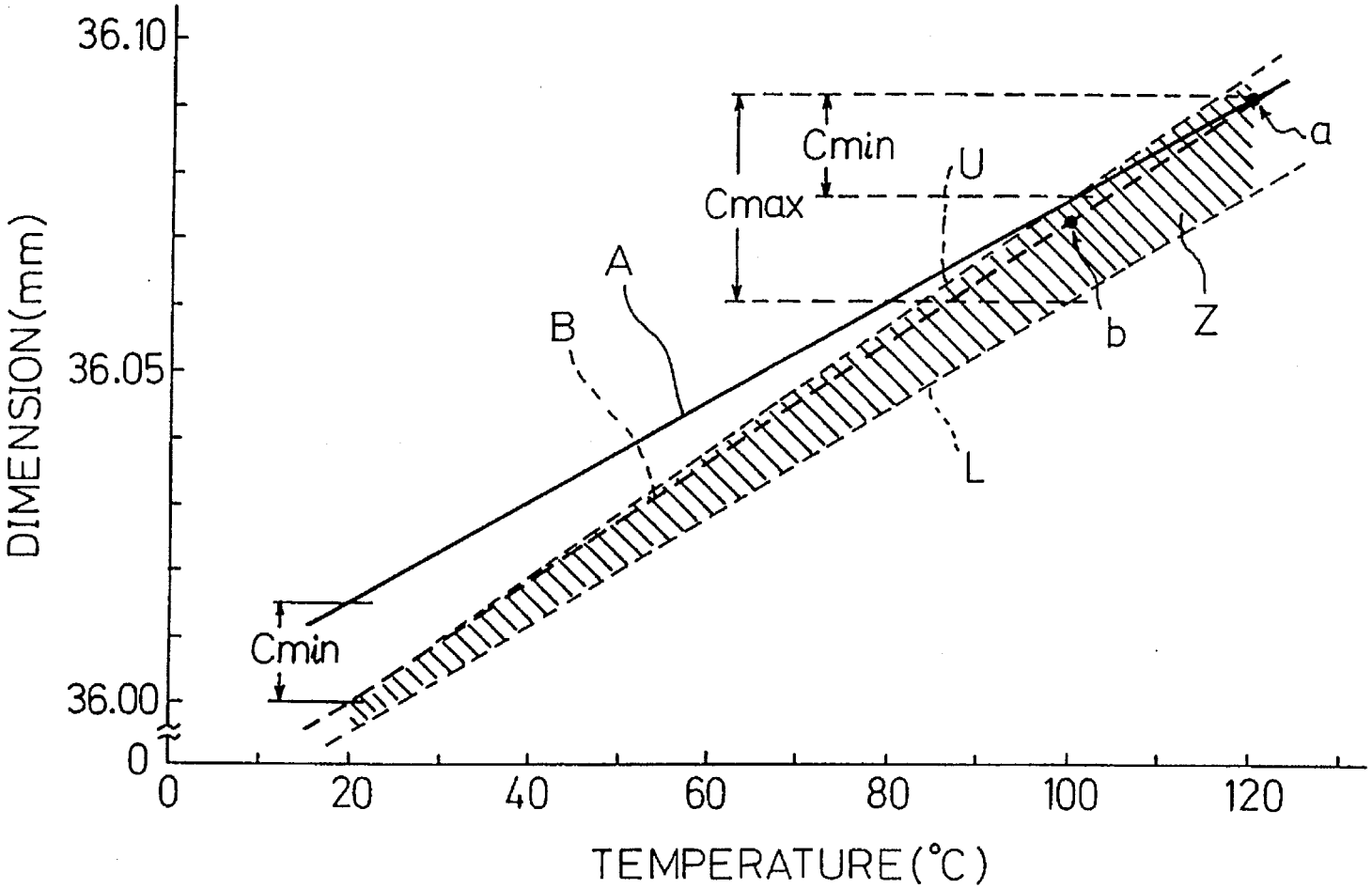

FIG. 50 is a relationship between the temperature of the rotary valve and its dimension.

Figure 51:
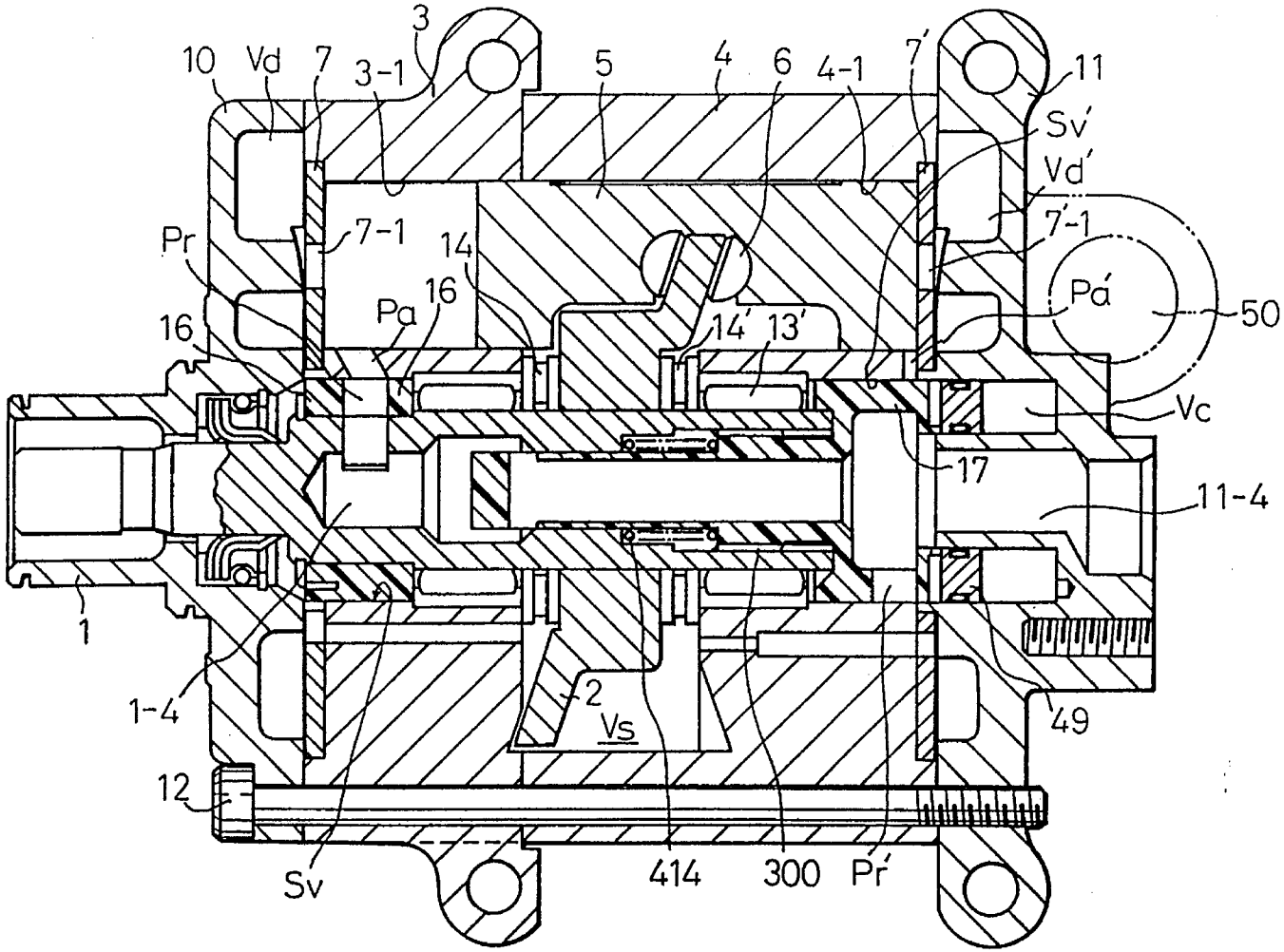

FIG. 51 is a longitudinal cross sectional view of a compressor according to sixteenth embodiment.

DESCRIPTION OF THE PREFERRED EMBODIMENT

Figure 4:
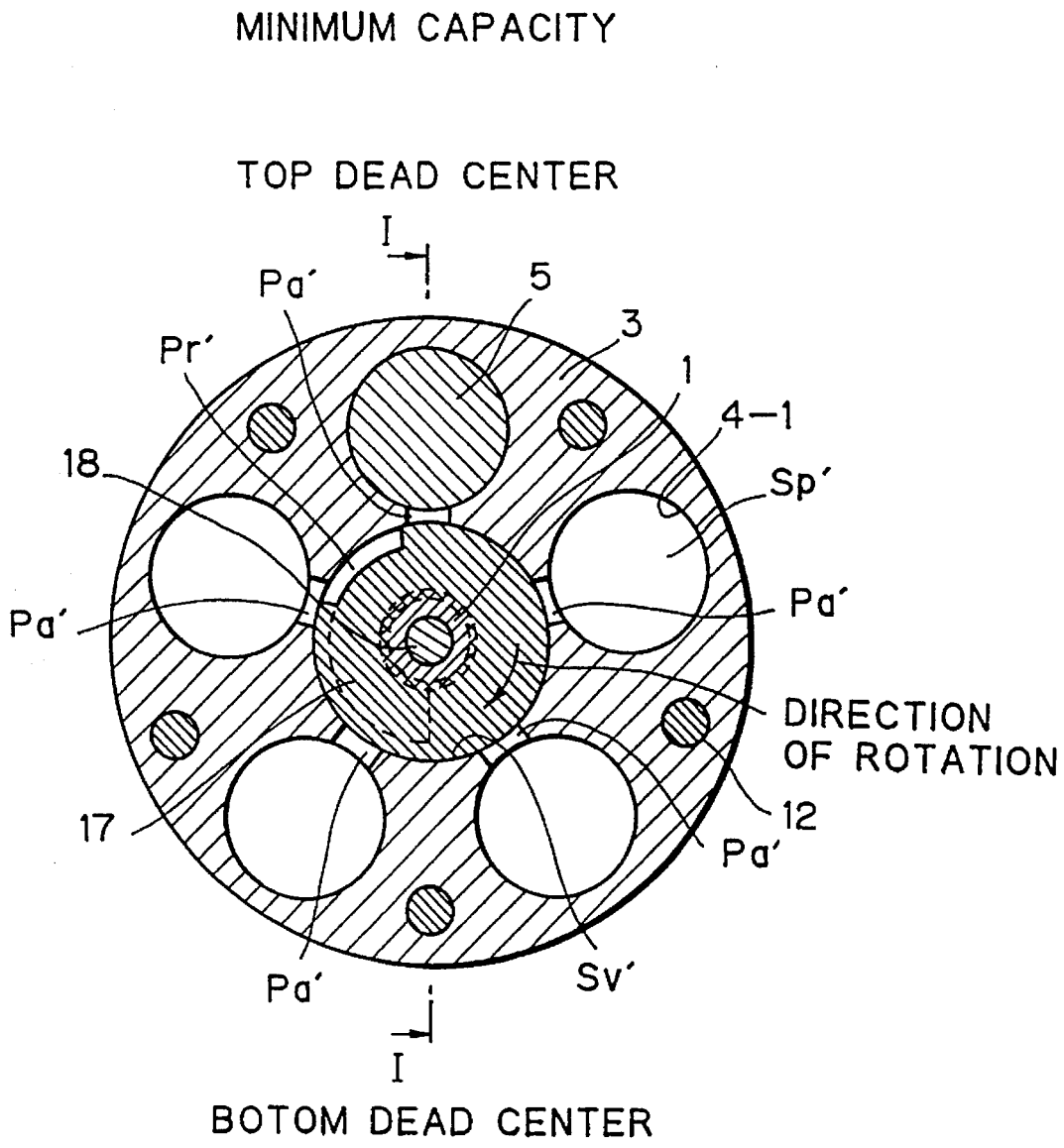
FIG. 4 is a transverse cross-sectional view of the compressor, taken along line IV—IV in FIG. 1.

FIG. 1 shows a first embodiment of a swash plate type compressor according to the present invention that is used for a refrigerant compressor of an air conditioning apparatus in a vehicle. The compressor is provided with a rotating shaft 1 connected, via an electromagnetic clutch, (not shown) to a rotating shaft (not shown) of an internal combustion engine of the automobile for receiving a rotating movement therefrom. A swash plate 2 is fixedly connected to the rotating shaft 1. The compressor is further provided with axially separated cylinder blocks 3 and 4, which rotatably support the rotating shaft 1 by means of respective radial bearings 13 and thrust bearings 14. The cylinder blocks 3 and 4 define a plurality of axially spaced aligned sets of cylinder bores 3-1 and 4-1. The aligned sets are arranged equiangularly and spaced along the circumference of the cylinder blocks 3 and 4. See FIG. 4. Axially and slidably inserted in each aligned set of the cylinder bores is a double headed piston 5. Respective pairs of shoes 6 have a semi-circular cross-sectional shape and are received in recess 5*a* having a complimentary shape to the swash plate 2. Rotational movement of the swash plate 2 by the rotation of the shaft 1 causes the pistons 5 to axially reciprocate in respective cylinder bores 3-1 and 4-1, so that the volume of the piston compression chamber Sp or Sp' alternately increases and decreases so as to compress the refrigerant, as will be fully described later. Connected to the ends of the cylinder blocks 3 and spaced from the ends of the piston 5 are valve seats 7, 7' which define valve ports 7-1, 7-1' opened to respective compression chambers Sp, Sp'. Arranged on a side surface of the valve seats 7, 7' remote from the compression chambers Sp, Sp' are delivery valves 8, 8' which are used as reed valves for closing the respective valve ports 7-1, 7-1'. Arranged on one side of the delivery valves 8, 8' are valve stoppers 9, 9' for preventing the respective delivery valves 8, 8' from buckling when the valves 8, 8' are detached from the respective valve seats 7, 7' due to high pressure in the compression chambers Sp, Sp' during a compression stroke of the respective pistons 5. A similar construction including a valve seat 7', delivery valves 8', and a valve stopper 9' is provided for controlling the outlet of the medium as compressed from the right handed piston chambers Sp'. The valve seats 7 and 7', the delivery valves 8 and 8' and valve stoppers 9 and 9' are sandwiched between the cylinder blocks 3 and a front casing 10 or a rear casing 11, and are tightened to each other by means of five bolts 12 that are circumferentially spaced as shown in FIG. 4, which shows top dead center at the top of the figure and bottom dead center at the bottom. In FIG. 1, the front casing 10 has a boss portion, inwardly of which, an annular recess 10-1 is formed. Arranged in the annular recess 10-1 is an annular seal assembly 15 that is in contact with an outer surface of the rotating shaft 1 during rotational movement, so that a sealing function is obtained between the seal assembly 15 and the shaft 1.

Figure 5:
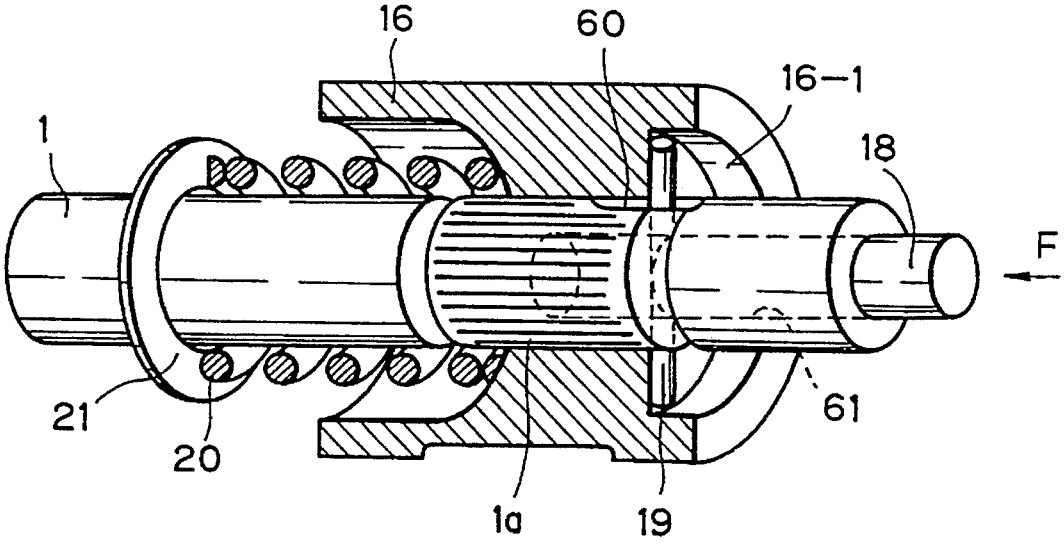
FIG. 5 is a schematic perspective view illustrating the front rotary valve in FIG. 1.

A pair of axially spaced rotary valves 16 and 17 are arranged on the rotating shaft 1 at its front and rear portions, respectively. The rotary valves 16 and 17 are spline engaged to the shaft 1 so that they rotate together with the rotation of the shaft 1 while slidably moving thereto. A reference numeral 20 denotes a coil spring arranged around the shaft 1 and located between a collar 21 connected onto the shaft 1 by means of a circlip 22 and the front rotary valve 16 for urging the front rotary valve 16 in a right-hand or rearward direction in FIG. 1. Arranged between the front rotary valve 16 and the rear rotary valve 17 is a guide pin 19 and a push rod 18. The shaft 1 is formed with diametrically opposite slits 60 to which the guide pin 19 extends radially so that the guide pin 19 is axially movable with respect to the shaft 1. The push rod 18 is axially and slidably inserted to an axial bore 61 of the shaft 1. As shown in FIG. 5, the front rotary valve 16 forms, at its axial end facing the rear rotary valve 17, an annular recess 16-1, to which the ends of the guide pin 19 extend. As a result, an axial movement of the rear rotary valve 17 toward the front rotary valve 16, as shown by an arrow F, causes the front rotary valve 16 to move in the same direction the same distance via the push rod 18 and the guide pin 19 against the force of the spring 20. It should be noted that, in FIG. 5, the shaft 1 has, on its outer surface, a spline portion la that is spring engaged with a spline inner surface of a central bore of the rotary valve 16.

Figure 2A:
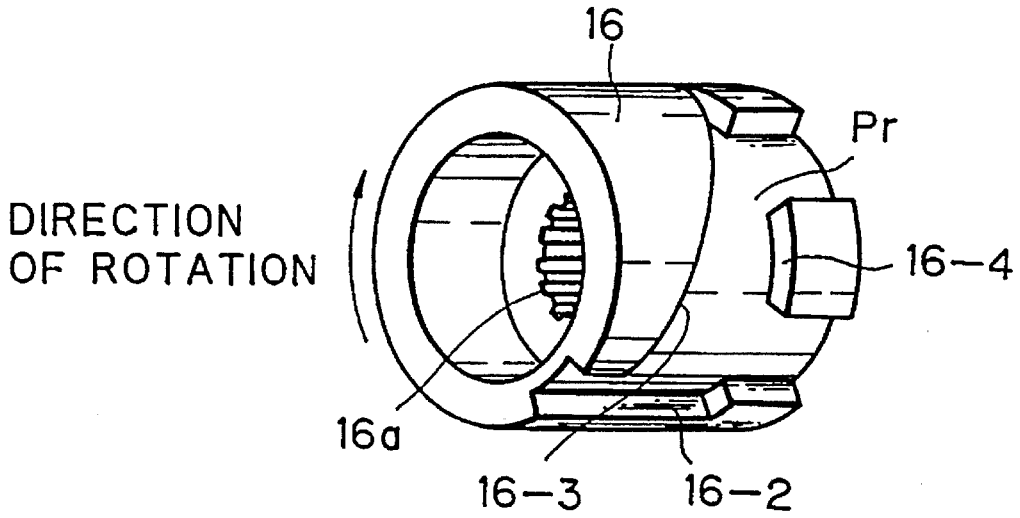
FIGS. 2A and 2B show perspective views of rotary valve 16 and 17, respectively in FIG. 1.
Figure 2B:
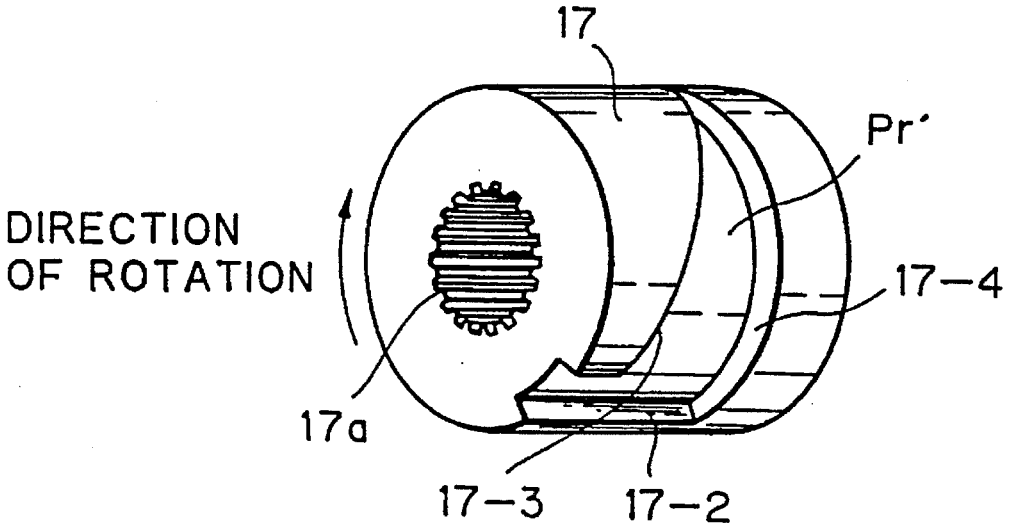

As shown in FIG. 2A, the rotary valve 16 forms a tubular body, which defines inner spline 16*a* in a spline engagement With the outer spline 1*a* (FIG. 5) on the shaft 1. The rotary valve 16 forms, on its outer cylindrical surface, a circumferentially extending recess having a gradually increasing axial width, defining an intake passageway Pr having a substantially triangle shape when developed. The recess Pr thus forms an edge 16-2 extending parallel along the axis of the shaft 1, a front edge 16-3 inclined and a rear edge 16-4 extending circumferentially. The rear edge 16-4 has portions cut out for communication with the intake chamber Vs. Similarly, as shown in FIG. 2B, the rear rotary valve 17 forms a tubular body that defines inner spline 17*a* in spline engagement with the outer spline on the shaft 1. The rear rotary valve 17 forms, on its outer end 3, a circumferentially extending recess having a gradually increasing axial width and defining an intake passageway Pr, Pr' having a substantially triangle shape when developed. The recess Pr' thus forms an edge 17-2 extending parallel along the axis of the shaft 1, a front edge 17-3 circumferentially inclined and a rear edge 17-4 extending circumferentially. These intake passageways Pr and Pr' are opened to an intake pressure chamber Vs formed in the compressor, so that the intake passageways Pr and Pr' are always under the same pressure level. The intake pressure chamber Vs is in communication with the source of a fluid medium, such as a refrigerant, to be compressed. The arrangement of the rotary valves 16 and 17 with respect to the rotating shaft 1 is such that, upon assuming an angular position of the rotating shaft upon one complete rotation, the axially extending wide edges 16-2 and 17-2 of the rotary valves 16 and 17 engage with grooves Pa, as will be described later, and the corresponding piston 5 is at top dead center. Namely, the front rotary valve 16 and the rear rotary valve 17 are located on angular positions of the shaft 1, the phase difference of which is 180 degrees. As shown in FIG. 1, the rear rotary valve 17 has a closed rear portion 17*a* and is inserted to a valve bore Sv' so that a control pressure chamber Vc is formed on one side of the rear rotary valve 17 so that the control pressure in the chamber Vc causes the rear rotary valve 17 and the front rotary valve 16 to move on the shaft 1 against the force of the spring 20. Namely, the front and rear rotary valves 16 and 17 move in unison via the push rod 18 and the guide pin 19.

The cylinder blocks 3 and 4 form, at their center portions, valve bores Sv and Sv', in which the rotary valves 16 and 17 rotate, respectively, while small gaps are maintained between the respective cylinders and the rotary valves. These valve bores Sv and Sv' are in communication with the piston chambers Sp and Sp' via the cut grooves Pa and Pa', respectively, which are formed at ends of the cylinder blocks 3 and 4 adjacent to the valve seats 7, and 7' as shown in FIGS. 1 and 4. An arrangement of the cut grooves Pa and Pa' and the variable intake passageways Pr and Pr' are such that the intake passageway Pr or Pr' having a developed triangle shape is, during one rotation of the rotary valve 16 or 17, in communication with a single cylinder Sp or Sp' via the cut groove Pa or Pa' at a specified range of a rotating angle during one complete rotation of the rotary valve 16 or 17. Namely, during rotation of the rotary valves 16 and 17, communications between the variable intake passageways Pr and Pr' and the piston cylinders Sp and Sp', which are circumferentially spaced via the respective cut grooves, takes place in a sequential manner along the circumferential direction, as will be seen from FIG. 4.

Figure 6:
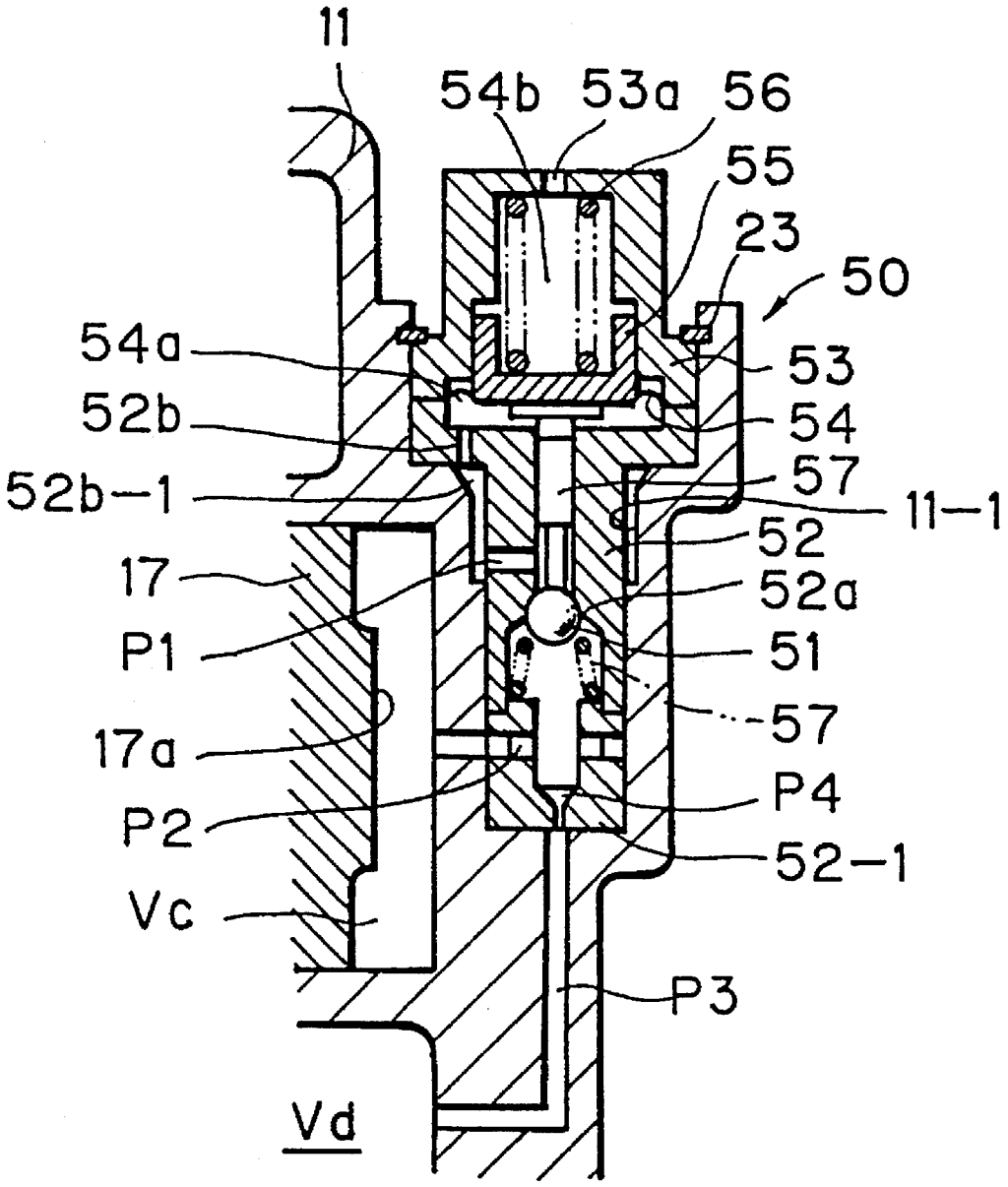
FIG. 6 is a longitudinal cross-sectional view of the control valve in the compressor in FIG. 1.

A control valve 50 is, as shown in FIG. 6, arranged in the rear casing 11 so that it extends in a direction transverse to the axis of the rotation of the shaft 1. The rear casing 11 is formed with an outwardly opened bore 11-1 with a shoulder, to which the valve 50 is fitted, and is fixed to the casing 11 by means of a circlip 23. The control valve 50 is a three port valve which includes an upper cover 53 and a housing 52, which defines a first or intake pressure port P1, a second or control pressure port P2 and a third or outlet pressure port P3. The intake pressure port P1 is connected to the intake pressure chamber Vs in the compressor; the control pressure port P2 is connected to the control chamber Vc in the compressor, and the outlet pressure port P3 is connected to the outlet pressure chamber Vd. Arranged in the housing 52 is a ball valve 51, which rests on a conical shaped valve seat 52*a* formed in the housing 52 for controlling communication between the intake pressure port P1 and the control pressure port P2. A coil spring 57 is provided for urging the ball valve 51 so that the ball valve 51 is seated on the valve seat 52*a*. A diaphragm 54 is provided so that it is, at its outer peripheral portion, sandwiched between the top cover 53 and the lower housing 52. A cap shaped stopper 55 is vertically and slidably fitted to an inner bore of the cover 53, and a coil spring 56 is provided for urging the stopper 55 downward. The diaphragm 54 is also connected to the bottom end of the stopper 55, and facing the bottom end of the stopper 55 is a rod 57 that is slidable in a vertical bore of the housing 52, and extends vertically so that the rod 57 faces the upper surface of the valve 51. Formed on the bottom side of the diaphragm 54 is a first space 54*a* that is in communication with the intake pressure port P1 via an orifice 52*b* and an annular space 52*b*1. Formed on the upper side of the diaphragm 54 is a second space 54*b* that is opened to the outside air via an opening 53*a*. As a result, a displacement of the diaphragm 54 occurs in accordance with a difference between a fluid force, as generated by a pressure difference between the intake pressure in the first space 54*a* and the atmospheric pressure in the second space 54*b*, and the spring force as generated by the coil spring 56 arranged in the second space 54*b* opens to the outside air. The rod 57 is for transmission of the displacement of the diaphragm 54 to the ball valve 51. It should be noted that an orifice P4 having a small inner diameter is formed in a lower separated portion 52-1 of the housing 52 so that the control pressure port P2 is always in communication with the outlet pressure port P3 via the throttle portion P4 for controlling the introduction of outlet pressure.

Now, an operation of the swash plate type compressor according to the first embodiment of the present invention will be explained. Upon a rotation of the rotating shaft 1, the swash plate 2 integrally connected thereto is also rotated. The rotational movement of the swash plate 2 causes the pistons 5 to be axially reciprocated in the respective cylinder bores 3-1 and 4-1 between top dead center and bottom dead center due to the fact that the swash plate 2 is connected to the pistons 5 via respective pairs of shoes 6. At the same time, the rotary valves 16 and 17 in spline engagement with the shaft 1 are rotated in the valve bore Sv and Sv', respectively. In this case, the variable intake passageways Pr and Pr' formed on the outer peripheries of the rotary valves 16 and 17 are always subject to intake pressure, so that the piston chambers Sp or Sp' in communication with the intake passageways Pr or Pr' via the cut grooves Pa or Pa' are maintained under intake pressure conditions. Note: in FIG. 1, top dead center refers to a position of the piston 5 where the piston 5 is closest to the valve plate 7 or 7', thereby having the smallest possible piston chamber volume, and bottom dead center refers to a position of the piston 5 such that the piston 5 is farthest from the valve plate 7 or 7', thereby creating the maximum piston chamber volume. FIGS. 4, 8, 20 and 26 are referenced with top dead center of the piston at the top of the respective figure and bottom dead center being at the bottom.

In the swash plate type variable volume compressor according to the present invention, the variable intake passageways Pr or Pr' are in communication with the specific cut grooves Pa or Pa' associated with the corresponding piston cylinder Sp or Sp' for a particular angular range within one complete rotation between a position just after the corresponding piston 5 reaches a position of top dead center and a position before reaching bottom dead center. The refrigerant gas in the intake pressure chamber Vs is admitted into the piston chamber Sp or Sp' during a rotating angle of the rotary valve 16 or 17, where the intake passageway Pr or Pr' communicates with the corresponding intake port Pa or Pa'. The rotational movement of the rotary valve 16 or 17 causes its rotational angle to be outside of the above range of the rotating angle, so that the piston cylinder Sp or Sp' and the corresponding cut groove Pa or Pa' are disconnected from the variable intake passageway Pr or Pr' of the rotary valve 16 or 17. A value of the volume of the compressor corresponds, therefore, to this amount of refrigerant gas confined in the piston cylinder Sp or Sp' at the instant the variable intake passageway Pr or Pr' of the rotary valve 16 or 17 is disconnected from the cut groove Pa or Pa' associated with the corresponding piston cylinder Sp or Sp'.

FIGS. 1 and 4 show conditions such that the rotary valves 16 and 17 are moved to respective, most right side (rearward) positions. Under these conditions, the minimum value of the rotating angle of about 25 degrees from an angular position at top dead center is obtained, where the variable intake passageway Pr or Pr' is in communication with the piston cylinder Sp or Sp'. Namely, the rotary valves 16 and 17 are in the respective axial positions where the corresponding variable intake passageways Pr and Pr' are in communication with the respective cut grooves Pa and Pa' at only a small range of the rotating angle. As a result, intake volume of about 20% with respect to the maximum intake volume of the refrigerant gas is obtained.

Figure 7:
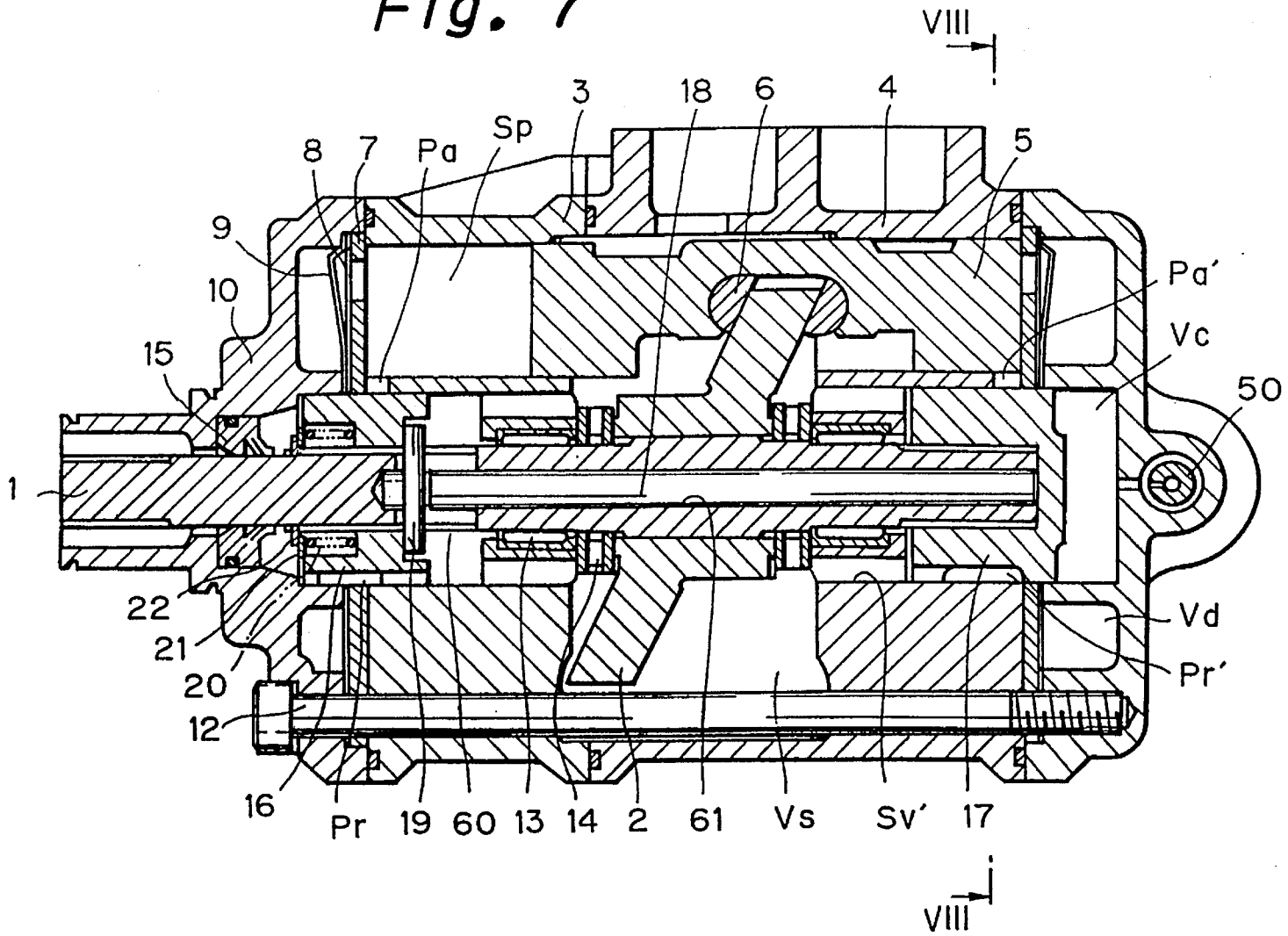
FIG. 7 is similar to FIG. 1, but when under maximum capacity condition, taken along lines VII—VII in FIG. 8.
Figure 8:
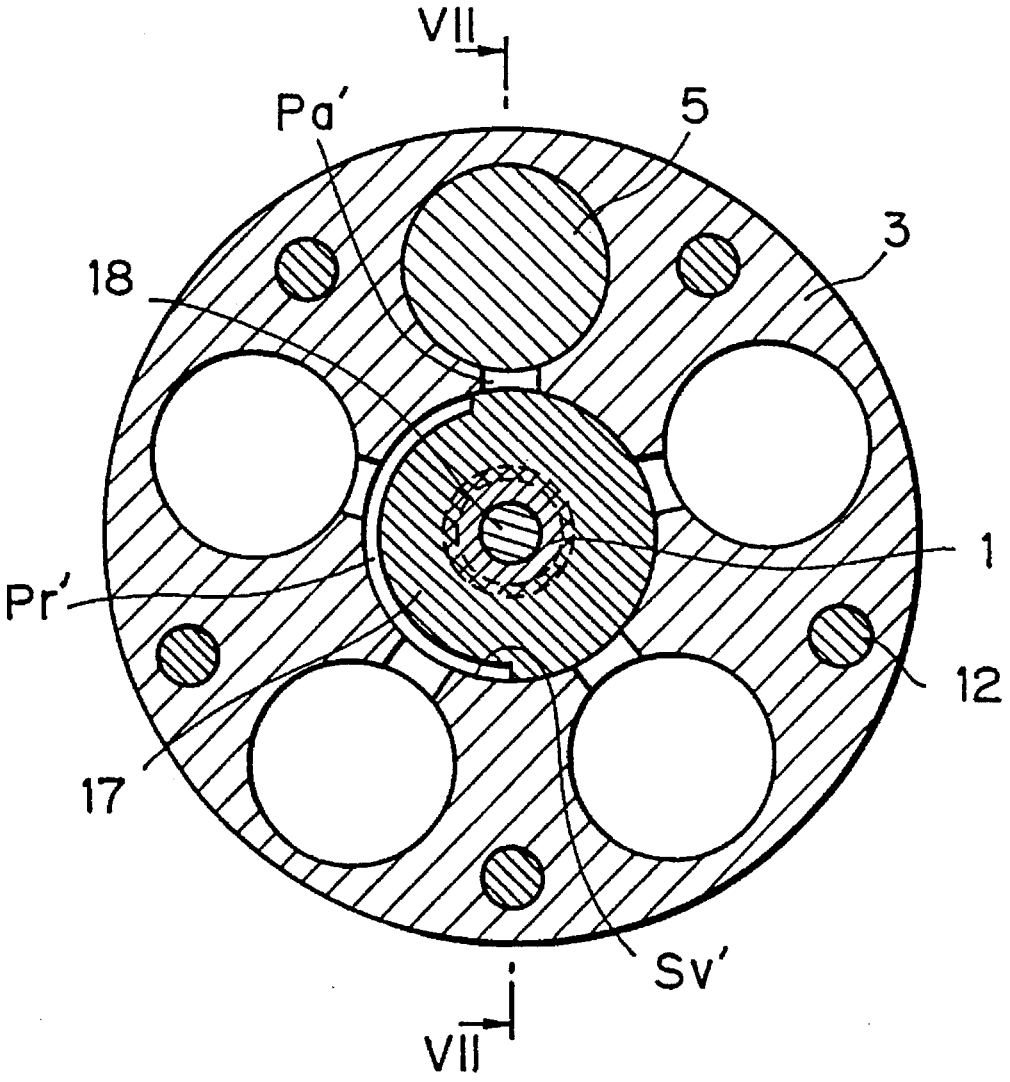
FIG. 8 is a transverse cross-sectional view of the compressor taken along line VIII—VIII in FIG. 7.

When the rotary valves 16 and 17 are moved to the respective, most left side (forward) positions, as shown in FIGS. 7 and 8, the maximum value of the rotating angle of about 180 degrees from the angular position at top dead center is obtained, where the variable intake passageway Pr or Pr' is in communication with the piston cylinder Sp or Sp'. Namely, the rotary valves 16 and 17 are under the respective axial positions where the corresponding variable intake passageways Pr and Pr' are in communication with the respective cut grooves Pa and Pa' at a range of a rotating angle from the dead center position and the bottom dead center position. As a result, a maximum value intake volume is obtained.

Figure 3A:
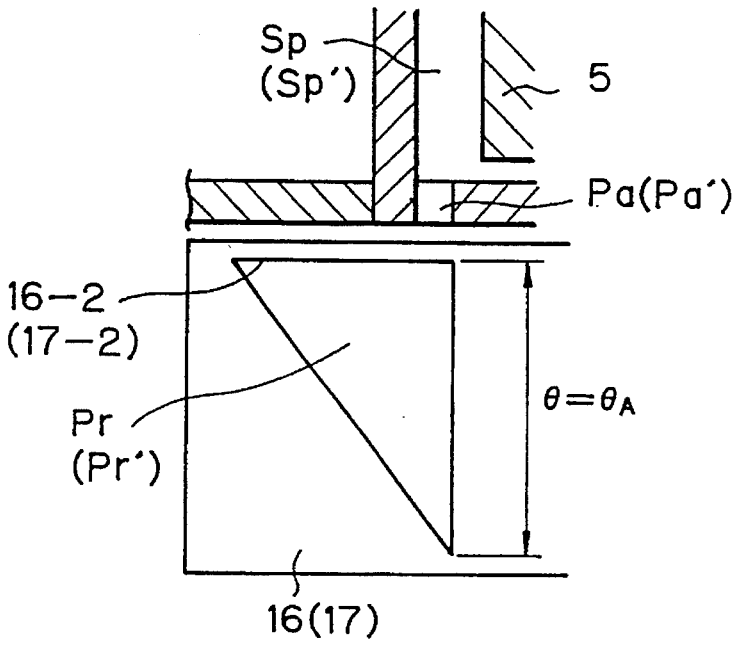
FIGS. 3A and 3B show schematic views illustrating a relationship between the intake passageway with the intake port under the maximum and minimum capacity conditions, respectively.
Figure 3B:
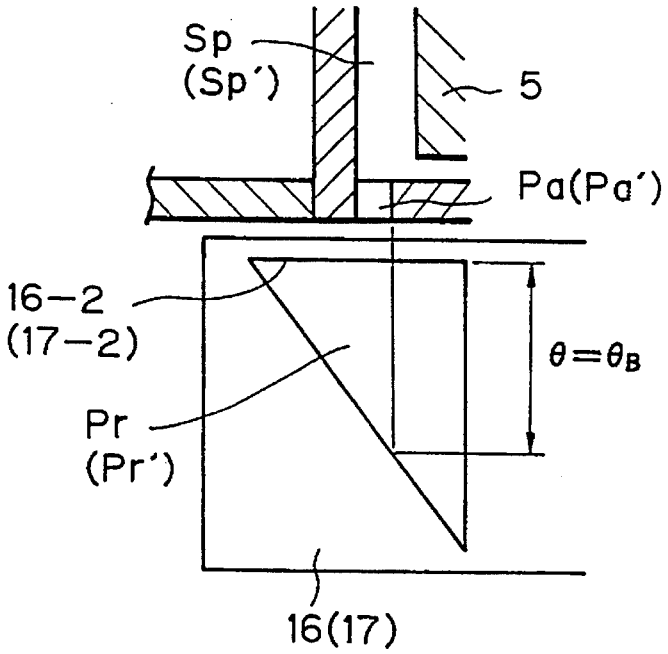

According to the swash plate type variable compressor of the present invention, by the axial movement of the rotary valves 16 and 17 on the shaft 1, the angle where the variable intake passageways Pr or Pr' communicate with the piston cylinders Sp or Sp' via the corresponding cut groove Pa or Pa' is changed so that the volume introduced into the piston cylinder continuously changes. Namely, FIG. 3A schematically illustrates a positional relationship between the rotary valve 16 or 17 with the cut groove Pa or Pa' of a piston cylinder Sp or Sp', when the rotary valve at its most left side position. In this case, the intake passageway Pr or Pr' communicates with the piston cylinder through an angle of $\Theta_B$, from the top dead center position. FIG. 3B is similar to FIG. 3A, but illustrates when the rotary valve at its most right side position. In this case, the intake passageway Pr or Pr' communicates with the piston cylinder through an angle of $\Theta_B$, from the top dead center position. Namely, the intake passageway Pr or Pr' commences communication with the cut groove Pa or Pa' at its axial edge 16-2 or 17-2 corresponding substantially to the top dead center position. Thus, the range of the angle $\Theta$ continuously varies in accordance with the axial position of the rotary valves 16 and 17. The control of the axial position is effected by the control of pressure at the control chamber Vc, which will be described herein below.

As shown in FIG. 1, the pressure chamber Vc is under control pressure acting to the rear end 17*a* of the rear rotary valve 17, while the intake pressure in the intake pressure chamber Vs acts upon the front end 17*b* of the rotary valve 17. Thus, a fluid pressure force is applied to the rotary cylinder 17 in the forward direction (left handed direction in FIG. 1), which corresponds to the difference between the pressure Pc in the control chamber Vc and the intake pressure Ps in the intake chamber Vs, multiplied by the cross-section area Av of the valve cylinder Sv or Sv'. Namely, the fluid pressure force is equal to Av×(Pc–Ps). This force is transmitted, via the push rod 18 and the guide pin 19, to the front rotary valve 16, and is opposite to the spring force from the coil spring 20. As a result, the rotary valves 16 and 17 take positions where the fluid force owing to the pressure difference Pc–Ps is balanced with the spring force by the spring 20. As a result, a control pressure Pc can vary so that the desired axial positions of the rotary valves 16 and 17 are obtained according to the present invention.

The control valve 50 in FIG. 6 can create a desired value of the control pressure Pc in the control chamber Vc. Namely, the force, as generated in the diaphragm 54 based on the intake pressure Ps via the intake pressure port $P_1$, is larger than the force exerted by the spring 56. The diaphragm 54 is moved in a direction upwardly in FIG. 6, thereby causing the ball valve 51 to be seated on the valve seat 52*a* of the conical shape and the intake port $P_1$ is disconnected from the control pressure port $P_2$. Since the control pressure port $P_2$ is disconnected from the intake pressure port $P_1$, and the outlet pressure Pd in the output pressure chamber Vd is opened to the control port $P_2$ via the orifice $P_4$, the control pressure Pc is increased to the control pressure Pd.

Contrary to the above, when the force to be generated at the diaphragm 54 by the intake pressure Ps at the intake port $P_1$ is smaller than the force exerted by the spring 56 in the atmospheric air pressure chamber 54*b*, the diaphragm 54 together with the rod 57 contacting thereto is displaced downwardly, so that the rod 57 pushes the ball valve 51 downwardly, and so that the ball valve 51 is detached from the valve seat 52*a* of the conical shape, so that the control port $P_2$ is connected to the intake pressure port $P_1$, and so that the control pressure Pc at the control port $P_2$ is reduced to the intake pressure Ps. According to the control valve 50 of this embodiment, the force of the spring 56 is obtained when the intake pressure Ps of 2 atm is applied to the diaphragm 54.

In a typical type of an air conditioning system for an automobile, a refrigerating cycle is operated such that an intake pressure Ps of about 2 atm is obtained when the evaporating temperature of the refrigerant is about 0° C. When a thermal load at the refrigerating cycle is higher than the capacity of the compressor, the value of the intake pressure is higher than 2 atm.

In the swash plate type variable capacity compressor according to the first embodiment, when the value of the intake pressure Ps is larger than 2 atm as a result of a large thermal load at the refrigerating cycle, the diaphragm 54 moves upwardly in FIG. 6, thereby causing control pressure port $P_3$ to communicate with the control pressure port $P_2$, the control pressure Pc to increase, and the rotary valves 16 and 17 to move in the forward direction (left-handed direction in FIG. 1) for increasing the capacity of the compressor. Contrary to this, when the value of the intake pressure Ps is smaller than 2 atm due to a low thermal load at the refrigerating cycle, the diaphragm 54 moves downwardly, thereby causing the control pressure port $P_2$ to be also connected to the intake port $P_1$, the control pressure Pc to decrease, and the rotary valves 16 and 17 to move in the rearward direction (right-handed direction in FIG. 1) for decreasing the capacity of the compressor. As a result, in a range of the thermal load for obtaining control of the intake pressure Ps to a value of 2 atm, the compressor is operated so that the capacity is automatically controlled to a value matching the thermal load.

In FIG. 9A, the ordinate is a rotation angle Θ of the rotating shaft 1, and the abscissa is the volume v of the piston cylinder Sp or Sp'. A value of 0° and 360° of the rotating angle corresponds to the top dead center position of the piston 5, and 180° rotating angle corresponds to the bottom dead center position of the piston 5. In FIG. 9B, the abscissa is the v value of the piston cylinder Sp or Sp', and the ordinate is pressure p in the piston chamber Sp. When the variable volume compressor is operating under maximum capacity, the piston cylinder Sp or Sp' is in communication with the intake pressure chamber Vs between the top dead center position A and the bottom dead center position B thereby executing an intake stroke. Namely, this intake stroke at a maximum capacity is in a rotating angle of 180° between a point a (top dead center: volume is 0) and b (bottom dead center: volume is MAX), where the pressure in the piston chamber has the intake pressure Ps. A compression stroke then occurs between the position b (volume is MAX) and the position c, while the pressure P in the piston chamber is increased along a line m due to compression. At the point c, the delivery valve 8 or 8' is opened to discharge the compressed gas to the delivery chamber Vd. Finally, a delivery stroke follows between the point c and d (volume is 0).

When a partial capacity operation is carried out by moving the rotary valves 16 and 17 in a forward direction, the piston cylinder Sp or Sp' is in communication with the intake pressure chamber Vs for a rotating angle between top dead center A and the position B of a rotating angle $\Theta_0$ so as to execute an intake stroke. Namely, this intake stroke at a reduced capacity is between a point a (volume is 0) and e (volume is $V_0$), where the pressure in the piston chamber is under the intake pressure Ps. An expansion stroke then follows between the position e and the position b', while the pressure P in the piston chamber is decreased along a line n. A compression stroke then follows between the position b' and the opposite c'. At point c', the delivery valve 8 or 8' is opened for commencing a discharge of the compressed gas to the delivery chamber Vd. Finally, a delivery stroke follows between the point c' and d. Namely, a p-v chart of the variable capacity compressor according to the first embodiment of the present invention is, during the reduced capacity mode, shown by the lines connecting the points in the order of a, e, b', c', d, and a. In this case, the compression drive power corresponds to the area enclosed by the points a, e, c', d, and a, which is equal to the driving power for compression of the volume $V_0$. Thus, the present invention can provide an effective compression operation.

According to the swash plate type compressor of the present invention, an axial position of the rearward rotary valve 17 on the shaft 1 varies, and its movement is transmitted, via the push rod 18 inserted in the shaft 1 and a guide pin 19, to the forward rotary valve 16, so that, for both the rearward and forward valves 16 and 17, the same range of the rotating angle is obtained for communicating the intake pressure chamber Vs with the piston cylinders Sp and Sp'. Thus, a continuously varied compressor capacity can be obtained irrespective of a highly simplified construction.

Furthermore, according to the present invention, the spring 20 generates an axial force for urging the forward rotary valve 16 to move in a rearward direction, while the control pressure Pc in the control chamber Vc generates a force at the rear surface of the rearward rotary valve 17 in a forward direction by means of the control valve 50 for controlling the control pressure Pc in accordance with the intake pressure Ps, so that the axial position of the rotary valves 16 and 17 can obtain a continuously varied capacity of the compressor and the compressor can always be operated with a suitable capacity corresponding to the thermal load occurring in the refrigerating cycle of the air conditioning apparatus.

According to the present invention, a complicated construction, such as a mechanism for controlling the inclination angle of the swash plate for obtaining the continuously varied capacity in the prior art, can be eliminated, and therefore, the reliability of the operation in the compressor can be increased.

Various modifications of the present invention will now be explained.

According to the first embodiment of the present invention, the variable intake passageways Pr and Pr' having a developed triangular shape are provided for a desired rotating angle range from a top dead center position A to a bottom dead center position B. Contrary to this, according to a second shown in FIGS. 10A(1) and 10B(1), the rotary valve 16 or 17 formed with an intake passageway Pr(Pr') having a substantially trapezoidal shape when developed, is formed within a rotating angle range. The rotary valves of the second embodiment are arranged such that the reduction of the capacity is obtained when moved in the opposite direction as that in the first embodiment. In this construction of the rotary valve 16 or 17, FIGS. 11A and 11B show relationships between the volume v in the piston cylinder Sp and the rotating angle Θ and between the volume v and the pressure p. When the compressor is operating under maximum capacity the piston cylinder Sp or Sp' is as shown in FIG. 10A(2) in communication with the intake port Pa or Pa' for rotating angle (Θ=180°) between top dead center A and bottom dead center B so as to execute the intake period between the points a and b. During movement of the rotary valve 16 or 17 from bottom dead center B to top dead center A, a compression period is first obtained between the points b and c, and a delivery period is then obtained between the points c and d, as shown by a line m'. In order to reduce the capacity, the rotary valve is moved from the position in FIG. 10A(2) toward the position in FIG. 10B(2). In the position 10B(2), an intake period is obtained when the rotary valve 16 or 17 is moved from top dead center A and bottom dead center B (between the points a and b in FIG. 11B, and communication between the piston cylinders Sp or Sp' continues up to the point F, which is further rotated from bottom dead center B for an angle of $\Theta_1$. This range $\Theta_1$ of the rotating angle between point b and f corresponding to an intake-discharge stroke where the refrigerant gas under the intake pressure Ps once drawn into the piston cylinder Sp or Sp' is again moved back to the intake chamber Vs until a position f is obtained such that the volume of the piston cylinder Sp or Sp' is reduced to $V_0$. When the position f of the rotary valve 16 or 17 is obtained, communication of the piston cylinder Sp or Sp' with the intake pressure chamber Vs is cancelled, so that, during movement up to top dead center A, a compression stroke is obtained between the points f and c', as shown by a line n', and a discharge stroke is obtained between the points c' and d. As a result, according to the swash plate type variable compressor, the p-v chart with a reduced or varied capacity is indicated by lines connecting the points a, b, c', d and a, and the compression power corresponds to a value of the figure area encircled by the p-v chart, which corresponds, similar to the first embodiment, to the compression power for the volume $V_0$.

In the above first and second embodiments, the control pressure Pc is applied directly to the rear surface 17*a* of the rotary valve 17. Contrary to this, as shown in FIG. 12, a control piston 24, which is slidable with respect to the casing 11 is arranged on one rear side of the rear rotary valve 17, and a thrust bearing 25 is arranged between axially spaced facing walls of the rotary valve 17 and the control piston 24. As a result, the control pressure in the control chamber Vc is applied to the rotary valve 17 by way of the control piston 24 and the thrust bearing 25.

A third embodiment of the present invention will be explained with reference to FIG. 13. In place of using the control valve 50 as a three port valve, which is responsive to the intake pressure Ps modified to the control pressure Pc, a control valve is employed, which is, as shown in FIG. 13, basically constructed by a diaphragm member 74 and a spring 72. In this construction of the control valve, a reference numeral 70 is a cover having a flanged cup shape fixedly connected to the rear casing 11 by means of bolts 75 via a diaphragm member 74 made of a rubber material. As shown in FIG. 14, the diaphragm member 74 is sandwiched between a cup shaped spring holder 71 and a cap member 73 that is fixed to the holder 71. A spring 72, on its first end, rests on the inner surface of the cup 70, and on its second end, rests on the opposite inner surface of the holder 71 so that the diaphragm member 74 is displaced in the direction toward the rear rotary valve 17. The cap 73 has, at its side faced with the rotary valve 17, a projection portion 77 of a hemispherical shape that contacts the facing end surface of the rotary valve 17. The cover 70 forms an air inlet 76 open to the atmosphere, so that space inside the body is subject to an atmospheric pressure, which acts on the side of the diaphragm member 74 facing the cup member 71.

The operation of the swash plate type compressor as shown in FIG. 13 controls the axial movement of the rotary valve 16 and 17 will be explained with reference to FIG. 15. S is a pressure receiving area of the diaphragm member 74, Kf and Kr are spring factors for the springs 20 and 72, respectively, δf and δr shrink with respect to the length of the springs 20 and 72, respectively during the minimum capacity of the compressor, i.e., when the rotary valves 16 and 17 move in the most left-hand (forward) direction in FIG. 15, and x is the axial movement of the rotary valves 16 and 17 from a position during the minimum capacity of the compressor. The balance of forces applied to the rotary valves provides the following equations:

$$Kf \times (\grave{o}f + x) + S \times (Ps - 1) = Kr \times (\grave{o}r - x) \quad (1)$$

$$x = \frac{S}{Kf + Kr} \times Pa + \frac{Kr\,x\grave{o}r - Kf\,x\grave{o}f + S}{Kf + Kr} \quad (2)$$

The equations (1) and (2) show that the amount of the displacement of the rotary valves 16 and 17 on the shaft 1 is inversely proportional to the intake pressure Ps. Namely, a reduction in the intake pressure Ps causes the rotary valves 16 and 17 to move in the rearward (right-handed) direction, thereby reducing the capacity of the compressor.

According to this embodiment, the factors, such as spring factors Kf and Kr of the springs 20 and 72, respectively, are such that a movement of the rotary valves 16 and 17 between the minimum capacity position and the maximum capacity position is obtained when a value of the intake pressure Ps is around 2 atm, i.e., the maximum capacity is obtained when intake pressure is 2 atm, while minimum capacity is obtained when the intake pressure is 1.9 atm. Namely, operation of the compressor in accordance with the thermal load is obtained such that a large thermal capacity is obtained when the load is high, and a small thermal capacity is obtained when the load is low. As a result, the maximum power consumption efficiency of the compressor is obtained.

According to the embodiment shown in FIG. 13, no provision regarding the control valve 50 in the first embodiment is made, thereby reducing manufacturing costs. A reduction in cost is also obtained because a communication means for introducing the pressure signals is unnecessary in the compressor housing, which allows machining time to be reduced. Elimination of the control valve 50 is advantageous in that a refrigerating cycle is not necessary, which would otherwise occur because of the response of the control valve 50.

In the embodiment shown in FIG. 13, in place of directly contacting the cap 73 (the projected portion 77) with the rotary valve 17, a thrust bearing 25 can be provided as shown in a modification in FIG. 16. Namely, the thrust bearing 25 is arranged in series between the rotary valve 17 and the cap 73 in such a manner that a transmission of the axial load occurs between the cap 73 and the rotary valve 17 by way of the thrust bearing 25.

FIG. 17 shows a different embodiment, wherein a bellows member 80 made of a metal sheet material is provided. The bellows member 80 has a first end to which a cap 82 forming a hemispherical shaped projection 82-1 contacting the rear end wall of the rotary valve 17 and a second end to which an annual shaped base member 81 is connected. The base member 81 is, at its outer periphery, sandwiched between the body 84 and a cover plate 83, which is fixedly connected to the body 84 by a suitable means. A spring 72 is arranged inside the bellows member 72, which is opened to the atmosphere via an opening 76 formed in the cover 83. The spring 72 urges the cap 82 toward the rotary valve 17. Similar to the embodiment in FIG. 16, an intake pressure Ps is opened to the space 80-1 outside the bellows member 80.

According to the construction in FIG. 17, a shrinkage of the bellows member 80 in accordance with the intake pressure Ps is obtained, similar to the operation in FIG. 13.

In the embodiment of the control valve 50 in FIG. 6, the intake pressure Ps and the discharge pressure pd in the respective chambers in the compressor are utilized for controlling the pressure Pc in the control chamber Vc. In place of the pressures Ps and Pd inside the compressor, outside pressure sources, such as a compressor, can be used. Namely, the pressure of the outside pressure sources are used in the control valve 50 to obtain a desired control pressure chamber pressure in the control pressure chamber Vc. Furthermore, in place of using the refrigerant gas pressure values for controlling the axial position of the rotary valves 16 and 17, an electric actuator, such as an electric motor, can be employed so that the axial position of the rotary valves 16 and 17 are electrically and directly controlled.

Another embodiment is shown in FIG. 18. In place of the double headed pistons in the first embodiment in FIG. 1, the compressor in the embodiment in FIG. 18 has pistons 5, each of which forms a single piston chamber on only one side thereof. Namely, a swash plate 2 is connected to a rotating shaft 1. The swash plate 2 has a boss portion 2-1, on which an annular place 92 is connected via a radial bearing 91, and is connected thereto by means of a circlip 2-3. A thrust bearing 90 is arranged between facing surfaces of the swash plate 2 and the plate member 92. A coil spring 2-4 is provided for urging the swash plate so that it is forced to a facing inner wall of the housing 10 via a thrust bearing 2-5. As a result, the plate member 92 is rotated together with the rotation of the rotating shaft 1. Piston rods 93, only one of which is shown, are for obtaining the axial reciprocating movement of the pistons 5 by the rotation of the swash plate 2. The plate member 92 is substantially semicircular shaped, with an axially outward opened recess, to which the piston rod 93 is engaged at its one end 93-1. Contrary to this, each piston 5 has an inner boss portion that is semicircular, and opens axially outward to which the piston rod 93 is engaged at its other end 93-2. The cylinder block 4 forms a plurality of circumferentially spaced cylinder bores 4-1, to which the respective pistons 5 axially and slidingly reciprocate so as to create piston chambers Sp. Upon such an axial reciprocating movement of the pistons 5 in the respective cylinder bore Sp by the rotating movement of the swash plate 92, the volume of the compression chambers Sp varies so as to obtain a compression operation of the gas.

In the embodiment in FIG. 18, which is similar to the first embodiment in FIG. 1, cut grooves Pa are opened for the respective cylinder bore Sv. A rotary valve 17 forming an intake passageway Pr is spline engaged with the rotating shaft 1, as explained with reference to the first embodiment while referring to FIG. 5, so that a control chamber Vc is formed on one side of the rotary valve 17 facing the casing 11. An intake pressure chamber Vs, which is in communication with a source of the fluid medium to be compressed, is formed inside the compressor. The intake pressure chamber Vs is opened to the other side of the rotary valve 17 which is remote from the control pressure chamber Vc. A coil spring 20 is provided for urging the rotary valve 17 in the right hand direction in FIG. 18. Similar to the first embodiment, a control valve 50 is provided for controlling the pressure in the control chamber for controlling an axial position of the rotary valve 17 on the shaft for controlling the capacity of the compressor. This embodiment operates similar to the first embodiment and obtains the same effect.

Another embodiment will now be explained with reference to FIGS. 19 to 24. In this embodiment, similar to the previous embodiments, on a rotating shaft 1 connected to a crankshaft of an internal combustion engine by way of a clutch (not shown), a swash plate 2 is fixedly connected. The rotating shaft 2 is rotatably supported on cylinder blocks 3 and 4 by means of radial bearings 13, and thrust bearings 14. Five double headed pistons 5 are axially and slidably inserted in respective cylinder bores 3-1 and 4-1 of the respective cylinder blocks 3 and 5 to create the respective piston chambers Sp and Sp', which are circumferentially spaced at an angle of one fifth of 360 degrees. See FIG. 20, which shows the maximum capacity. These pistons 5 are connected to the swash plate 2 via respective pairs of shoes 6 having a substantially semicircular shape, so that an axial reciprocating cylinder bores 3-1 and 4-1 is obtained. At the spaced ends of the cylinder blocks 3 and 4, valve plates 7 and 7', delivery valves 8 and 8' and valve stoppers 9 and 9' are arranged, and are connected to the cylinder blocks 3 and 4 by means of circumferentially spaced five bolts 13. A shaft seal assembly 15 is arranged in the front housing 10 so that its inner edge contacts the outer surface of the rotating shaft 1.

The embodiment of FIG. 19 features axially spaced control pressure chambers Vc and Vc' formed on the outer sides of the front and rear rotary valves 16 and 17, and the shaft 1 forms an axial opening 1—1 therethrough and radial openings 1-2 and 1-2' for defining a control pressure passageway Pc for connecting the control pressure chambers Vc and Vc' with a control port P2 of the control valve 50.

As shown in FIGS. 21 to 23, the rotary valves 16 and 17 are, at front and rear ends, connected to the shaft 1 by means of keys 100 and 100', which are fixed to the shaft 1, on one hand, and are fitted to key grooves 106 on the rotary valves, on the other hand, so that the rotation of the shaft 1 is transmitted to the rotary valves 16 and 17, while the latter are axially slidable on the shaft 1. Axially spaced coil springs 101 and 101' are arranged between the rotary valves 16 and 17 and shoulders 102 formed on the shaft 1, so that the rotary valves 16 and 17 are augured axially outward. Namely, in FIG. 19, the front rotary valve 16 is urged in the left handed direction by the spring 101, while the rear rotary valve 17 is urged in the right handed direction by the spring 101'. Circlips 104 and 104' are fixedly mounted on the shaft 1, while shoulders 103 are formed on the shaft 1. The axial movement of the rotary valves are, therefore, allowed between a position where the rotary valves 16 and 17 contact the respective circlips 104 and a position where the rotary valves 16 and 17 contact the respective shoulders 103.

The rotary valve 16 has, as shown in FIG. 22, a sleeve shape defining thereon recess 16-5 for creating an intake passageway Pr of a triangle shape when developed. A plurality of circumferentially spaced openings 105 are formed in the rotary valve 16 so that each of the openings 105 is, at one end, opened to the rear end surface of the rotary valve 16 and is, at the front end, opened to the recess 16-5, which allows the intake passageway Pr to be opened to the intake pressure chamber Vs, so that the intake passageway Pr is subject to the intake pressure. Similarly, the rotary valve 17 has, as shown in FIG. 23, a sleeve shape defining thereon recess 17-5 for creating intake passageway Pr' having a triangle shape when developed. A plurality of circumferentially spaced openings 105-1 are formed in the rotary valve 17 so that each of the openings 105-1 is, at one end, opened to the front end surface of the rotary valve 17 and is, at the rear end, opened to the recess 17-5, which allows the intake passageway Pr' to be opened to the intake pressure chamber Vs, so that the intake passageway Pr' is subject to the intake pressure. The rotary valves 16 and 17 are connected to the shaft 1 such that, when the piston 5 is in its dead center position, i.e., the piston approaches the valve plate 7 or 7', the axial edge portion 16-2 or 17-2 of the recess is opened to the corresponding cut groove Pa or Pa'. Thus, the front rotary valve 16 and rear rotary valves 17 are positioned on the shaft 1 so that an angle of 180 degree difference is obtained between the angular positions of the front and rear rotary valves 16 and 17.

The cylinder blocks 3 and 4 form axially spaced valve bores Sv and Sv', in which the rotary valves 16 and 17, respectively, are slidably and rotatably stored while maintaining a small clearance. The communication grooves Pa and Pa' extend in a direction inclined with respect to the axis of the shaft 1 so as to be opened to the corresponding cylinder bores 3-1 and 4-1 and, the intake passageway Pr or Pr' for a piston chamber Sp or Sp' communicates with a cut grove Pr or Pr' on the rotary valve 16 or 17 for a rotating angle. Namely, such communication of the intake passageways Pr and Pr' occurs successively with respect to the circumferentially spaced piston cylinders Sp and Sp', respectively, upon one complete rotation of the rotary valves 16 and 17 as shown by an arrow in FIG. 20 in the cylinder bores Sv and Sv', respectively.

As shown in FIG. 19, the control valve 50 is arranged in the rear casing 11, and is fixedly connected thereto by means of a circlip 107. The control valve 50 is, as shown by FIG. 24, constructed as a three port valve having ports P1, P2 and P3, which are opened to the intake pressure chamber Vc, the outlet pressure chamber Vd and the control pressure chamber Vc, respectively. The control valve 50 includes a housing 108 defining a conical shaped first valve seat 109, a cap 110, a ball shaped valve 113 arranged between the first and second valve seats 109 and 111, and a coil spring 112 urging the ball valve 112 so that the ball valve 112 is seated on the first valve seat 109 to control communication between the control pressure port P3, the intake pressure port P1, and the outlet pressure port P2. The control valve 50 is further provided with a diaphragm 114 that is arranged between the faced end surfaces of housings 108 and 115. Formed on one side of the diaphragm 114 is a first diaphragm chamber 115 that is opened to the intake pressure port P1, so that the chamber 115 is under the intake pressure. Formed on the opposite side of the diaphragm 1114 is a second chamber 116 opened to the atmosphere via an opening 117. As a result, displacement of the diaphragm 114 occurs in accordance with the difference between the force as generated by the pressure difference between the intake pressure at the first chamber 115 and the atmospheric pressure at the second chamber 116, and the force as generated by a spring 119 arranged in the second chamber 116. The control valve 50 is further provided with a rod 120, which displaces transmission of the diaphragm 114 to the ball valve 113 so as to lift it from the valve seat 109, so that the outlet pressure P2 at the outlet pressure port P2 is opened to the control pressure port P3. The upper end of the rod 120 is connected to the diaphragm by means of a pair of retainer plates 118 via a ball. The lower retainer plate is fixedly connected to the top end of the rod 120.

The operation of the embodiment in FIGS. 19 to 24 will now be explained. The rotation of the shaft 1 causes the swash plate connected to the shaft 1 to rotate, so that the pistons connected to the swash plate 2 via respective pairs of shoes are axially reciprocated in the respective cylinder bores Sv and Sv'. Simultaneously with the rotational movement of the shaft 1, the rotary valves 16 and 17 connected to the rotating shaft 1 by means of the keys 100 and 100' are rotated in the respective valve cylinders Sv and Sv'. Due to the fact that the variable intake passageways Pr and Pr' on the outer walls of the rotary valves 16 and 17 are always subject to the intake pressure so that the piston cylinders Sp, which are in communication with the intake passageway Pr and Pr' via the corresponding cut grooves Pa and Pa', respectively, are always subject to the intake pressure.

According to the embodiment in FIGS. 19 to 24, the variable intake passageway Pr and Pr' on the rotary valve 16 or 17, respectively communicates with an intake port Pa or Pa' of a corresponding piston chamber Sp or Sp' at a particular rotating angle from a position adjacent the top dead center to a position before bottom dead center, which varies in accordance with the position of the rotary valve 16 or 17, so that, at a particular rotating angle, an intake of refrigerant gas to a piston chamber Sp or Sp' occurs. A rotation of the rotary valve 16 or 17 to a position out of a particular range causes the variable intake passageway Pr or Pr' to be disconnected from the corresponding cut groove Pa or Pa', which causes the corresponding piston chamber Sp or Sp' to be disconnected from the intake pressure chamber Vs. As a result, at the point where the variable intake passageway Pr or Pr' of the rotary cylinder 16 or 17 is disconnected from the cut groove Pa or Pa', an amount of refrigerant gas confined in the corresponding piston chamber Sp or Sp' corresponds to the capacity of the compressor at that instant.

In FIG. 19, by operating the control valve 50, the rotary valve 16 is at its most left side (outward) position, while the rotary valve 17 is at its most right side (outward) position. Under these conditions, as shown in FIG. 20, the variable intake passageway Pr of Pr' of the rotary valve 16 or 17 is in communication with the corresponding piston chamber Sp or Sp' for the widest rotating angle of 180 degrees from top dead center, as shown in FIG. 20, so that a maximum amount of refrigerant gas is admitted into the corresponding piston chamber Sp or Sp'. In contrast, when the rotary valve 16 is moved to its most right side (inward) position in FIG. 25 from the position in FIG. 19, while the rotary valve 17 is moved to its most left side (inward) position in FIG. 25 from the position in FIG. 19, the variable intake passageway Pr of Pr' of the rotary valve 16 or 17 is in communication with the corresponding piston chamber Sp or Sp' for the narrowest rotating angle of 25 degrees from top dead center as shown in FIG. 26, so that a minimum amount of refrigerant gas is admitted into the corresponding piston chamber Sp or Sp'. In short, as a result of the axial movement of the rotary valves 16 and 17, the rotating range provides communication between the respective piston chambers Sp or Sp'. In short, as a result of the axial movement of the rotary valves 16 and 17, the rotating range provides communication between the respective piston chambers Sp and Sp' and the intake pressure chamber varies, so that the outlet capacity continuously changes between the maximum valve and the minimum valve corresponding to about 25% capacity of the maximum capacity.

As explained above, according to the swash plate type compressor in the embodiment in FIGS. 19 to 26, by the axial movement of the rotary valves 16 and 17 on the shaft 1, the angular range at which the triangular intake passageway Pr or Pr' on the rotary valve 16 or 17 varies, so that the volume of the refrigerating gas introduced into the corresponding piston chamber Sp or Sp' continuously varies. FIG. 26 shows the minimum capacity.

Furthermore, the change in the control pressure in the control chambers Vc and Vc' causes the axial positions of the rotary valves 16 and 17 on the shaft 1 to vary. The control chambers Vc and Vc' are delimited by the rotary valve 16 and 17, the cylinder blocks 3 and 4, and the front and the rear casings 10 and 11, and are disconnected from the intake pressure chamber Vs and the outlet chambers Vd and Vd'. In addition, the front and rear control chambers Vc and Vc' are connected to each other by means of the control pressure communication passageway Pc in the shaft 1, so that the pressure in the control chambers Vc and Vc' is equalized. A force due to the control pressure is applied to the sides of the control valves 16 and 17 adjacent to the control pressure chambers Vc and Vc', respectively, while a force due to the intake pressure Ps and a force due to the springs 101 are applied to the other sides of the control valves 16 and 17. As a result, when the control pressure in the control chambers Vc and Vc' is within a suitable range, the rotary valves 16 and 17 move to positions where forces applied to the opposite ends of the rotary valves are balanced, so that control of the control pressure can continuously control the capacity of the compressor. The control pressure in the control chambers Vc and Vc' is obtained by the control valve 50 as shown in FIG. 24.

As in the first embodiment where the combination of the push rod 18 and the guide pin 19 as shown in FIG. 5 is used to obtain a unified movement of the first and second rotary valves 16 and 17, the unified movement of the first and second rotary valves 16 and 17 in the embodiment in FIG. 19 to 26 is obtained by the provision of the communication passageway Pc formed in the shaft 1. Thus, the latter embodiment is advantageous in that a reduction in the number of parts and a reduction in cost is obtained, and the compressor is easily assembled.

According to the embodiment in FIGS. 19 to 26, it is shown that the rotary valves 16 and 17 are provided with a recess for defining the variable intake passageways Pr and Pr' in communication with the intake pressure chamber Vs via the communication openings 105 as shown in FIGS. 22 and 23. In place of this construction in FIGS. 22 and 23, a construction of the intake passageways Pr and Pr' on the rotary valves 16 and 17, respectively, as shown in FIGS. 2A and 2B may be provided for obtaining communication between the intake pressure chamber Vs and the recess for forming the variable intake passageways Pr and Pr'.

FIG. 27 shows a seventh embodiment, which is a modification of the 6th embodiment in FIG. 19, in that springs 101 and 101' having a different spring coefficient are provided for generating forces urging the rotary valves 16 and 16, respectively, in directions opposing the forces exerted by the control pressure in the control chambers Vc and Vc', respectively. Namely, the spring coefficient of the spring 101 on the left-hand side of FIG. 27 is larger than that of the spring 101' on the right-hand side. Thus, the increase in control pressure Pc, first, causes the rotary valve 17 on the right hand side to move against the spring 101'. After the control pressure Pc increases to a level for obtaining a desired stroke of the rotary valve 1, the force exerted by the control pressure Pc exceeds the set force exerted by the spring 101, thereby causing the rotary valve 16 to move against the force of the spring 101. In comparison with the 6th embodiment in FIG. 19, where the rotary valves 16 and 17 are fitted to the corresponding valve cylinder bores Sv and Sv' as closely as possible in order to prevent a leak between the control pressure chambers Vc and Vc' and the intake pressure chamber Vs, the 7th embodiment employs annular seal members 122, 122', 123 and 123' arranged on an annular recess formed on the outer cylindrical walls of the rotary valves 16 and 17 in such a manner that the seal members 122, 122', 123 and 123' arranged on an annular recess formed on the outer cylindrical walls of the rotary valves 16 and 17 in such a manner that the seal members 122 and 123 make contact with the facing inner cylindrical walls of the cylinder bores Sv and Sv' for obtaining a desired seal effect, without maintaining a strict clearance between the rotary valves 16 and 17 and the rotary valve cylinder bores.

According to the 7th embodiment in FIG. 27, a varying operation of the compressor capacity is obtained by the right hand (rear) side rotary valve 17 in a range (large capacity range) between 100 to 60% of the full capacity, and by the left hand (front) side rotary valve 16 in a range (small capacity range) between 60 to 20% of the full capacity. As a result, a more precise control of the compressor capacity is obtained by the compressor in this 7th embodiment.

FIG. 28 shows an 8th embodiment, which is a modification of the 6th embodiment. Namely, in comparison with the 6th embodiment in FIG. 19, the control pressure chambers Vc and Vc' are located axially outward with respect to the corresponding rotary valves 16 and 17; the 7th embodiment provides a construction wherein a control pressure chamber Vc is formed between the cylinder blocks 3 and 4, to which the control pressure port P3 connected to the control valve 50 is opened. In FIG. 28, the intake pressure chamber is not shown, but is formed by the cylinder blocks 3 and 4, the casings 10 and 11, and the rotary valves 16 and 17. The control pressure chamber Vc is located axially inward of the corresponding rotary valves 16 and 17. As a result, the arrangement of the variable intake passageways Pr and Pr' is opposite from those as shown in FIGS. 2A and 2B or FIGS. 22 and 23. Furthermore, the springs 101 and 101' are arranged outwardly from the respective rotary valves 16 and 17, and collars 124 and 124' are fixedly connected to the shaft 1, on which the respective springs 101 and 101' are placed. The detailed construction of the control valve 50 is not shown in FIG. 28, but operates in a similar manner as that in the previous embodiments. Namely, an intake pressure port P1, a control pressure port P2, and an outlet pressure port P3 are provided in a similar way as that shown in FIG. 6, so as to obtain the designated function of the control valve 50. This embodiment operates in a similar manner as that of the 6th embodiment in FIGS. 19 to 26. The embodiment in FIG. 28 is combined with the 7th embodiment in FIG. 27. The seal members 122, 122', 123 and 123' may be provided on the rotary valves 16 and 17 for obtaining the sealing function.

In the above embodiments, the compressor is provided with double headed pistons 5 defining piston chambers Sp and Sp' on their opposite sides, and the volume of the piston chambers Sp and Sp' varies. However, a means such as an orifice is provided so that the volume of the piston chambers on one side, for example, the rear side piston chambers Sp' varies, first, and, then the volume of the piston chambers on the other side, for example, the front side piston chambers Sp varies.

FIG. 29 shows the 9th embodiment, which is a modification of the embodiment in FIG. 28. Namely, in place of the control valve operated by fluid pressure, an electro-magnetic valve 125 as a control valve is provided. Namely, the control valve 125 is provided with a valve device 125-1 similar to that shown in FIG. 24, and an electromagnetic actuator 125-2. The actuator 125-2 is connected to a control circuit such a microcomputer system to obtain a desired control of the capacity of the compressor. Namely, similar to the first embodiment in FIG. 6, an intake pressure port $P_1$, a control pressure port $P_2$ and outlet pressure port $P_3$ are provided so that communication of the control pressure port $P_2$ with respect to the intake pressure port $P_1$ and the outlet pressure port $P_3$ is controlled by a ball valve 126 operated by the actuator 125-2 so that a target pressure is obtained.

It should be noted that the valve cylinder bores Sv and Sv', at inner cylindrical sliding surfaces, face the rotary valves 16 and 17, and have coatings for obtaining a desired sliding movement of the rotary valves 16 and 17.

FIGS. 30 to 33 show a 10th embodiment of the present invention. The compressor includes cylinder blocks 3 and 4, and front and rear casings 10 and 11, which are connected to each other by means of bolts 12. The cylinder blocks 3 and 4 form equiangularly spaced five pairs of cylinder bores 3-1 and 4-1 in which double headed pistons 5 are axially and slidably inserted, so that piston chambers Sp and Sp' are formed on the side of the pistons 5 facing the front and rear housings 10 and 11, respectively. Annular delivery chambers Vd and Vd' are formed inwardly of the front and rear casings 10 and 11, respectively, so that they are connected to a refrigerating line for an air conditioning system for a vehicle, in particular, a condenser. Valve seats 7 and 7' are arranged between the facing surfaces of the cylinder block 3 and the casing 10, and the cylinder block 4 and the casing 11, respectively. The valve seat 7 and 7' forms delivery ports 7-1 and 7'-1 opened to the respective cylinder changers Sp and Sp', respectively, which are opened or closed by respective valve plates 8 and 8', and backed by valve stoppers 9 and 9', respectively.

A rotating shaft 1, which is connected to the crankshaft of an internal combustion engine (not shown), is supported by radial bearings 13 and 13', and a swash plate 2 is connected to the rotating shaft 1 via thrust bearings 14 and 14'. The swash plate 2 is connected to the pistons 5 by means of shoes 6. An intake pressure chamber Vs is formed in the space for storing the swash plate 2.

As shown in FIG. 30, the shaft 1 is integral with a large diameter portion, at a location adjacent to and inwardly of the bearing 13. A valve cylinder bore Sv is formed in the cylinder block 3, in which the large diameter portion 1-3 is axially and slidably inserted with a limited clearance. As will be explained later, according to this 10th embodiment, the large diameter portion 1-3 is integral to the shaft 1 and operates as a fixed front rotary valve. Namely, the cylinder block 3 forms circumferentially spaced intake ports Pa which are, at their outer ends, opened to the respective cylinder bores 3-1, and are, at their inner end opened to the inner cylindrical wall of the valve bore Sv. The large diameter portion 1-3 forms a groove having a fan shaped groove 36 for forming a fixed intake passageway, which is formed along the circumference for an angle of about 130 degrees. The shaft 1 forms an intake passageway 1-4, and the fixed intake passageway Pr is opened to the passageway 1-4 at its front end. As shown in FIG. 30, the rotating shaft 1 and a boss portion of the swash plate 2 forms a radial intake passageway 1-5, which is for connecting the other end of the passageway 1-4 with the intake pressure chamber Vs. In the embodiment as shown, the radial passageways 1-5 are recesses opened laterally at the boss portion of the swash plate 2. These intake ports Pa are closed by respective pistons 5 when the piston 5 moves to the top dead center position (left most position), so that the piston chamber Pv is disconnected from the groove 36, but is opened to the ports Pa when the piston 5 changes its direction of movement toward the bottom dead center position.

As shown in FIG. 30, the cylinder block 4 forms a rear valve cylinder Sv', in which a rear rotary valve 17 is axially and slidably stored with a small clearance. The space inside the rotary valve 17 is in communication with a cylindrical bore at the right hand (rear) end of the rotating shaft 1, so that an additional intake pressure chamber 39 is created. The rotary valve 17 is constructed as shown in FIG. 32, and is inserted into the valve cylinder Sv' from its right hand side, so that it is axially slidable while rotating together with the rotating shaft 1. In order to obtain such a connection of the rotary valve 17 with the rotating shaft 1, the rotating shaft 1 forms, at its tubular rear end portion, diametrically opposite slits 42 that extend axially up to the free end of the shaft 1. A stopper member 44 is arranged inside the tubular portion of the shaft 1. The stopper member 44 is provided with diametrically opposite guide pins 43 that extend radially outward, so that the guide pins 43 are passed through the slits 42. The rotary valve 17 is formed with diametrically opposite grooves 45, to which the outer ends of the guide pins 43 are engaged. As a result of this construction, the rotational movement of the shaft 1 is transmitted to the rotary valve 17 via the guide pins 43 engaging the slits 42 of the shaft 1 and groove 45 of the rotary valve 17. Note: the stopper member 44 forms therein with axial openings 46 therethrough, which allows the refrigerant gas to freely pass.

As shown in FIGS. 30 and 31, the rear cylinder block 4 forms equiangularily spaced intake ports Pa' that are, at their outer ends, opened to the respective rear cylinder bores 4-1, and are, at their inner ends, opened to the rear valve bore Sv'. These intake ports Pa' are closed by the respective pistons 5 when the piston 5 is moved to its top dead center position (right most position), so that the piston chamber Pv' is disconnected from the respective intake passageway Pa', but is opened to the ports Pa' when the piston 5 changes its direction of movement toward the bottom dead center position.

As shown in FIG. 32, the rear rotary valve 17 for an intake port Pr', which is constructed by a first portion of a wider axial length of $L_1$, and a second portion of a narrower axial length of $L_2$ of an angular extension of an angle $O_2$ from top dead center of the corresponding piston 5. The introduction of the refrigerant gas from the intake pressure chamber Vs to the corresponding piston chamber Sp' occurs for a period where the intake passageway Pr' is opened to the intake port Pa. When the rotary cylinder 17 is in an axial position (left handed position in FIG. 30) where the intake port Pa is connected to both the wider and narrower length portions, such a connection occurs for a larger angle of $O_1$ from top dead center (O=0°) of the corresponding piston 5, so that a large capacity of the compressor capacity is obtained. When the rotary cylinder 17 is in an axial position (right handed position in FIG. 30) where the intake port Pa' is connected only to the wider length portions, such a connection occurs for a larger angle of $O_2$ from top dead center (O=0°) of the corresponding piston 5, so that a small compressor capacity is obtained. Thus, continuous control of the refrigerant introduced into the piston chambers Sp' for compression is obtained in accordance with the position of the rotary valve 17. An edge of the recess for forming the intake port Pr, if inclined as explained with reference to FIGS. 2B and 3B for the first embodiment, can provide a continuously varied capacity.

In the embodiment of the rear rotary valve 17 shown in FIG. 32, the portion of the intake passageway Pr' having a larger rotating angle $O_1$ and the portion of the intake passageway Pr' having a smaller rotating angle $O_2$ start at the same point in one complete rotation of the rotary valve 17. When a large capacity is required in the air conditioning system, the rotary valve 17 is moved to the position where the intake port Pr' is opened to the portion of the intake passageway Pr' having a larger rotating angle $O_1$. When a small capacity is required in the air conditioning system, the rotary valve 17 is moved to a position where the intake port Pr' is opened to the portion of the intake passageway Pr' having a smaller rotating angle $O_2$. FIG. 33 is similar to FIG. 9A for the first embodiment, which illustrates a relationship between the rotating angle and the volume of the piston chamber or stroke of the piston. Under full capacity conditions, an intake stroke occurs in a range between top dead center and an angle position of $O_2$.

In order to obtain a desired axial position of the rear rotary valve 17 on the shaft 1, a control piston 49 is provided, which is axially and slidably inserted in an axially and inwardly opened cylinder bore 11-2 formed in the rear casing 11 via an annular seal 201. A control pressure chamber Vc is formed on one side of the control piston 49 remote from the rotary valve 17. A control valve 50 having a similar construction as explained with reference to the first embodiment in FIG. 1 is provided for controlling pressure in the control pressure chamber Vc, so that the control pressure varies in accordance with the intake pressure Ps and the outlet pressure Pd in a similar way as explained with reference to the first embodiment. A spring 200 is provided for urging the stopper member 44 and the rotary valve 17 in the right hand (rearward) direction in FIG. 30, while a spring 202 is arranged in the control pressure chamber Vc for urging the rotary valve 17 in the left hand direction. As a result, the axial position on the shaft 1 is obtained in such a manner that a balanced condition is obtained between the spring force exerted by the springs 200 and 202 and the fluid force exerted by the control pressure in the control pressure chamber Vc and the intake pressure in the intake pressure chamber Vs, as explained with reference to the previous embodiment.l Namely, by changing the control pressure by the control valve 50, a desired axial position of the rotary valve 17 and a desired compression capacity is obtained.

Similar to the previous embodiment, capacity control by the control valve 50 can be carried out automatically in accordance with the refrigerant pressure in the refrigerating cycle as explained with reference to FIG. 6 for the first embodiment. It is also preferable that capacity control be effected manually by the driver or a passenger.

A thrust bearing 204 is arranged between the control piston 49 and the rotary valve 17 for preventing the control piston 49 from rotating even if the rotary valve 17 is rotating.

According to the 10th embodiment, although there is a continuously varying volume of refrigerant gas introduced into the rear side piston chambers Sp' by means of the rear rotary valve 17, which is similar to the previous embodiments, the amount of refrigerant gas is introduced into the front side piston chambers Sp in an "ON-OFF" manner. Namely, a puppet valve 210 is provided for moving between a closed position where the intake passageway 1-4 at the enlarged diameter portion 1-3 is closed, and an opened position where the intake passageway 1-4 is opened. The puppet valve 210, which extends axially, is passed through a bore at the center of the stopper 44 in an axially slidable manner, and is projected out of the stopper 44 to form a radially projected engaging portion 212 at its free end. A spring 214 having a relatively weak spring coefficient is arranged between the puppet valve 210 and the stopper member 44 for urging the puppet valve 210 to seat on the outer edge of the intake passageway 1-4. FIG. 30 shows a condition where the rotary valve 17 together with the control piston 49 is in its leftmost position so that the intake passageway Pr' communicates with the piston chamber Pv' at an angle $O_2$ so that compression capacity at the rear side (right hand side) of the piston cylinders Sp' is minimized. The puppet valve 210 is closed so as to shut off the intake passageway 1-4, so that the introduction of the refrigerant gas to the left hand piston chambers Sp is stopped. Namely, the capacity of refrigerant from the left side piston chambers Sp is zero.

The movement of the rotary valve 210 in the right hand direction by the control valve 50 to a position where the variable intake passageway Pr' engages the intake port Pa' at an angle $O_1$ and maximizes the capacity of the right handed piston chambers Sp'. In this case, the stopper member 44, which moves axially together with the rotary valve 17, is still detached from the engaging portion 212 of the puppet valve 210, so that the puppet valve 210 is still maintained at its closed position. Following this a further axial movement of rotary valve 17 caused by the movement of the control piston 49 finally causes the stopper member 44 to engage with the engaging portion 212, which detaches the puppet valve 210 from the valve seat, and so that the intake passageway 1-4 is connected to the intake pressure chamber Vs. As a result, the supply of refrigerant gas to the left side piston chamber Sp is commenced. In this case, a step like increase in the output capacity of the refrigerant gas is obtained. From the viewpoint of an idealized compressor operation, a continuously changing capacity from the minimum valve to the maximum valve via a medium value is desirable, however, a continuous change in the outlet volume from the middle value to the maximum value is rarely required. Contrary to this, with such control as in the embodiment in FIG. 30 it is sufficient that the capacity continually change in a range between the minimum value to the medium value, and be controlled to the maximum level in a step like manner so as to obtain a "cool down" operation. Namely, a cool down operation is carried out until a target temperature is obtained, and after the target temperature is obtained, a change in the outer volume between the minimum value and the medium value is sufficient to obtain a desired precise control of the temperature. Therefore, the simplified ON-OFF capacity control at the front side piston chambers Sp by the puppet valve 210 is sufficient from an operational point of view and costs can be reduced.

In the 10th embodiment shown in FIG. 30, an increase in pressure at the control pressure chamber Vc reduces the outlet capacity. However, it will be possible to obtain a construction such that an increase in pressure at the chamber Vc increases the capacity. In order to do this, in FIG. 32, the axial position of the portion of the intake passageway of the larger angle and the portion of the intake passageway of the smaller angle are reversed.

FIGS. 34 to 36 show an 11th embodiment, which is a modification of the embodiment in FIG. 30, and therefore difference therefrom will be explained. In place of the provision of the enlarged diameter portion 1-3 of the shaft 1 constructed as an integral type rotary valve defining the fixed intake passageway Pr, a sleeve member 62, which is separate from the shaft 1, is provided so that the sleeve member 62 is fixedly connected to the shaft 1 by means of a fixing member 63. The sleeve member 62 is formed with a slit 62-1 as a fixed intake passageway Pr extending along a rotating angle for about 130 degrees. This construction is advantageous from the viewpoint of manufacturing, since the slit 62-1 can be easily machined on the sleeve 62 as a separate part.

In the embodiment shown in FIG. 34, an intake passageway 36 is formed obliquely in the shaft 1, which is opened to an axial bore 1-4 as an intake passageway formed in the shaft 1. A slide valve 66 is coaxially arranged in the axial bore 1-4. The slide valve 66 has an enlarged diameter end 66-1 having an outwardly opened cup shape, which functions as a spool valve for opening or closing the intake passageway 36 for obtaining a step like capacity control as also explained with reference to the embodiment shown in FIG. 30. A compression spring 67 is arranged in the cup shaped portion 66-1 for urging the slide valve 66 in the right hand direction in FIG. 34. The slide valve 66 has, at the other end opposite the cup shaped valve portion 66-1, a piston portion 66-2 that is axially and slidably inserted in a cylinder bore 17-1 of a rear rotary valve 17 so that a chamber Vx is formed. The rotary valve 17, which also functions in relation to the control piston 49 in the previous embodiment in FIG. 30, is axially and slidably inserted in a cylinder bore 11-2 formed in the housing 11, so that a control pressure chamber Vc is created on the rear side of the rotary valve 17. The rotary valve 17 forms an opening 17-2 for opening the control pressure in the control pressure chamber Vc to the chamber Vx, which causes the control pressure to also be applied to the slide valve 66.

When the pressure in the control chamber Vc as created by the control valve 50 is high, the rotary valve 17 moves in the left-hand direction in FIG. 34 against the force of the spring 250. Prior to or after this movement of the rotary valve 17, depending on the strength of the spring 67, due to the control pressure in the chamber Vx opened to the control pressure chamber Vc via the opening 17-2, the slide valve 66 is moved in the same direction so as to assume a position where the spool valve portion 66-1 opens the intake port 36, so that the intake pressure chamber Vs is opened to the intake passageway 36, which allows the refrigerant gas to be admitted into the piston chamber Pv via the corresponding intake port Pa.

A reduction of the control pressure in the control pressure chamber Vc due to the operation of the control valve 50 causes the rotary valve 17 to move in the right hand direction in FIG. 34 due to the return force of the spring 250. Prior to or after commencement of the movement of the rotary valve 17, the valve rod 66 movement in the right handed direction in FIG. 34 due to the return force of the spring 67 thereby, causing the spool valve portion 66-1 to close the intake port 36 and disconnecting it from the intake pressure chamber Vs. As a result, refrigerant gas is prevented from being introduced into the front side piston chambers Pv, which reduces the capacity of the compressor by 50%. In the case where the slide valve 66 meres first in the right hand direction as in FIG. 34, which is followed by movement of the rear rotary valve 17 in the same direction, by a relatively large spring coefficient value of the spring 67, the capacity of the front side piston chambers Pv is, first, made zero, and then, the rotary valve 17 is moved in the right hand direction, thereby continuously reducing the capacity of the right side piston chamber Pv' in accordance with the reduction of the control pressure in the control chamber Vc.

In the 11th embodiment in FIG. 34, the rear rotary valve 17 functions as a control piston. In order to axially move the rotary valve 17 while rotating together with the drive shaft 1, the tubular end portion of the rotating shaft 1 is formed with four axially extending outwardly opened equiangular spaced slits 254. An annulcer stopper 256 is arranged in the tubular end portion of the shaft 1, and the annular stopper 256 is, as shown in FIGS. 35 and 36, formed with four equiangular spaced radially extending four guide pins 258, that are axially and slidably inserted in the respective axial slits 254 formed in the tubular end portion of the shaft 1. The rear rotary valve 17 is formed with four equiangular spaced, axially inwardly opened recesses 260, in which the radially outward ends of the guide pins 258 are inserted, so that the rotational movement of the shaft 1 is transmitted to the rotary valve 17. The axial movement of the rotary valve 27 is allowed because the guide pins 258 are axially guided along the axial slits 254 on the tubular end of the rotating shaft 1. The compression spring 250, at its rear end, makes contact with the annular stopper 256, so that the rear rotary valve 17 is urged in the axially right hand direction. Similar to the 20th embodiment in FIG. 32, the rear rotary valve 17 is formed with a variable intake passageway Pr' that functions to control the introduction of a variable amount of refrigerant into the rear side piston chamber Sp' in accordance with the axial position of the rotary valve.

FIG. 37 shows a 12th embodiment, which features a rotary slide valve 300 provided to function as the puppet valve in the 10th embodiment or the slide valve in the 11th embodiment and the rotary valve. Namely, the rotary slide valve 300 has a slide valve portion 302 defining an intake passageway Pr' and a rotary valve portion 304 extending integrally from the slide valve portion. A rear casing 11 is formed with a boss portion 11-1 that is opened to the space inside the rotary slide valve 300, so that an intake pressure chamber Vs is formed inwardly of the rotary slide valve 300 and the boss portion 11-1, which is in communication with a refrigerant gas source (not shown). The drive shaft 1 has a tubular portion defining an inner annular partition wall portion 320, with which the slide valve portion 302 is axially slidable. The slide valve portion 302 has, at its portion near its closed end, diametrically opposite openings 312 opened to the control pressure chamber Vs inside the rotary slide valve 300. Arranged in an annular space between the shaft and the cylinder wall is a fixed rotary valve 316 having a fixed intake passageway Pr cooperating with the intake ports Pa of the respective piston chambers Pa upon completion of one rotation. The rotary slide valve 300 has a spline portion 305 that engages with a spline portion 1-8 at the inner surface of the tubular portion of the drive shaft 1, so that the rotary slide valve 300 rotates together with the drive shaft 1, while the rotary slide valve 300 is axially slidable with respect to the shaft 1. A spring 330 is provided for urging the rotary slide valve 300 so that it is moved in the right hand direction.

An annular piston 332 is provided in an annular cylinder bore 116 in the casing 11 so that an annular control pressure chamber Vc is formed. Inner and outer seal rings 332 and 342 are provided on the piston 332 for obtaining a desired sealing function. Similar to the previous embodiment, the control pressure chamber Vc is under a control pressure obtained by a control valve that is not shown but may have a similar construction as explained with reference to the former embodiments.

In the operation, the refrigerant gas is introduced into the intake pressure chamber, and when the pressure in the control pressure chamber Vc is low, the rotary slide valve 300 is in its right hand position, where the slide valve portion 302 is at a position to close the valve openings 312. As a result, the refrigerant gas is prevented from being introduced into the front (left handed) piston chambers Sp. In this case, the degree of opening of the intake passageway Pr' to the right hand (rear) piston chambers Sp' is controlled in accordance with the axial position of the rotary slide valve 300 so as to continuously vary the capacity of the compressor. Namely, the capacity is continuously changed up to ½ of the full capacity from the minimum capacity. An increase in pressure in the control chamber Vc causes the rotary slide valve to be situated so that the valve openings 312 are opened to be situated so that the valve openings 312 are opened to the intake pressure chamber Vs so that the refrigerant gas is also introduced into the left hand piston chambers Sp. As a result, a step like increase in the capacity of the compressor from half capacity to full capacity is obtained.

In the embodiment of FIGS. 30 to 37, the valves 210, 66 and 300 provide a two stage characteristic of the capacity of the compressor when moved inside the shaft. Contrary to this, in the 13th embodiment shown in FIGS. 38 to 46, a stationary inner valve 400 provides the two stage characteristic of the capacity of the compressor. In these figures, a detailed explanation regarding the parts having a similar function as are illustrated by the same reference in other embodiments is omitted, the explanation being focused to points which are different from the previous embodiments. In FIG. 38, the rear housing 11 is shown so that it has an inlet 11-3 of the fluid to be compressed and a passageway 11-4 for introducing the medium to the piston chambers Sp and Sp'. The rear rotary valve 17 has basically the same construction as that in FIGS. 30 and 32. But, as shown in FIG. 42, the rotary valve 17 has a front end of a reduced diameter on which are circumferentially spaced axially extending spline portions 404, which are engaged with corresponding grooves on the axial bore of the shaft 1, so that an axial slide movement of the rear rotary valve 17 in accordance with the pressure at the control pressure chamber Vc is allowed.

Furthermore, the 13th embodiment is similar to the 12th embodiment in FIG. 37 in that a fixed front rotary valve 316 and a slidable rear rotary valve 17 are provided. As shown in FIG. 41, the slid able rotary valve 17 is formed therein with a central bore 17*a*, in which an inner valve 400 is arranged. As shown in FIGS. 41 and 45, the inner valve 400 has a front disk portion 410 which rests on a shoulder portion 1-4" of the bore 1-4, and a rod portion 412 extending therefrom. The disk portion 410 forms openings 410-1 for the passage of the medium. A spring 414 is arranged between axially facing surfaces of the front disk portion 412 of the inner valve 400 and the rear rotary valve 17. The spring 414 generates a force whereby the disk portion 412 is always in contact with the shoulder portion 1-7 of the central bore of the shaft 1. Thus, the inner valve 400 is prevented from being moved axially with respect to the shaft. In other words, in this embodiment, the inner valve 400 is made axially stationary. The movable rotary valve 17 is further provided with a rear end (valve portion) 400*a* of an increased diameter, which is connected to the rod portion 412 and which is slidably inserted into the central bore 17*a* of the rear rotary valve 17. The rear end 400*a* together with the central bore 17*a* forms a spool valve 402 of variable orifice for controlling the introduction of the medium to be compressed into the front rotary valve 316. As shown in FIG. 44, the valve portion 400*a* forms, at a location adjacent to its stem portion, radially spaced grooves 400*b*, which extend partly on the valve portion 400*a* from front edge thereof. A large pressure at the control chamber Vc adjacent the piston 49 causes the rotary valve 17 to be moved against the force of the spring 414 until the rotary valve 17 is contacted with the end of the shaft. In this case, a relative position of the inner valve 400 with respect to the rear rotary valve 17 is as shown in FIG. 38 or 45 such that the grooves 400*b* connect an inlet passageway 11-4 with a intake passageway 1-4, which causes the medium to be compressed to be directed to the front piston chambers Sp, thereby obtaining 100 percent capacity of the compressor. When a pressure at the control chamber Sp is reduced, the spring 414 causes the rear rotary valve 17 to be moved toward the rear housing 11. As a result, the relative position of the rotary valve 17 with respect to the stationary inner valve 400 is such that the grooves 400*b* are closed. As a result, an introduction of the gas to be compressed into the intake passageway 1-4 is stopped, thereby obtaining 50 percent reduction of the compressor capacity.

During operation of the 13th embodiment, a control pressure at the control chamber Vc causes the control piston 49 to be axially moved against the force of the spring 414 until a position where the control pressure force at the chamber Vc and the force of the deformation of the spring 414 are balanced. Namely, when the maximum stroke of the rear rotary valve toward the front cylinder block 3 is obtained, the relative position of the intake passageway Pr' with respect to the cut groove Pa' is such that the former communicates with the latter for an increased angle Θ 1 as explained with reference to FIG. 32 for the 12th embodiment, so that a maximum amount of the fluid to the rear piston chambers Sp' are obtained. In addition, the medium is fully introduced via the grooves 400*b* into the intake passageway 1-4 as shown in FIG. 38, which allows the compression at the front piston chambers Sp to be carried out. As a result, 100 percent capacity of the compressor is obtained.

A small reduction of the pressure at the control chamber Vc causes the rotary valve 15 to be moved in the right-handed direction to the position as shown in FIG. 41, so that the grooves 400*b* are fully closed by the inner periphery of the bore 17*a* of the rotary valve 17. As a result, an introduction of the medium into the intake passageway 1-4 is stopped, so that a capacity of the front side (front piston chambers Sp) of the compressor is nullified. At this 0% capacity condition of the front side of the compressor, the arrangement of the intake port Pr' with respect to the cut groove Pa' can be such that the communication occurs via the portion of an increased circumferential length of an angle of Θ 1 in FIG. 42. Thus, a 100% capacity is obtained at the rear side (rear piston chambers Sp') of the compressor. Thus, a total compressor capacity between front and rear parts becomes 50%.

A further reduction of the pressure at the control chamber Vc causes the cut groove Pa' to be connected to the intake port Pr' at its portion of a reduced angle of Θ 2 as shown in FIG. 42. As a result, an amount of the medium into the rear side piston chambers Sp' is reduced, thereby causing the capacity to be reduced, for example, to 25%.

FIG. 46 illustrates in the 13th embodiment a relationship between a length of the axial slide movement of the rear rotary valve 17 to the capacity of the compressor. In this case, the inner valve 400 constructs the spool valve which is not merely an ON-OFF type valve but rather a type valve capable of obtaining a continuously varied degree of the throttle. As a result, a continuous change in the capacity is obtained. Namely, a dotted line Fr illustrates a change in the capacity at the front side compressor (piston chamber Sp), which is a downwardly inclined line. A dotted line Rr illustrates a change in the capacity at the rear side of the compressor (piston chambers Sp'), which is a combination of a horizontal line and a downwardly inclined line. Thus, the total characteristic of the capacity as shown by a solid curve is obtained.

FIG. 47 is similar to FIG. 38 but illustrates a 14th embodiment. The 14th embodiment in FIG. 47 is different from the 13th embodiment only in that, in place of the radial bearings 13 and 13', slide type journals 500 and 502 are respectively used, and the slide type journals 500 and 502 function as rotary valves for obtaining a sequential supply of the medium to the piston chambers Sp and Sp' during a single rotating movement thereof.

The central bore Sv and Sv' of the cylinder blocks has a diameter which is larger than an outer diameter of the shaft 1 for a value in a range between 2 to 4 mm, so that annular spaces are created between the bore Sv and Sv' and the shaft 1. The slide journals 500 and 502 formed as a thin walled sleeve member are press fitted to the annular spaces. The shaft 1 is formed with a pair of axially spaced apart tubular outer surfaces 1-10 and 1-11, which slidingly engage with the corresponding sleeve members 500 and 502 during the rotation of the shaft 1. Namely, the sleeve members 500 and 502 and the tubular surfaces 1-10 and 1-11 cooperate with each other to construct respective slide journal units. The slide journal members 500 and 502 are formed from a sleeve member made of a basic material such as a metal coated with a fluorine resin. The sleeve members are press fitted to the bores Sv and Sv', respectively, and are subjected to a precise machining to obtain a desired inner diameter which is close to the outer diameter of the cylindrical journal portions 1-10 and 1-11.

Furthermore, the sleeve 500 is formed with an opening 500-2 which functions as an intake port Pr and which is opened to the groove 36 on the shaft 1.

The construction at the rear side is similar to that of the front side. Namely, the rear slide valve 17 has an outer cylindrical surface which is an extension of the outer cylindrical surface 1-11. The rear side slide sleeve 502 has an inner cylindrical surface, with a very small clearance is maintained between the outer and inner cylindrical surfaces. The sleeve 502 is formed with an opening 502-2 which also functions as an intake port Pr' and which is opened to a groove 508 formed in the large diameter portion of the rear rotary valve 17.

In the 14th embodiment, the bearing of the rotating shaft 1 is constructed by the slide type journals 500 and 502, which, also, function as the intake valves for obtaining a sequential connection of the medium to the circumferentially spaced piston chambers Sp and Sp', respectively. Thus, a highly simplified construction is obtained, with reduced clearances between the parts effecting the sliding movement, thereby reducing leakage of the medium to be compressed. Furthermore, due to the simplified construction of the sleeves 500 and 502 merely fitted to the cylindrical bores Sv and Sv', on one hand, and the machining of the journals 500 and 502 as well as the cylinder bores Sv and Sv' which are carried out simultaneously on the other hand, a high accuracy of the machining can be very easily obtained, thereby providing a highly reduced clearances between the inner surface of the bores Sv and Sv' and the outer surface of the journals 500 and 502. Furthermore, the provision of the openings 500-2 and 502-2 function as the intake ports Pr and Pr' and eliminate separate parts for constructing the rotary valves 16 and 17, as well as fixing means, which effectively simplifies construction and reduces the cost.

In the 13th and 14th embodiments, the capacity control means are merely constructed by the slide rotary valve 17, the control piston for obtaining its axial movement, the coil spring 414 for generating a set force opposite to the control pressure, and the inner valve 400 which is stationary. Thus, it is advantageous that an intake control to the front and rear piston chambers Sp and Sp' can be obtained by a mere axial movement of the rear rotary valve 17. Thus, a relatively small axial force is sufficient to obtain a desired axial movement, thereby reducing the size of the control chamber Vc, as well as the size of the variable capacity mechanism itself.

The slide rotary valve 17 and the control piston 49 can be made from a light weight metal material such as an aluminum coated with fluorine resin. Otherwise, they are made from material other than a metal such as synthetic resin such as a or polyamide which allows an easy sliding moment and which can be machined easily. The control piston 49 may desirably be provided with a seal means such as an O-ring.

The inner valve 400 of relatively low cost is made of a shaft portion 412 which is made of metal material or synthetic resin such as a polyamide or and is integral to the valve member portion 400*a*, while the disk portion 410 is separated from the shaft portion 412 and is fixedly connected thereto by crimping. The inner valve 400 is, after introduction into the inner bore 17*a* of the slide rotary valve, prevented from being withdrawn. Thus, a high precision of an axial alignment as well as parallel relationship are not required between the bore 17*a* and the valve member portion 400*a*. Furthermore, a high precision of a right angle is not required between the shaft portion 412 and the disk portion 410. Due to the use of the parts which are low cost, as a well as small number of such parts, reduces the total cost of the production of the compressor of the present invention.

The present invention is also related to a selection of materials constructing the rotary valve 16 and 17, which can reduce the leakage of the medium, while maintaining a small resistance. Namely, FIG. 48 shows a 15th embodiment, which has a construction which is the same as that shown in FIG. 38, except that no provision is made as to the inner valve 400. The 15th embodiment features that the rotary valves 16 and 17 are made of a material which has a thermal expansion factor which is larger than that of a material for constructing the rotary valves 16 and 17. Namely, the rotary valves 16 and 17 are made of a polyamide-imide resin having a thermal expansion factor of a value in a range between 23 to $26\times10^{-6}$ mm/mm/° C., which is slightly larger than the value of the thermal expansion factor of a aluminum based alloy for constructing the cylinder blocks 3 and 4.

During the operation of the compressor, the temperature of the valve cylinders Sv and Sv' in which the rotary valves 16 and 17 are respectively located is increased to a temperature around 120° C. (see FIG. 50) due to the fact that these parts are subjected to a high temperature of the compressed medium at the piston chambers Sp and Sp'. The rotary valves 16 and 17 are, also, subjected to a temperature increase due to the fact that the valves 16 and 17 contact with the respective cylinders Sp and Sp'. However the rotary valves 16 and 17 are subjected to a cooling by low temperature of the medium passing thorough the rotary valves 16 and 17. Thus, the temperature of the rotary valves 16 and 17 is smaller than that of the cylinders Sp and Sp', and is about 100° C. Due to the temperature difference between the cylinders Sp and Sp' and the rotary valves 16 and 17, the thermal expansion of the cylinders Sp and Sp' is larger than that of the rotary valves 16 and 17, which causes the clearance between these parts to be increased, thereby causing the medium to leak from the high pressure side (piston chambers Sp and Sp') to the low pressure side (the passageway 1-4), thereby reducing the performance of the compressor.

FIG. 50 shows a result of tests conducted by the inventors when the rotary valves 16 and 17 have a nominal outer diameter of 36 mm under a normal temperature condition of 20° C., and the minimum clearance as required is 15 μm. Namely, a curve A shows a characteristic of a thermal expansion of the rotary valves 16 and 17 when an actual inner diameter of 36.015 mm made of an aluminum based alloy is 36.015 mm. In the 15th embodiment as shown in FIG. 48, the rotary valves 16 and 17 are made of the polyamide-imide resin of a thermal expansion coefficient of value in a range between 23 to $26\times10^{-6}$ mm/mm/° C. which is larger than that of the aluminum based alloy. Thus, the value of the inner diameter of the rotary valves 16 and 17 made of the resin material according to the present invention is in a range shown by shaded lines between straight lines U and L. Desirably, the thermal expansion characteristic of the rotary valve 16 and 17 in 15th embodiment is shown by a line B which is located in the shaded area.

In FIG. 50, the value of the thermal expansion factor corresponds to value of the gradient of the straight line. As explained above, during the operation of the compressor, the valve cylinders Sv and Sv' have a temperature of 120° C., which is shown by a point a on the straight line A in FIG. 50. The characteristic of the expansion of the rotary valve 16 and 17 made of the polyamide-imide resin is shown by the curve B. As explained above, the temperature of the rotary valves 16 and 17 during the operation of the compressor is 100° C., so that the rotary valves have a thermal expansion of value corresponding to a position b on the curve B. The straight line B for the resin material has a value of the gradient larger than that of the straight line A for the aluminum alloy material. Thus, the difference of dimension between positions a and b is only slightly larger than the minimum clearance Cmin, which is initially given as 15 μm. Thus, a leakage of medium to be compressed via the clearances between the rotary valves 16 and 17 and the valve cylinders Sv and Sv' is effectively prevented.

In FIG. 50, a permissible maximum clearance between the rotary valves 16 and 17 and the valve cylinders Sv and Sv' is shown by Cmax, which is nearly a value of 30 μm, which is obtained when both of the rotary valves 16 and 17 and the valve cylinders Sv and Sv' are made from the aluminum based alloy material. However, according to the present invention, it is essential that the material made of the rotary valves 16 and 17 and the material made of the valve cylinders Sv and Sv' are different, and the heat expansion factor of the rotary valves 16 and 17 is larger than that of the valve cylinders Sv and Sv'. Thus, the value of the clearance obtained when the same material is used, and a desired range of the clearance C=Cmax−Cmin is expressed by:

$$30\ \mu m > C \geqq 15\ \mu m$$

The minimum value of 15 μm is essential since an excessively large value of the thermal expansion of the material for constructing the rotary valves 16 and 17 causes the clearance to become excessively reduced due to the large thermal expansion of the rotary valves, thereby causing the latter to be locked.

FIG. 51 shows a 16th embodiment which is provided with the last feature of the present invention for preventing the leakage of oil due to the increase in the clearance between the rotary valves and the cylinders Sv and Sv'. From the view point of construction, the 16th embodiment is similar to 15th embodiment except that the former is provided with an inner valve 300 for controlling an introduction of the medium to be compressed into the front side piston chambers, which inner valve 300 is integral with the rear rotary valve 17 as is realized in the 12th embodiment shown in FIG. 37. Thus, a detailed explanation of the construction and operation as to the 16th embodiment shown in FIG. 51 is eliminated, while using the same reference numbers for indicative the same kind of functions.

In the 16th embodiment, which is similar to the 15th embodiment shown in FIGS. 48 to 50, when the cylinder blocks 3 and 4 are made of the aluminum based alloy, the rotary valves 16 and 17 are made from a material, such as a polyamide-imide resin having a value of the thermal expansion factor in a range between 23 to 26×10−6 mm/mm/° C., which is more or less larger than the value of the thermal expansion of the cylinder blocks 3 and 4, i.e., the valve cylinder Sv and Sv'. As a result, a clearance between the rotary valves 16 and 17 and the valve cylinder Sv and Sv' is maintained such that a leakage of the medium to be compressed is prevented. It should be noted this idea of the present invention can be applied to a swash plate compressor of a variable capacity type.

The idea of the 15th and 16th embodiments can also be applied to a compressor having piston chambers on only one side of the pistons as is realized in FIG. 18.

According to the 15th and 16th embodiments, the employment of the idea of the desired selection of the values of thermal expansion factors between the rotary valves and valve cylinders can use plastic material such as polyamide-imide resin for constructing the rotary valve or slide valve. Thus, a formation of a desired shape, such as a spline or spline groove, or valve port can be easily obtained, which are otherwise difficult in the case of metal material. Furthermore, a secondary treatment, such as a finishing is unnecessary. Furthermore, a covering of lubricant material such fluorine is also unnecessary due to a self-lubrication ability of the resin material. Thus, a reduction of the production cost can be expected.

While embodiments of the present invention are explained with reference to the attached drawings, many modifications and changes can be made by those skilled in this art without departing from the scope and spirit of the present invention.

We claim:

1. A variable capacity swash plate type compressor comprising:

a rotating shaft adapted for connection to a source of a rotating movement;

a cylinder block rotatably connected to said rotating shaft, said cylinder block forming a plurality of circumferentially spaced cylinder bores each extending parallel to an axis of said rotating shaft;

a plurality of double headed pistons axially and slidably stored in respective ones of said plurality of circumferentially spaced cylinder bores, each of said plurality of double headed pistons forming on sides thereof axially spaced first and second piston chambers;

a swash plate fixedly connected to said rotating shaft and connected to said plurality of double headed pistons to obtain an axial reciprocal movement of each of said plurality of double headed pistons upon rotation of said rotating shaft;

each of said first and second piston chambers having a volume which alternately increases and decreases upon said axial reciprocal movement of a corresponding one of said plurality of double headed pistons;

said cylinder block forming therein an intake pressure chamber that is connected to a source of a medium to be compressed, and forming therein axially spaced first and second outlet pressure chambers for removing said medium as compressed;

intake means for controlling an introduction of said medium from said intake pressure chamber to said first and second piston chambers; and discharge means for controlling a discharge of said medium from said first and second piston chambers to said first and second outlet pressure chambers;

said intake means comprising:

axially spaced first and second rotary valves, said first rotary valve being axially slidable with respect to said rotating shaft while rotating together with said rotating shaft, and said second rotary valve always being at a fixed position of said rotating shaft, and axial position control means for controlling an axial position of said first rotary valve on said rotating shaft;

said first and second rotary valves providing successive control of a communication between said intake pressure chamber and said first and second piston chambers, respectively, at a respective range of a rotating angle within one complete rotation of said first and second rotary valves, said rotating angle of said first rotary valve varying in accordance with said axial position of said first rotary valve as controlled by said axial position control means; and valve means, responsive to axial movement of said first rotary valve, for selectively controlling an introduction of said medium to said second piston chamber, so that a capacity of said compressor changes between a first mode wherein said medium to be compressed is only introduced to said first piston chamber, and a second mode wherein said medium to be compressed is introduced to said first and second piston chambers.

2. A compressor according to claim 1, wherein said valve means is movable together with said axial movement of said first rotary valve, and selectively controls said introduction of said medium to said second piston chamber.

3. A compressor according to claim 1, wherein said valve means is stationary with respect to said cylinder block, creating a relative axial movement between said valve means and said first rotary valve.

4. A compressor according to claim 3, wherein said valve means comprises:

a valve member having a valve portion which cooperates with said first rotary valve and a fixed portion in face to face contact with said rotating shaft, and fixed connecting means for fixedly connecting said fixed portion of said valve member with said rotating shaft while allowing said medium to be introduced to said second piston chamber.

5. A compressor according to claim 4, wherein said fixed connecting means comprises a spring arranged between said fixed portion of said valve member and said first rotary valve.

6. A compressor according to claim 3, wherein said valve means further comprises means for controlling an amount of said medium introduced to said second piston chamber in accordance with said relative axial movement between said valve means and said first rotary valve.

7. A compressor according to claim 1, further comprising a pair of axially spaced apart slide bearings having a sleeve shape to rotatably support said rotating shaft to said cylinder block, said pair of axially spaced apart slide bearings including respective openings for allowing said introduction of said medium to said first and second piston chambers, respectively.

8. A compressor according to claim 1, wherein said first and second rotary valves are made from materials having different coefficients of thermal expansion such that a first coefficient of thermal expansion of said first and second rotary valves is larger than a second coefficient of thermal expansion of respective valve cylinders so as to prevent, during a normal operation, an outer diameter of said first and second rotary valves from exceeding an inner diameter of said respective valve cylinders.

9. A variable capacity swash plate type compressor comprising:

a rotating shaft adapted for connection to a source of a rotating movement;

a cylinder block rotatably connected to said rotating shaft, said cylinder block forming a plurality of circumferentially spaced cylinder bores each extending parallel to an axis of said rotating shaft;

a plurality of pistons axially and slidably stored in the respective ones of said plurality of circumferentially spaced cylinder bores and forming a respective piston chamber on a respective side of each of said plurality of pistons;

a swash plate fixedly connected to said rotating shaft and connected to said plurality of pistons to obtain an axial reciprocal movement of each of said plurality of pistons upon rotation of said rotating shaft;

each of said respective piston chambers having a volume which alternately increases and decreases upon said axial reciprocal movement of a corresponding one of said plurality of pistons;

said cylinder block forming therein an intake pressure chamber that is connected to a source of a medium to be compressed, and forming therein an outlet pressure chamber for removing said medium as compressed;

intake means for controlling an introduction of said medium from said intake pressure chamber to said piston chambers, said intake means comprising a rotary valve that is rotatable with said rotating shaft; and discharge means for controlling a discharge of said medium from said piston chambers to said outlet pressure chamber;

said rotary valve and a valve cylinder for said rotary valve being made from materials having different coefficients of thermal expansion, such that a first coefficient of thermal expansion of said rotary valve is larger than a second coefficient of thermal expansion of said valve cylinder so as to prevent, during a normal operation, an outer diameter of said rotary valve from exceeding an inner diameter of said valve cylinder.

10. A compressor according to claim 9, wherein:

said valve cylinder is made of an aluminum based alloy material; and said rotary valve is made of a plastic material.

11. A compressor according to claim 10, wherein a clearance between said rotary valve and said valve cylinder is in a range equal to or larger than 15 μm and smaller than 30 μm.

12. A compressor according to claim 9, wherein said intake means comprises:

a rotary valve that is axially slidable with respect to said rotating shaft while rotating together with said rotating shaft; and axial position control means for controlling an axial position of said rotary valve on said rotating shaft;

said rotary valve providing successive control of a communication between said intake pressure chamber and said piston chambers at a respective range of a rotating angle within one complete rotation of said rotary valve, said rotating angle being controlled in accordance with said axial position of said rotary valve as controlled by said axial position control means.

13. A variable capacity swash plate type compressor comprising:

a rotating shaft adapted for connection to a source of a rotating movement;

a cylinder block rotatably connected to said rotating shaft, said cylinder block forming a plurality of circumferentially spaced cylinder bores each extending parallel to an axis of said rotating shaft;

a plurality of pistons axially and slidably stored in respective ones of said plurality of circumferentially spaced cylinder bores forming a respective piston chamber on respective sides of said plurality of pistons;

a swash plate fixedly connected to said rotating shaft and connected to said plurality of pistons to obtain an axial reciprocal movement of each of said plurality of pistons upon rotation of said rotating shaft;

each of said piston chambers having a volume which alternately increases and decreases upon said axial reciprocal movement of a corresponding one of said plurality of pistons;

said cylinder block forming therein an intake pressure chamber that is connected to a source of a medium to be compressed, and forming therein an outlet pressure chamber for removing said medium as compressed;

intake means for controlling an introduction of said medium from said intake pressure chamber to said piston chambers; and discharge means for controlling a discharge of said medium from said piston chambers to said outlet pressure chamber;

said intake means comprising:

a rotary valve that is axially slidable with respect to said rotating shaft while rotating together with said rotating shaft, and axial position control means for controlling an axial position of said rotary valve on said rotating shaft;

said rotary valve providing successive control of a communication between said intake pressure chamber and said piston chambers at a respective range of a rotating angle within one complete rotation of said rotary valve, said rotating angle being controlled in accordance with said axial position of said rotary valve as controlled by said axial position control means, and said rotary valve and a valve cylinder for said rotary valve being made from materials having different coefficients of thermal expansion such that a first coefficient of thermal expansion of said rotary valve is larger than a second coefficient of thermal expansion of said valve cylinder so as to prevent, during a normal operation, an outer diameter of said rotary valve from exceeding an inner diameter of said valve cylinder.

* * * * *

UNITED STATES PATENT AND TRADEMARK OFFICE

CERTIFICATE OF CORRECTION

PATENT NO. : 5,478,212

DATED : December 26, 1995

INVENTOR(S) : SASAKI et al.

It is certified that error appears in the above-identified patent and that said Letters Patent is hereby corrected as shown below:

Title page, item

[63] Continuation-in-part of Ser. No. 26,058, Mar. 13, 1993, Pat. No. 5,362,208 should read

[63] Continuation-in-part of Ser. No. 26,058, Mar. 3, 1993, Pat. No. 5,362,208

Signed and Sealed this

Eleventh Day of February, 1997

Bruce Lehman

*Attest:*

BRUCE LEHMAN

*Attesting Officer*

*Commissioner of Patents and Trademarks*